US006151046A

United States Patent [19]

Abe et al.

[11] Patent Number: 6,151,046

[45] Date of Patent: Nov. 21, 2000

[54] RECORDING HEAD UNIT AND RECORDING APPARATUS USING THE SAME

[75] Inventors: Tsutomu Abe, Isehara; Tsunenobu Satoi; Masami Ikeda, both of Yokohama; Seiji Suzuki, Kawasaki; Naohito Asai, Yokohama; Tsuyoshi Orikasa, Kasukabe; Seiichiro Karita, Yokohama; Eiichiro Shimizu, Urawa; Masahiko Higuma, Tohgane, all of Japan

[73] Assignee: Canon Kabushiki Kaisha, Tokyo, Japan

[21] Appl. No.: 08/728,858

[22] Filed: Oct. 10, 1996

Related U.S. Application Data

[63] Continuation of application No. 08/099,655, Jul. 30, 1993, abandoned.

[30] Foreign Application Priority Data

| | | | |
|---|---|---|---|
| Jul. 30, 1992 | [JP] | Japan | 4-203680 |
| Mar. 23, 1993 | [JP] | Japan | 5-086854 |
| May 7, 1993 | [JP] | Japan | 5-130089 |
| May 25, 1993 | [JP] | Japan | 5-122638 |
| May 25, 1993 | [JP] | Japan | 5-122977 |

[51] Int. Cl.[7] ..... B41J 2/01

[52] U.S. Cl. ..... 347/50

[58] Field of Search ..... 347/49, 50, 86, 347/87

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,635,078 | 1/1987 | Sakurada et al. | 346/140 R |
| 4,635,080 | 1/1987 | Watanabe | 347/50 |
| 4,723,129 | 2/1988 | Endo et al. | 346/1.1 |
| 4,740,796 | 4/1988 | Endo et al. | 346/1.1 |
| 4,774,529 | 9/1988 | Paranjpe et al. | 347/43 |
| 4,907,018 | 3/1990 | Pinkerpell et al. | 346/139 R |
| 5,608,434 | 3/1997 | Wilson et al. | 347/50 |

FOREIGN PATENT DOCUMENTS

| | | |
|---|---|---|
| 0240710 | 10/1987 | European Pat. Off. . |
| 0313205 | 4/1989 | European Pat. Off. . |
| 0380199 | 8/1990 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 3-55253 | 3/1991 | Japan . |
| 4-206752 | 7/1992 | Japan . |
| 5-16339 | 1/1993 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recording apparatus using a recording head to effect recording on a recording material includes a recording head unit provided with a recording head for effecting recording on a recording material including a recording head supporting member for supporting the recording head at a predetermined position; a relaying electric contact member including a first electric contact member for external electric connection; a second electric contact for electrically connecting the first electric contact member with the recording head; and an electric current supplying device for supplying electric current to the first electric contact member.

18 Claims, 53 Drawing Sheets

RECORDING HEAD UNIT AND RECORDING APPARATUS USING THE SAME

This application is a continuation of application Ser. No. 08/099,655 filed Jul. 30, 1993, now abandoned.

FIELD OF THE INVENTION AND RELATED ART

The present invention relates to a recording head unit and a recording apparatus using the same, more particularly to a recording head unit having a plurality of recording heads and a recording apparatus using the same.

A recording apparatus usable with a detachable recording head is known. In the field of ink jet recording apparatus, increasing number of apparatuses are used with detachably mountable recording heads. In this case, various advantageous effects are provided, but corresponding problems arise. As one of the problems, the relative problems between or among the recording heads are to be correctly assured. As another problem, the electric connection has been properly established between the recording head and the main assembly of the recording apparatus.

As for the first mentioned problem, the respective recording heads are mounted on the carriages, and at that time, the correct positional relations are required to be established between or among the recording heads.

Japanese Laid-Open Patent Application No. 16339/1993 proposes a recording head mounting structure in which the recording heads are mounted and urged to a predetermined reference surface, and the connector of the main assembly is made displaceable, so that no unnecessary force is applied to the electric contacts of the recording head, thus assuring the positional accuracy of the recording head.

Japanese Laid-Open Patent Application No. 55253/1991 deals with the similar problem, in which when a head cartridge of a cartridge type having an integral recording head and ink container, is to be mounted, the cartridge is movable relative to contacts of the main assembly, and the correct positioning is established by the movement, thus permitting easy mounting by the users.

The latter proposal is directed to the position of the electric contacts of the recording head. More particularly, the recording head is disposed close to a recording material to assure the recording accuracy, and therefore, the electric contacts of the recording head is frequently disposed close to the recording material. In such a case, the electric contacts are contaminated by the paper dusts produced from the recording material. In addition, ink mist produced by the ejection of the ink from the recording head may contaminate the electric contacts.

Against the contamination of the electric contacts, it has been proposed to use a cover or the like to protect the electric contacts. If an attempt is made to place the electric contacts only remote from the recording material for the purpose of avoiding the above problem, the positional accuracy with the contacts of the main assembly is deteriorated.

When a plurality of recording heads are used for the purpose of color recording or the like, the ink supply portion, ejecting portion and positioning portion or the like of each of the recording heads are spatically efficiently disposed. Therefore, the electric contacts of the recording head are frequently in the form of a card edge.

However, this involves another problem.

Upon the mounting of the recording head, the recording head is positioned, and the electric connections are established. In this case, it is possible that the force tending to deform the recording head may be applied because of the possible error of the positioning between the main assembly and the recording head.

The recording head disclosed in the above-mentioned Japanese Laid-Open Patent Application No. 16339/1993 is generally in the form of a flat tip, and therefore, a twisting deformation or the like is significant. In addition, if vibration or impact are applied to the contacts of the main assembly, the contacts may be displaced with the result of the positional deviation of the recording head. In any event, the mounting structure involves the limit to the mechanical positional accuracy.

The deviation or deformation of the recording head result in positional or directional deviation of the ink ejection, and the deviations are enhanced with increase of the distance between the recording head and the recording material (head-sheet gap).

In the apparatus disclosed in the above described Japanese Laid-Open Patent Application No. 16339/1993, if the head-sheet gap is 1.4 mm, the distance from the recording head positioning reference to the recording head end is 1.6 mm, and the length of the recording head is 30 mm, the deviation of 1 mm in the contact results in approx. 100 micron deviation of the ink shot position on the recording sheet. If the density of the arrangement of the ejection outlets of the recording head is 360–400 dpi, the normal pixel pitch is 70–60 microns, and therefore, this shot deviation corresponds to approx. 1–1.5 pixels.

Such a large deviation of the ink shot position results in a remarkable deterioration of the print quality. Particularly when a plurality of recording heads having different color inks, the above-deviation results in incapability of reproduction of the intended color, and therefore, high quality color image can not be provided. The large shot position deviation may result in increase of the amount of the ink at a local position, and in this case, the ink may bleed in the recording material.

As a second point, the service life of the recording head is generally shorter than that of the main assembly of the recording apparatus. In view of this, the recording head is exchanged. With the structure disclosed in the Japanese Laid-Open Patent Application No. 16339/1993, relatively cumbersome and difficult operations are required in order for the operator to exchange the recording head and to position the recording heads with desired accuracy.

As a third point, with the structure disclosed in Japanese Laid-Open Patent Application No. 55253/1991, the operator can relatively easily exchange the recording head. However, since the recording head and the ink container are structurally integral, and therefore, both are required to be exchanged together even if one of them is usable without problem. In addition, the accuracy in the mechanical positioning of the plurality of the recording heads involves a limit. A structure is known in which the positional deviation is corrected by supply timing control of the ink ejection signal. However, it is required to supply the positional information to the recording head with the result of costly recording head.

In addition, as regards the position of the electric contacts, the contamination by the paper dust or the like has to be avoided. The provision of the cover or the like to avoid the problem requires the space therefor. In the case of a plurality of recording heads used, the electric contacts are in the form of card edges, and therefore, the use of the cover or the like is not proper.

In the structure in which the electric contacts are positioned remote from the recording sheet, the improper electric connection would result because of the inaccuracy of the contact positions.

Additionally, in the case of the card edge contacts, the cost of the contacts is relatively high, and the positional deviation problem of the recording head has been described in connection with the positioning among the recording heads, may arise.

SUMMARY OF THE INVENTION

Accordingly, it is a principal object of the present invention to provide a recording head unit and a recording apparatus using the recording head unit in which the recording heads are supported on a frame so that the recording heads are correctly positioned on the frame, and electric contacts and relaying connectors are connected with the positional accuracy maintained.

It is another object of the present invention to provide a recording head unit and a recording apparatus using the recording head units in which the relative positional accuracies between or among the recording heads are maintained without influence of the structure of the electric connection establishment mechanism.

It is a further object of the present invention to provide a recording head unit and a recording apparatus using the recording head unit having a highly reliable electric connection establishing mechanism with high accuracy and low cost.

It is a further object of the present invention to provide a recording head unit and a recording apparatus having an electrode structure, wherein the recording heads are mounted on a frame having positioning references for the respective recording heads, and electrodes contactable to a part of the recording head at the time of mounting thereof is used, to permit high quality image recording head by the positional accuracy among the recording heads.

It is a further object of the present invention to provide a recording head unit and a recording apparatus using the recording head unit in which the electric connection between the main assembly and a plurality of recording heads, is accomplished through a relaying contact member fixed on a member for supporting the recording head, and therefore, the positional accuracies between or among the recording heads is maintained with additional force to the recording head.

It is a yet further object of the present invention to provide a recording head unit and a recording apparatus having the recording head unit in which the electric contacts with the main assembly are provided on a side opposite from the ink ejection side surface, by which, the contamination of the electric contacts by the paper dust or ink mist or the like can be prevented.

It is a further object of the present invention to provide a recording head unit and a recording apparatus using the recording head unit in which the contact position of the relaying connector is of elastic material, or the wiring of the connector is of flexible material, by which the interference in the positional accuracy is prevented between the recording heads and the positional accuracy of the relaying connector contacts, so that a high quality image recording is accomplished.

It is a yet further object of the present invention to provide a recording head unit and a recording apparatus using the recording head in which the electrode portion and the relaying connector are connected in a recording head so as to maintain the positional accuracy between or among the recording heads, and a guiding rib of the relaying connector of the recording head unit is inserted along a guiding groove of the frame, and an engaging arm is engaged with a recess, and in addition a positioning pin is engaged in a positional hole.

It is a further object of the present invention to provide a recording head unit and a recording apparatus using the recording head unit in which the positional deviation of the recording head is prevented to maintain the image quality.

It is a further object of the present invention to provide a recording head unit and a recording apparatus using the recording head unit in which the recording head is positioned in a direction perpendicular to a main scan direction without abutting to a recording material carrying member, so that the positional deviation of the recording head due to the variation of the manufacturing accuracy of the carrying member.

According to an aspect of the present invention, there is provided a relaying electric contact member usable with a recording head unit having a recording head for effecting recording on a recording material, comprising: a first electric contact member for external electric connection; a second electric contact for electrically connecting the first electric contact member with the recording head.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
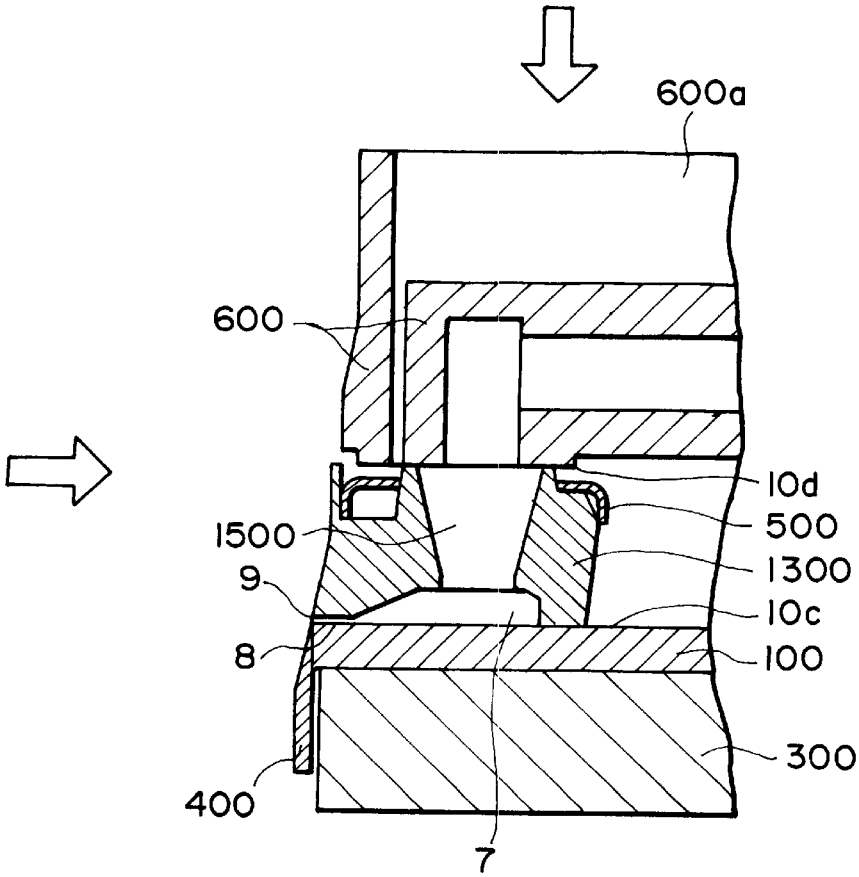
FIG. 1 is a sectional portion of a major portion of a recording head according to a first embodiment of the present invention.
Figure 2:
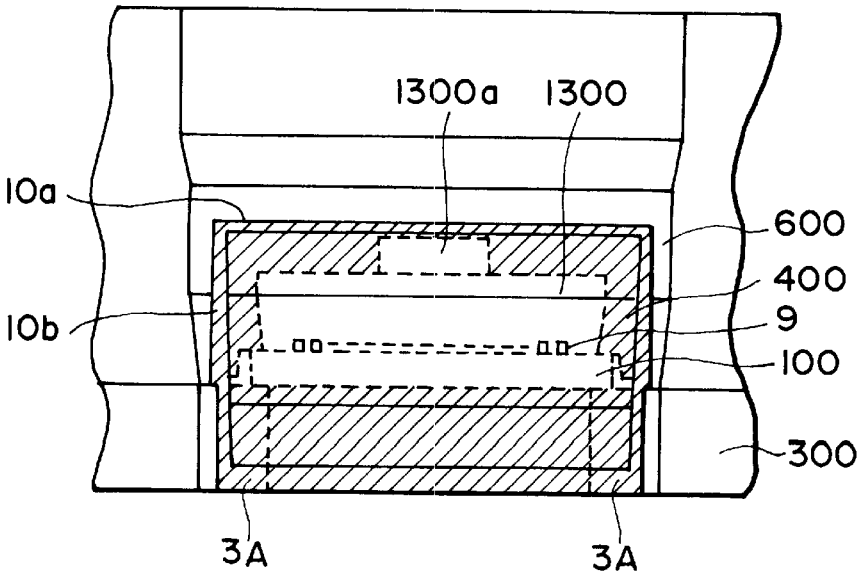
FIG. 2 is a front view of a major portion of a recording head of FIG. 1.

Referring to FIGS. 1 and 2, there is shown an ink jet head IJH according to an embodiment of the present invention. As shown in FIG. 1, the ink jet head IJH comprises a first base plate 1 (heater board) and a second base plate 2. The first base plate 1 being provided with ink ejection pressure generating elements 1, and the second base plate 2 being provided with recess and projection for constituting an ink chamber 7 and ink passages 8 for accommodating recording liquid (ink) by being connected with the base plate 1. The base plate 2 (top plate with grooves) is integrally provided with an orifice plate 4 having ink ejection outlet 9 for ejecting the ink and in communication with the ink passages 8.

The heater pole 1 is bonded and fixed by an adhesive on a supporting base plate 3. The top plate 2 having the grooves is temporarily bonded on the heater board 1 so that the ink ejection pressure generating elements (heaters) on the heater board 1 is aligned with the ink passages 8 of the top plate 2. Thereafter, it is fixed by mechanical urging force of a confining spring. An orifice plate 4 in the top plate 2 is in the form of an apron at a front edge of the supporting base plate 3.

The ink is supplied through an ink supply port 2*a* formed in the top of the top plate 2 from an ink supply member 5. The ink supply member 5 has a projection (not shown), which is inserted into a through hole formed in the supporting base plate 3, and is fixed by heat on the supporting plate 3. At this time, a uniform gaps 10*a* and 10*b* are formed between the orifice plate 4 and the ink supply member 5.

In FIGS. 1 and 2, a sealing material is supplied into gap 10*a* and 10*b* between the ink supply member 5 and the heater board 1 and the top plate 2 and into a gap between the orifice plate 4 and a front end surface of the supporting base plate 3. A groove 3A is sufficient to accommodate the sealing material.

A groove 3A formed in the supporting base plate 3 is continuous with the gap between the orifice plate 4 and the supply member 5. This is desirable. It is not preferable that the groove 3A is completely covered with the orifice plate 4, or is independently from the gaps 10*a* and 10*b*, because the flow of the sealing material ejected is blocked. The groove 3A formed at the front side of the supporting base plate 3 is manufactured by pressing, in consideration of the mass-production.

The sealing material is injected through a sealing injection inlet (not shown) formed at an upper portion of the ink supply member 5. The sealing member is effective to seal a wire bonding portion (not shown) for transmitting electric signals and to seal the gaps 10*a* and 10*b* between the orifice plate 4 and the ink supply member 5. The sealing material flows through the groove 3A to completely seal the gap between the orifice plate 4 and the supporting base plate 3. In order for the sealing material to accomplish the sealing of the small gap without plugging the orifices 9, it is required to have a proper thixotropy and a proper viscosity. If the viscosity thereof is too low, it enters the nozzles of the top plate 2 and the orifices 9 with the result of plugging them. If it is too high, on the contrary, the sealing material does not sufficiently extend to the peripheries of the orifice plate 4. The viscosity of the sealing material used in this embodiment is 1000–15000 cps, preferably 2000–10000 cps, and further preferably 4000–10000 cps.

The sealing material desirably has good bonding property with the heater board 1 of silicone wafer, the supporting base plate 3 of metal, the top plate 2, the orifice plate 4 and the ink supply member 5 or the like of a synthetic resin material. In order to connect the members of different materials having different thermal expansion coefficients, the sealing material desirable has a sufficient flexibility to accommodate the thermal expansion resulting from the temperature change, more particularly, it is desirable that the hardness thereof is not more than A100 (JIS).

On the other hand, the sealing member also functions to protect the wire bonding portion by covering it. In order to perform this function the sealing material preferably exhibits anti-corrosion relative to the aluminum wire bonding portion or aluminum electrodes. From this standpoint, the impurity ion content ($Cl^-$, $Na^+$ or the like is not more than 30 ppm). The material also exhibits resistivity against solvent and alkali resistance because it will be locally in contact with the ink. It also exhibits low permeabilities relative to oxygen, nitrogen and water vapor.

Ink Jet Head Unit

Figure 3:
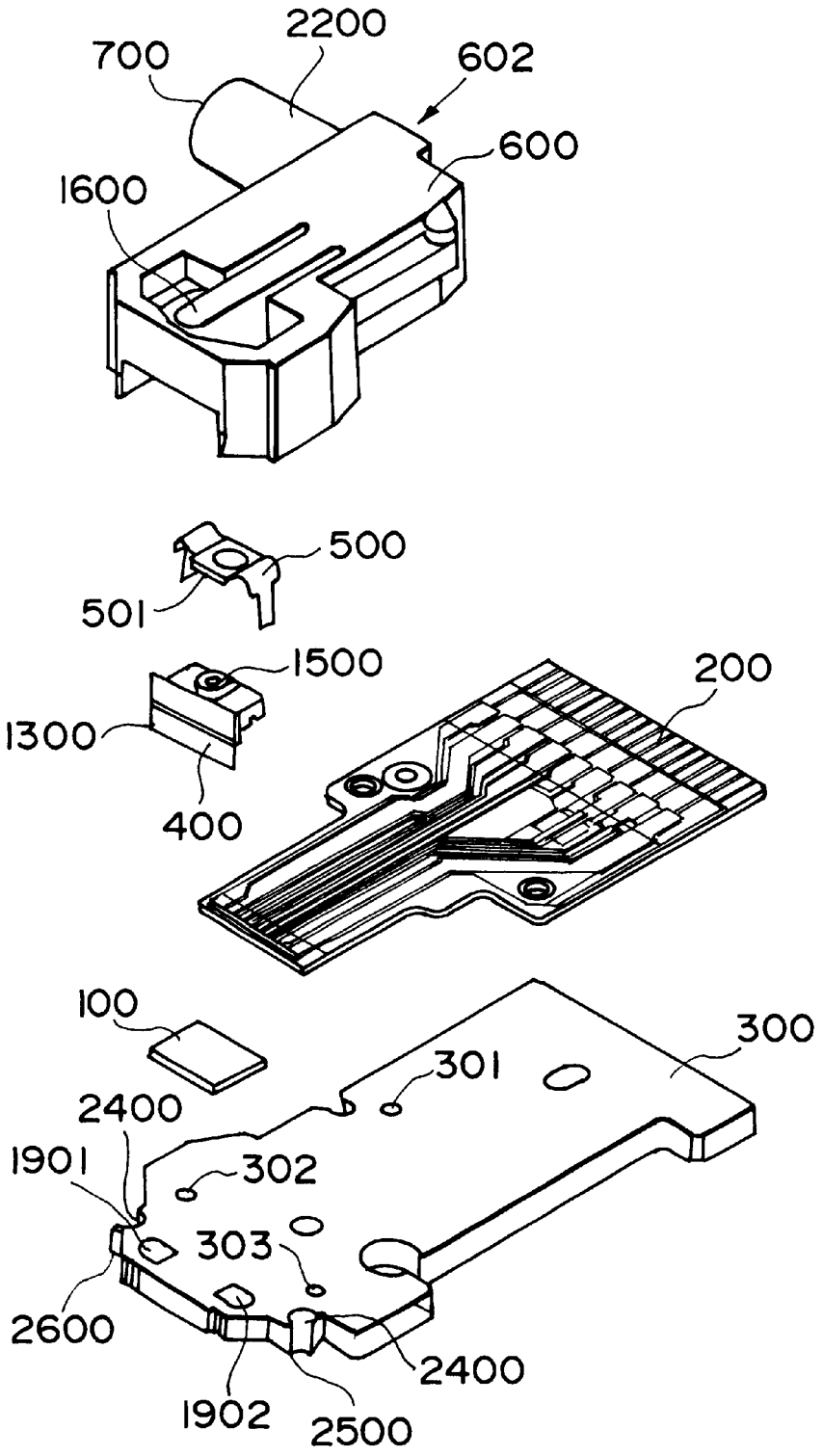
FIG. 3 is an exploded perspective view of the recording head shown in FIGS. 1 and 2.

FIG. 3 is an exploded perspective view of an ink jet head unit.

In FIG. 3, electrothermal transducers (ejection heaters) function as the thermal energy generating elements arranged in a plurality of lines on the base plate 100 of Si, and electric wiring of aluminum or the like for supplying the electric energy, are formed by film forming technique. The heat produced by the electrothermal transducer causes a film boiling of the ink, which is effective to eject the ink by formation of a bubble. The wiring board 200 comprises electric leads lines (to be connected through wiring bonding) corresponding to the wiring on the heater board 100, and pads for receiving electric signals from the main assembly at the end portions of the wiring. The top plate 1300 is provided with partition walls for defining a plurality of ink passages described hereinbefore and a recess for forming a common liquid chamber or the like for accommodating the ink to be supplied to the ink passages. It also integrally has an orifice plate 400 having a plurality of ink supply openings 1500 in communication with the common liquid chamber to receive the ink supplied from the ink container and an orifice plate 400 having a plurality of ejection outlets corresponding to the ink passages. The material thereof is preferably polysulfone, but another material is usable.

The supporting material 300 is made of metal such as aluminum and functions to support the backside of the wiring board 200. A confining spring 500 is in the form of "M", and the center thereof urges such a portion of the top plate as to correspond to the common liquid chamber with light pressure, and an apron 501 concentratedly urges by a line pressure a portion corresponding to the ink passages, preferably, the portion adjacent to the ejection outlets. The heater board 100 and the top plate 1300 are clamped by legs of the confining spring engaging with the backside of the supporting plate 300 through holes 1901 and 1902 of the supporting member 300. By the concentrated urging force of the apron 501 of the confining spring 500, the heater board 100 and the top plate 1300 are securedly fixed. The mounting of the wiring board 200 relative to the supporting member 300 is effected by an adhesive or the like. Recesses 2400 and 2400 of the supporting member 300 are formed at positions adjacent to positioning projections 2500 and 2600, and the ink supply passage defining member 600 has an ink conduit 1600 in communication with the ink supply pipe 200 in the form of a canti-lever fixed at the side adjacent to the supply pipe 2200, and a sealing ball 602 is inserted thereinto to assure the capillary force in the ink supply pipe 2200 and the fixed side of the ink conduit. A filter 700 is provided at an ink container side end of the supply pipe. The ink supply passage 600 is molded, and therefore, dimensions thereof are accurate, and the manufacturing cost is low. In addition, the canti-lever structure of the conduit 1600 permits the stabilized press-contact of the conduit 1600 to the ink supply port 1500 even if it is mass-produced. In this example, a better communication state can be provided assuredly simply by supplying the sealing bonding material from the ink supply member side with the urged state. For the fixing of the ink supply passage defining member 600 to the supporting member 300, backside pins (not shown) of the ink supply passage defining member 600 through the holes 301, 302 and 303 of the supporting member 300, and the projected portions of the pins are heat-fused. Therefore, the fixing is simply performed.

Figure 4:
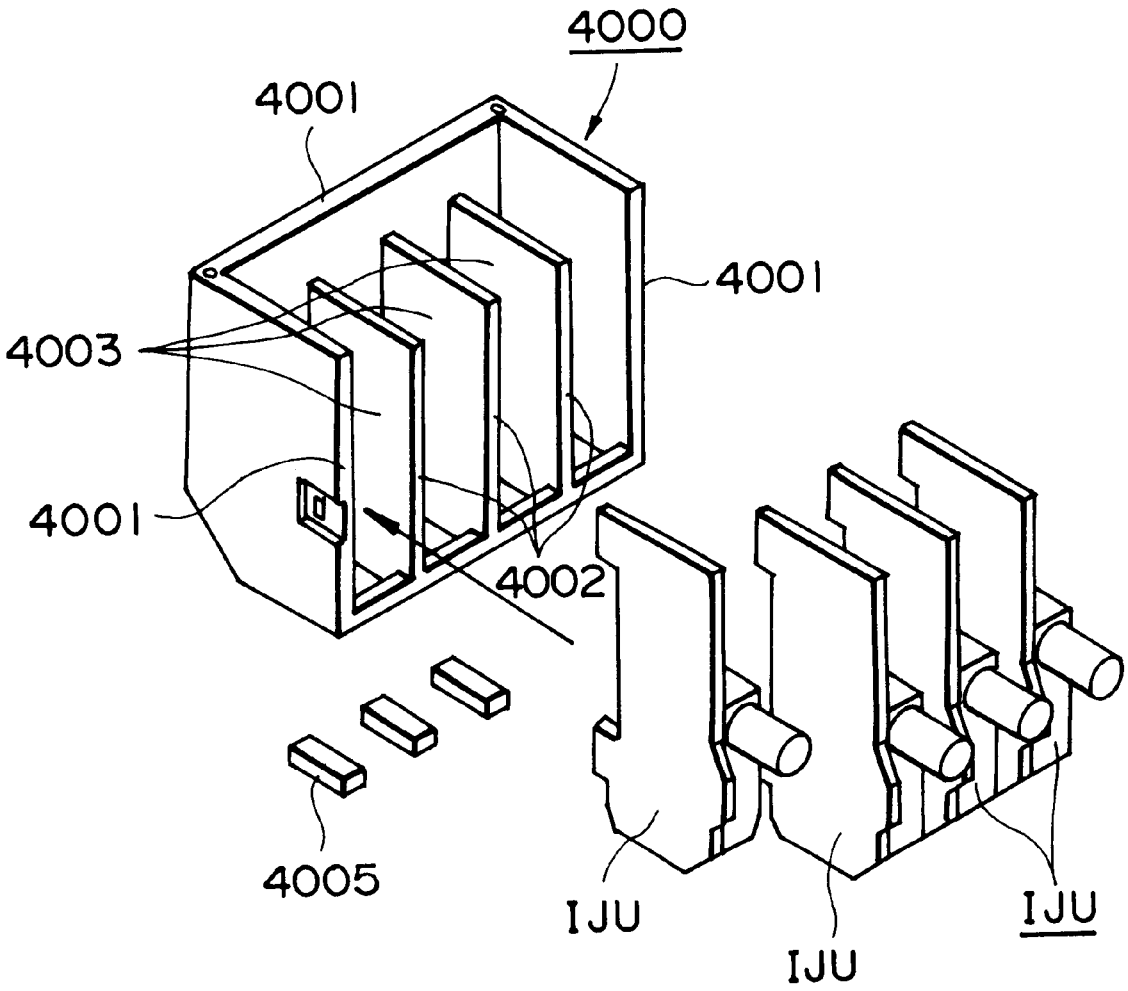
FIG. 4 is an exploded perspective view, without housing, of a recording head unit comprising a plurality of the recording heads as shown in FIGS. 1, 2 and 3.
Figure 5:
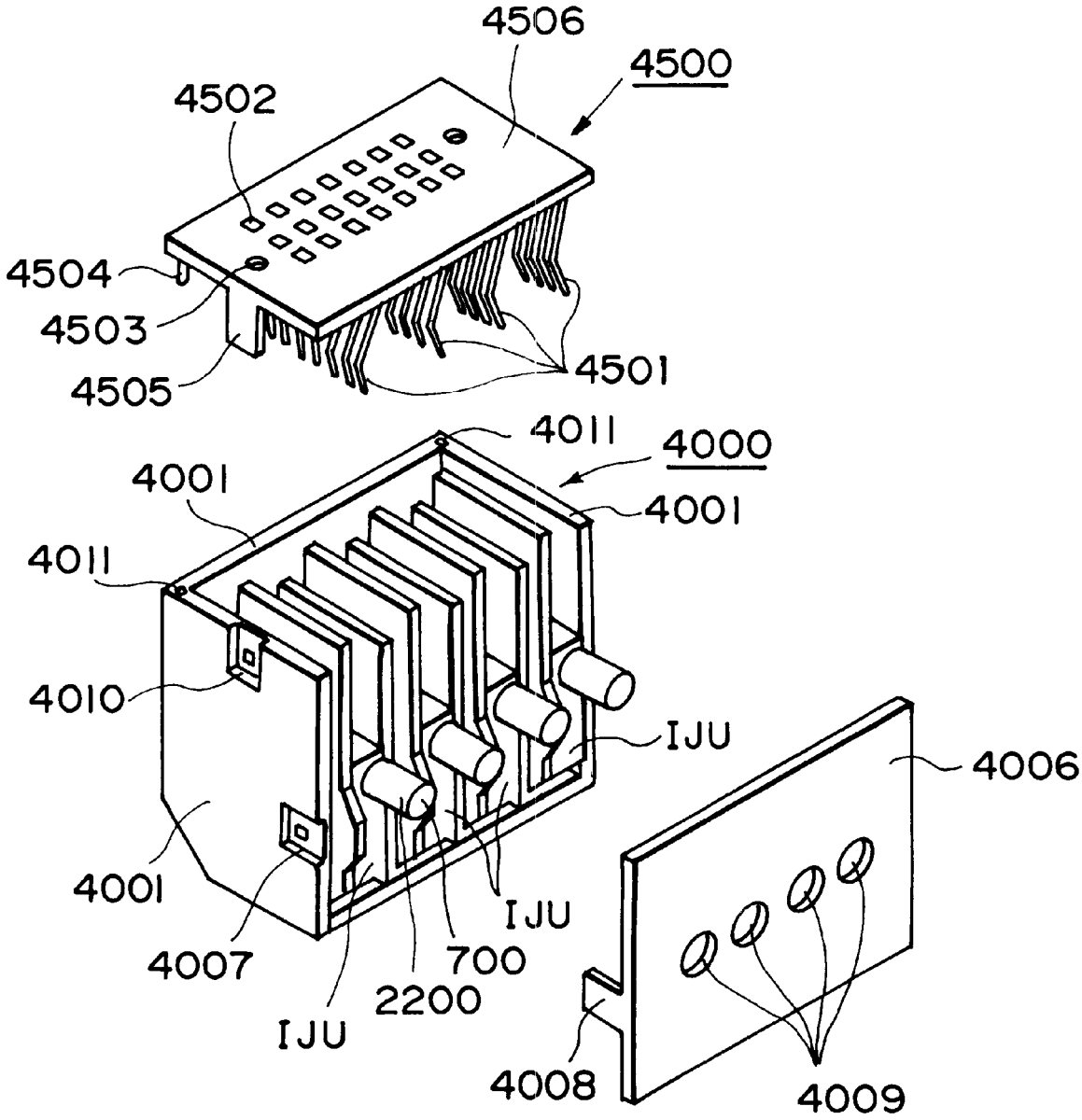
FIG. 5 is an exploded perspective view of the recording head unit.

FIGS. 4 and 5 are exploded perspective views of the recording head unit having a plurality of recording heads. The recording head unit will be described in conjunction with FIGS. 8 and others, hereinafter. In FIG. 4, a housing member of the upper unit is omitted for explanation.

In this embodiment, the recording head unit has four recording heads capable of ejecting different color inks. The recording head unit can determine the positional relationship among the recording heads. The four recording heads may eject the same color inks. In this case, a high speed printing or tone reproduction corresponding to number of ink droplets, may be accomplished. The tone reproduction can be effected also by ejecting the same color but different density inks.

In FIG. 4, a reference numeral 4000 designates a unit frame. The unit frame 4000 comprises an outer wall plate 4001 having a configuration shown in FIG. 4, and three inner walls 4002 for defining recording head supporting portions 4003 for accommodating the recording heads. The recording head IJH having been described in conjunction with FIGS. 1, 2 and 3, are accommodated in the head supporting portion 4003 with the ejection outlet side facing down in the Figure. For the positioning of each of the recording heads in the unit frame 4000, reference surfaces of each of the recording heads are abutted to three reference surfaces in the associated head supporting portion, and thereafter, they are bonded by an adhesive. In this case, the reference surfaces of each of the recording head units IJU and the orifices thereof, are in the predetermined positional relationship relative to each other with high accuracy.

Figure 13:
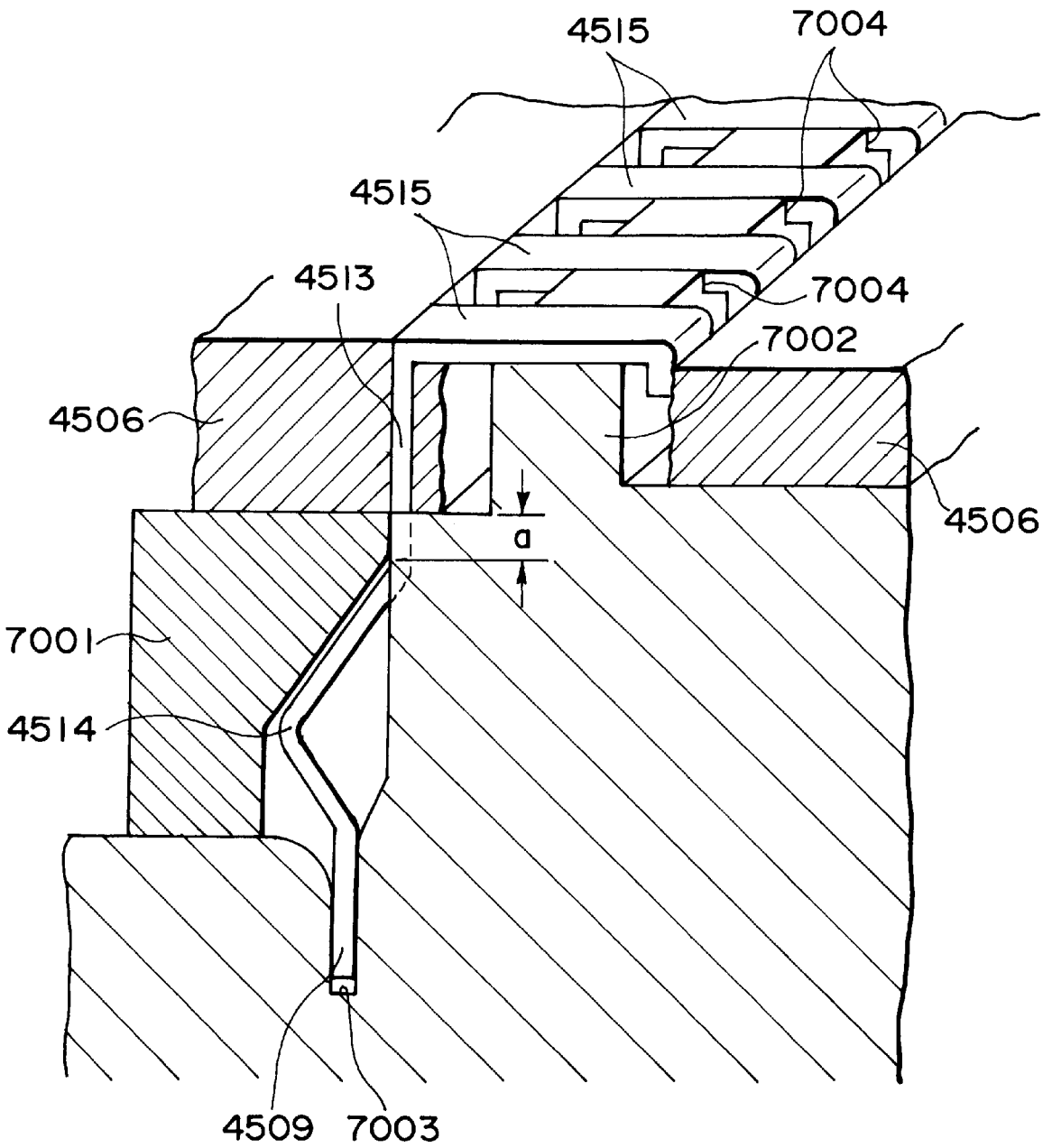
FIG. 13 is a perspective view illustrating an example of manufacturing the connector with metal mold.

Thus, in this embodiment, the four recording heads are securedly fixed by the adhesive in the unit frame, and the recording heads are exchanged as a unit, and therefore, the relative relations among the four recording heads are not deteriorated even by the head exchanging operation. Since the recording heads are accommodated and fixed in the unit frame, there are a wide latitude in design compared with the recording head having integral ejection outlets for ejecting different color inks. As an example, various recording head units as shown in FIG. 13 which will be described hereinafter, can be manufactured.

In FIG. 4, reference numeral 4005 designates a porous material capable of absorbing and retaining ink, and is disposed between orifice side surfaces of adjacent recording heads IJH. The ink absorbing materials function to absorb the ink from a cleaning blade, when it is carrying out the wiping operation. By doing so, the ejection side surfaces of the recording heads can be prevented from being contaminated with a different color ink.

In FIG. 5, a top housing 4506 and side housings 4006 are fixed on the unit frame 4000. For the fixing of the top housing a pair of pins 4504 (only one is shown) of the top housing are inserted into holes 4011 formed in the top end surface of the outer wall 4001 of the unit frame 4000, by which the top housing is correctly positioned, and a projection (not shown) of a locking plate 4505 formed at each of the ends of the top housing is engaged with a recess 4010 formed in the outer wall 4001, so that they are securedly fixed. For the fixing of the side housing 4006 to the unit frame, the same mechanism is used as with the top housing 4506, using a pair of locking plates 4008 of the housing 4006 and recesses 4007 of the unit frame 4000.

On an outer surface of the top housing 4506, there are provided pads 4502 functioning as electric contacts of the recording head unit IJU, and the respective pads are in connection with terminals 4501 extending from the inner surface of the top housing 4506. When the housing 4506 is fixed on a unit frame, the respective terminals 4501 are in contact with the associated connecting pads on a base plate of the recording heads.

A side housing 4006 is provided with holes 4009 for permitting insertion of ink supply pipes 2200 for the recording head unit IJU.

Figure 6:
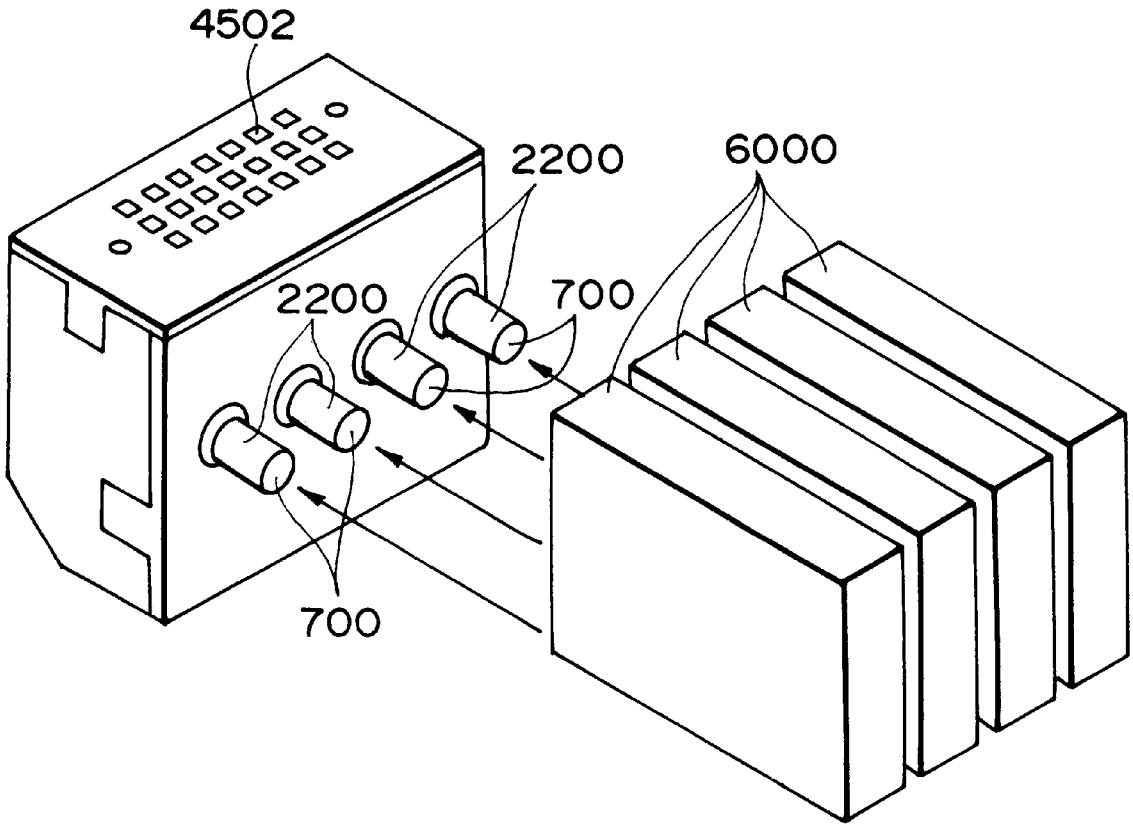
FIG. 6 is a perspective view illustrating connection between the recording head unit shown in FIGS. 4 and 5 and an ink container.

FIG. 6 is a perspective view illustrating connection between the recording head unit shown in FIGS. 4 and 5 and respective ink containers.

As shown in FIG. 6, the ink containers 6000 containing color inks are connected with the recording head such that the ink supply pipes 220 of the recording head are inserted into the respective openings of the joint portions (not shown) of the ink container. When the ink container 6000 is removed from the recording head, any one of the ink containers can be taken out independently from the other ink containers.

Figure 7:
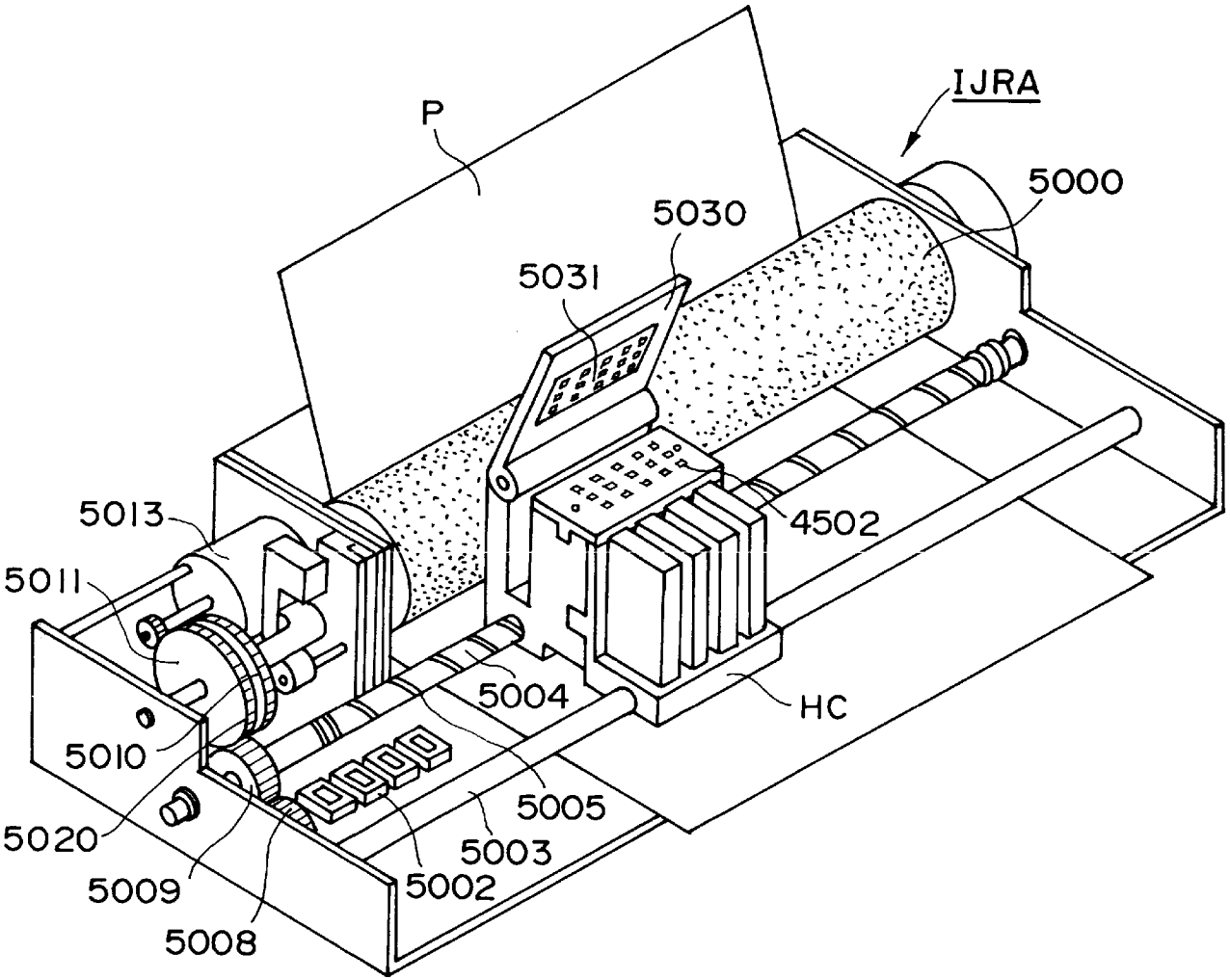
FIG. 7 is a perspective view of an ink jet recording apparatus using the recording head shown in FIGS. 4 and 5.

FIG. 7 is a perspective view of an ink jet recording apparatus IJRA usable with the recording head unit described hereinbefore.

In FIG. 7, the forward or backward rotation of the driving motor 5013 is transmitted to a lead screw 5004 through transmission gears 5001 and 5009 to rotate the lead screw 5004. A carriage HC is provided with an unshown pin engaged in a helical groove 5005 of the lead screw 5004, so that the carriage HC is reciprocated in a longitudinal direction of the apparatus. A cap 5002 for capping a front side of the recording head in the recording head unit is used for sucking and recovering the recording head with the aid of unshown sucking means. The cap 5002 is moved by a driving force transmitted through a gear 5008 or the like to cover the ejection side surface of any of the recording heads. Adjacent the cap 5002, there is provided a cleaning blade (not shown), which is supported for vertical movement in the Figure. The blade is not limited to this disclosed here, but any known cleaning blade is usable. The capping, cleaning and sucking recovery operations are carried out at proper positions by the lead screw 5005 when the carriage is moved to the home position. Any other timing for these operations is usable. The connection pads 4502 of the recording head unit are electrically connected with the connection pads 5031 by rotation of a connecting plate 5030 on the carriage HC about its rotational axis, when the recording head unit is mounted on the carriage HC. Thus, the electrical connection is established. As will be described hereinbefore, no connector is used for the establishment of electric connection, and therefore, no additional force is applied to the recording head unit.

The description will be made as to the recording head unit usable with the ink jet recording apparatus.

Figure 8:
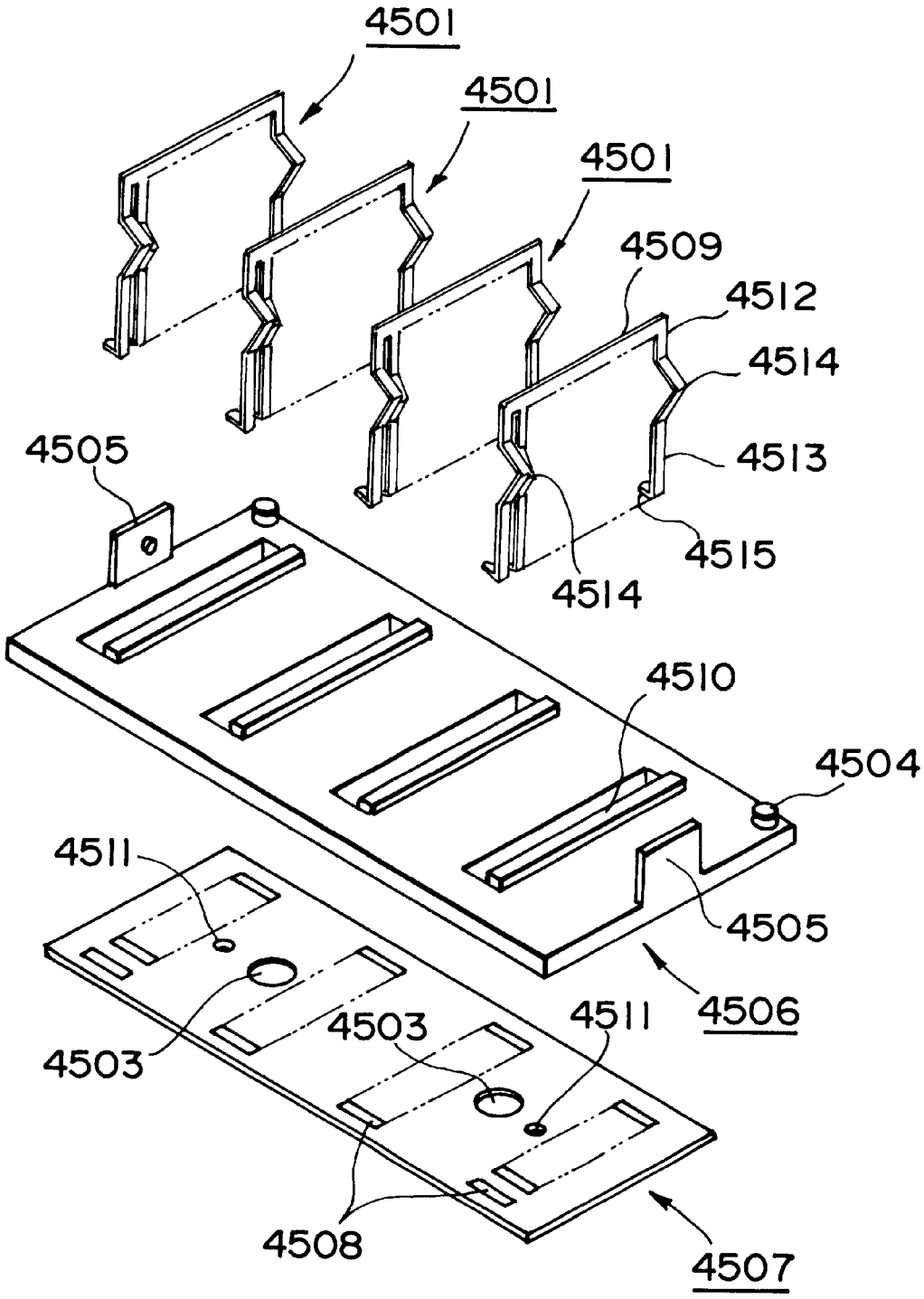
FIG. 8 is an exploded perspective view illustrating a manufacturing process of a retaining connector in a housing member of the recording head unit.

FIG. 8 is an exploded perspective view at a initial stage of manufacturing. In FIG. 8, each of the terminals 4501 comprises a plurality of contact members 4512 having contacts 4504, and a connector for connecting the plurality of contact members 4512. The connectors will finally be cut out. The contact 4514 is projected substantially at the center of the contact member 4512. A fixed side 4513 adjacent the end portion of the contact member 4512 is fixed on the top housing 4506, so that the terminal 4501 is fixed to the top housing 4506. An end of the contact member 4512 constitutes a contact 4515 for connection with the pad 4508 on the wiring board 4507.

The top housing 4506 is provided with holes 4510 corresponding to the plurality of terminals 4501. The contact 4515 of the terminal 4501 and the pad 4508 of the wiring board 4507 are soldered by application of a laser beam through the hole 4510. If re-flow soldering is used in place of the laser soldering, the thermal energy can be applied through the hole 4510. The top housing 4506 is further provided with pins 4504 for positioning with the unit frame 4000 and fixing tongue 4505 for fixing the top housing 4506 on the unit frame 4000.

The wiring board 4507 to be joined with the top housing 4506 is provided with positioning holes 4511 engageable with unshown pins of the housing 4506. Also, it is provided with positioning holes 4503 for the positioning with the electric contacts of the recording apparatus. On a front side (bottom side in FIG. 8 now shown) of the wiring board 4507, connection pad 4502 shown in FIG. 5 are formed.

Figure 9:
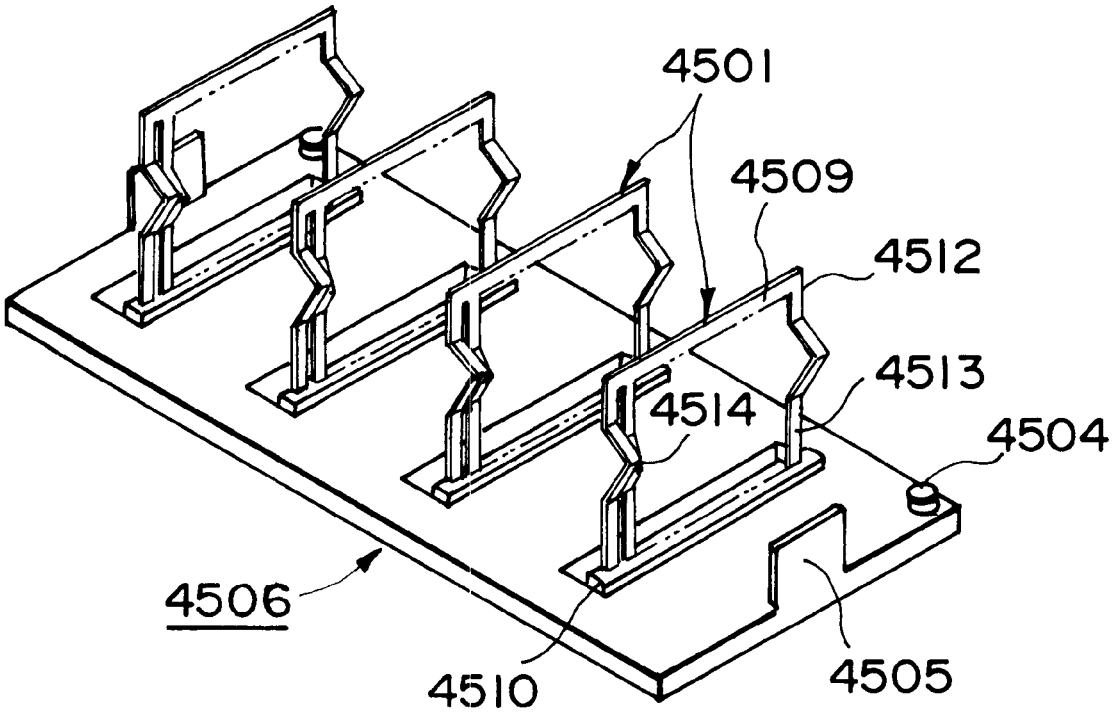
FIG. 9 illustrates a process step subsequent to that shown in FIG. 8, and is an exploded perspective view in which contacts shown in the Figure are mounted on the housing.
Figure 9:
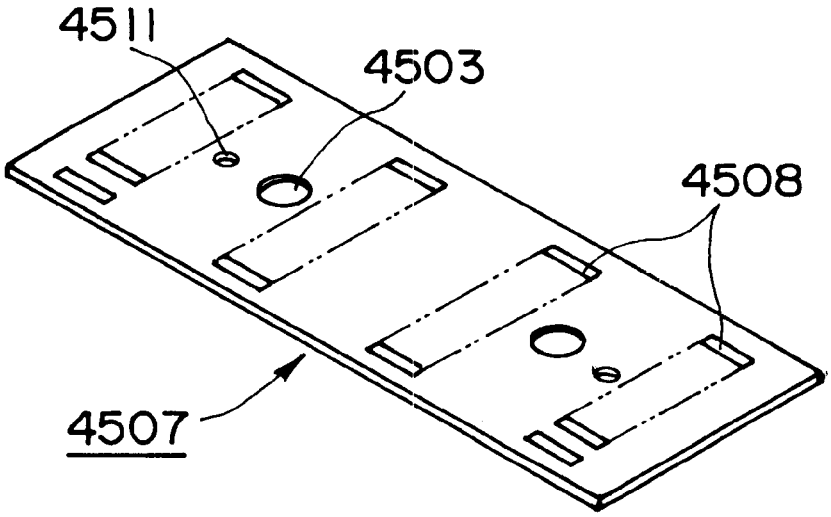

FIG. 9 is a perspective view in which the terminals 4501 are assembled on the top housing 4506. At this manufacturing stage, the connector 4509 still connects the contact members 4512. As regards the assembling of the terminals 4501 and the housing 4506, the description will be made hereinafter.

Figure 10:
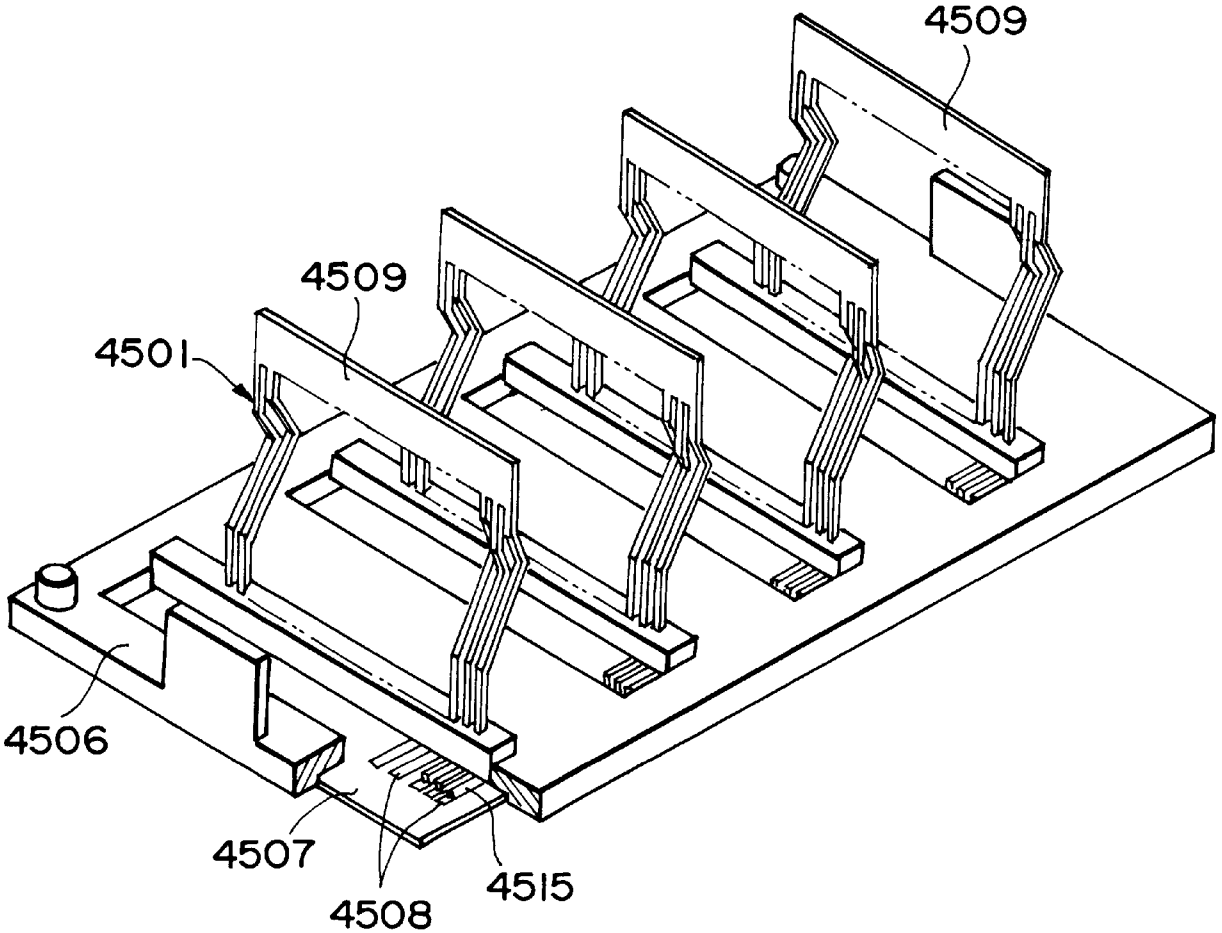
FIG. 10 is an exploded perspective view illustrating a process step subsequent to that shown in FIG. 9, wherein the connection between the contacts and the pads of the wiring board is illustrated.

FIG. 10 is a perspective view in which the wiring board 4507 is joined with the top housing 4506, at this stage, the pads 4508 of the board 4507 are connected with the contacts 4515 of the terminals 4501 by soldering. Still, the connector 4509 connects the contact members.

Figure 11:
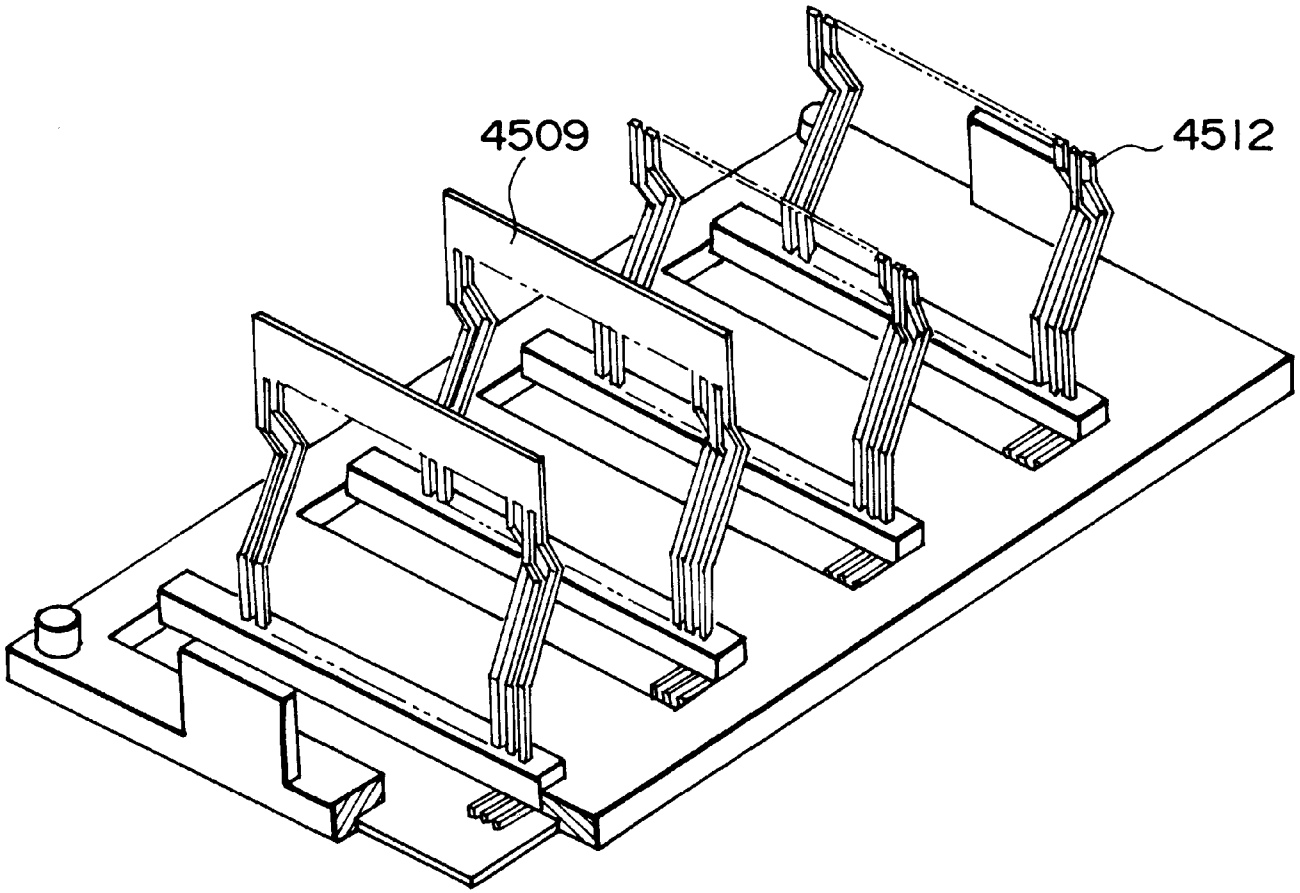
FIG. 11 is a perspective view illustrating a process step subsequent to that shown in FIG. 10, in which a connecting portion for connecting various connecting members for the contacts, is cut.

FIG. 11 is a perspective view in which the connectors 4509 are being cut away.

The connectors 4509 are cut away such that the remaining end portions of the contact members 4512 are substantially flash with each other. The reason for this is for the purpose of easy cutting operation, and therefore, the flash arrangement is not inevitable.

Figure 12:
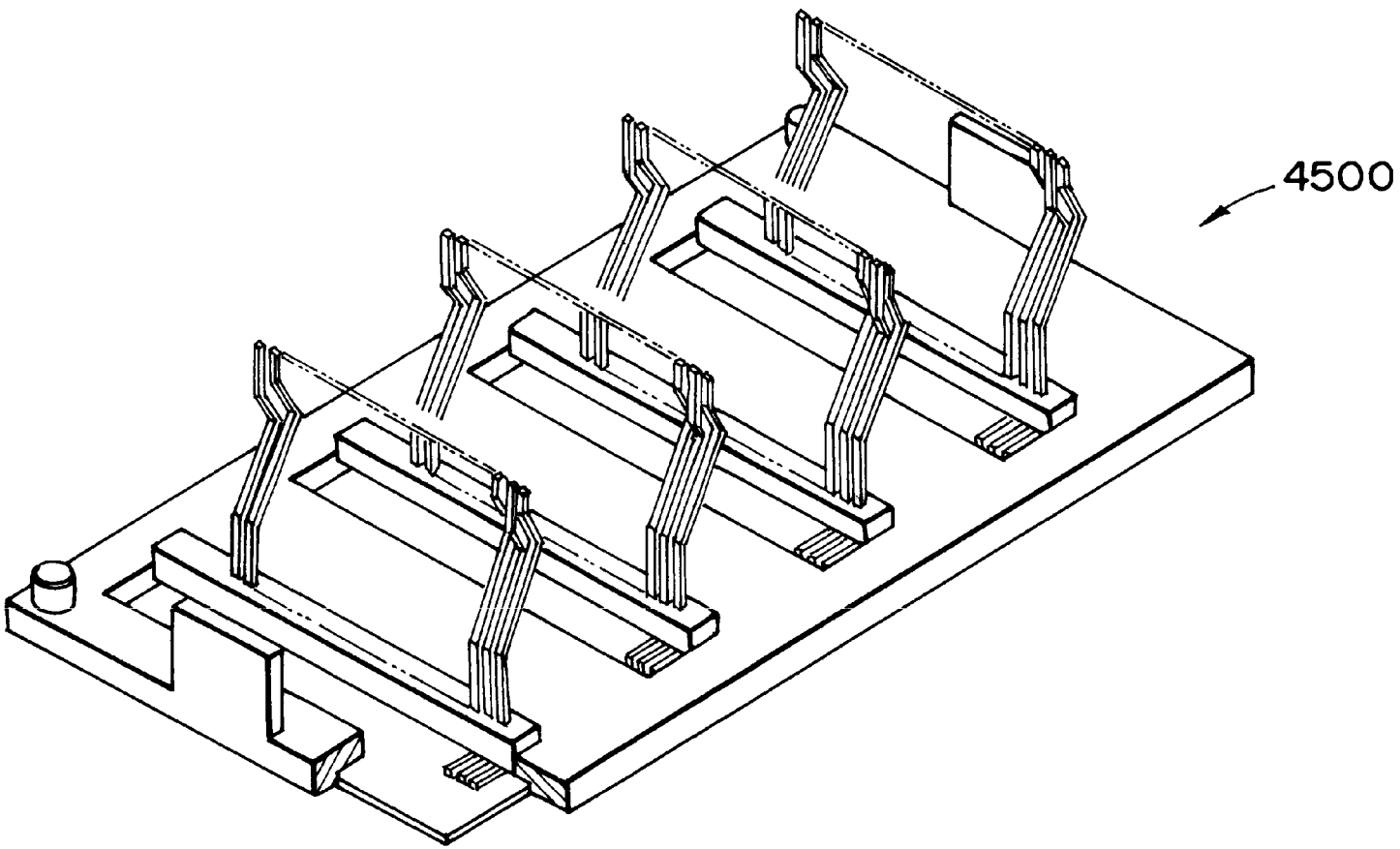
FIG. 12 is a perspective view illustrating a produced relaying connector functioning also as a housing of the recording head unit.

FIG. 12 is a perspective view in which all of the connectors 4509 are cut away, at which stage, a relaying connector 4500 is completed.

Figure 14:
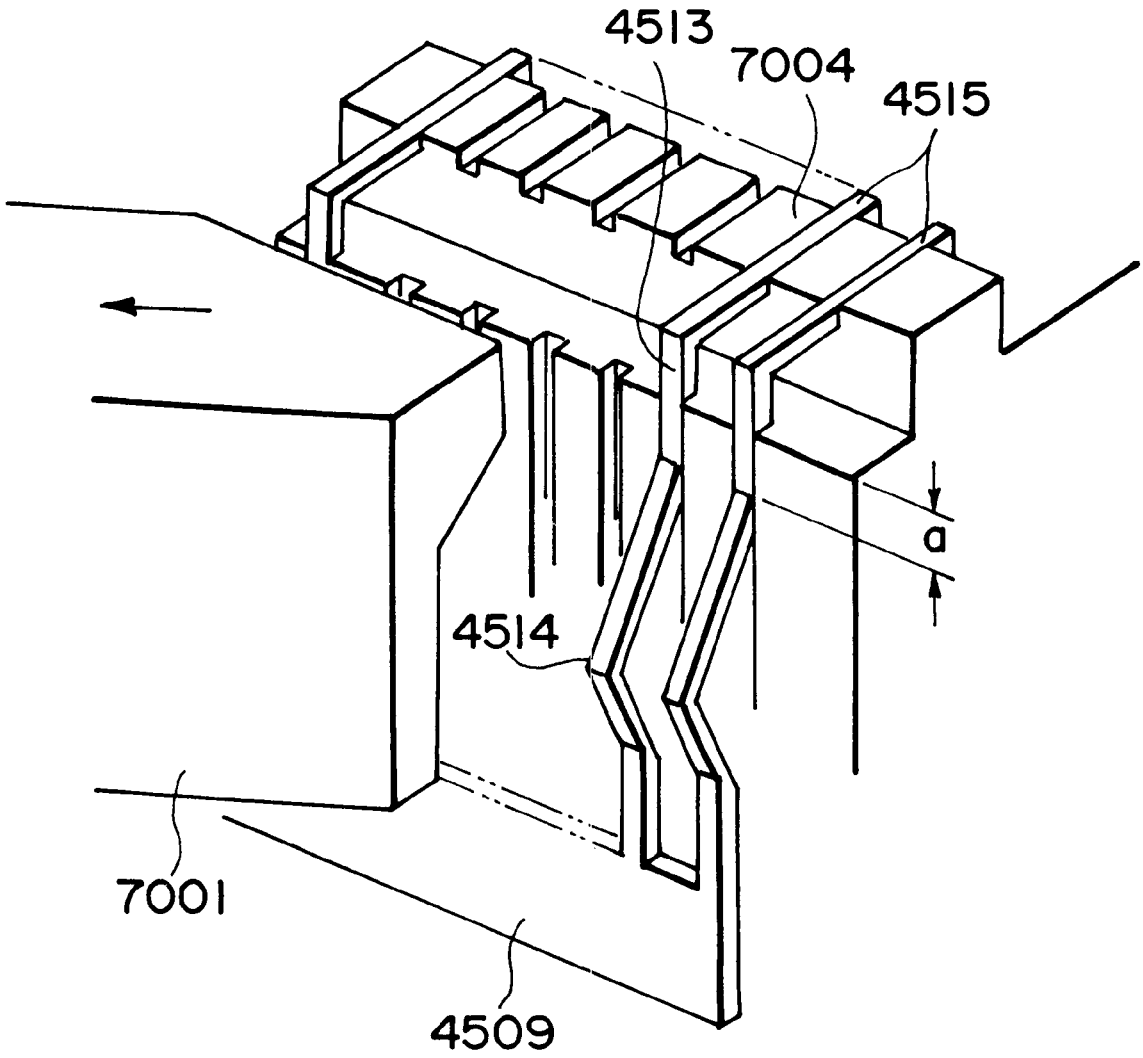
FIG. 14 is a perspective view of an example in which the connector is manufactured using a mold.

FIGS. 13 and 14 are perspective view in which the terminals 4501 are mounted in the housing 4506 by insert molding.

In this Figure, reference numeral 7002 designates a core of a metal mold, and the core has a comb-like portion 7004 engageable with the contacts 4505 of the terminals 4501. The connector 4509 of the terminal 4501 is inserted into a slit 7003 of the metal mold for the positioning and fixing. A part of the fixing portion 4513 of the terminal 4501 is sandwiched and fixed between the metal mold and a slide 7001 which functions as another metal mold. A relief is formed in the slide 7001 so that the slide 7001 is kept from contact with the contacts 4514 upon the sandwiching.

Then, a resin material constituting the housing is supplied, thus effecting inserting molding, so that the housing 4506 is formed by the cavity provided by the metal molds. Thus, the terminals 4501 are assembled at the same accuracy of the metal molds, relative to the housing 4506. The number of contacts required for a single recording head are connected by the connector 4509, and therefore, the setting operation of the terminal 4501 in the metal mold is easy.

Figure 15:
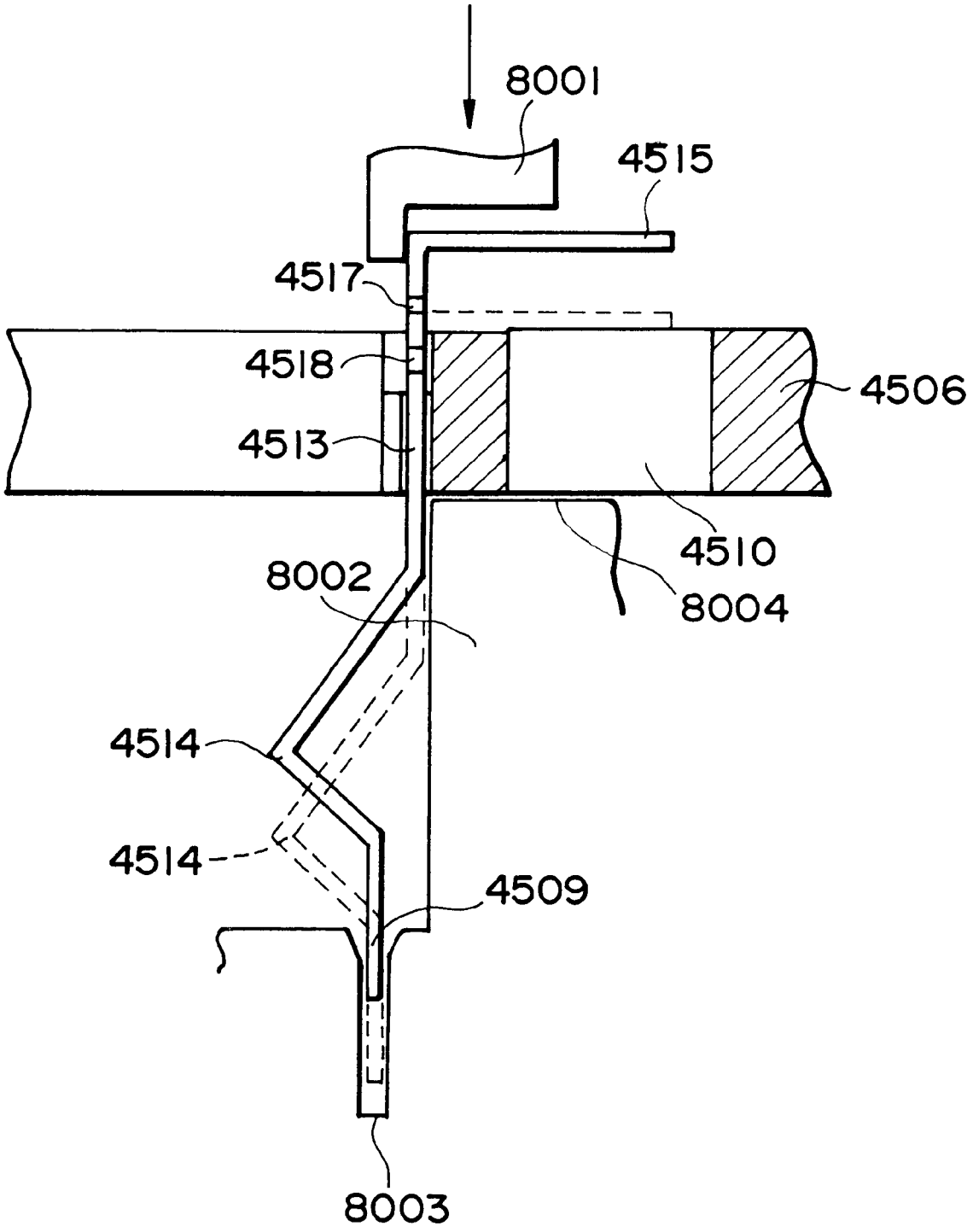
FIG. 15 is a schematic sectional view illustrating manufacturing of the connector by press-fitting.

FIG. 15 is a sectional vie in which the terminals 4501 are press-fitted into the housing 4506.

Figure 16:
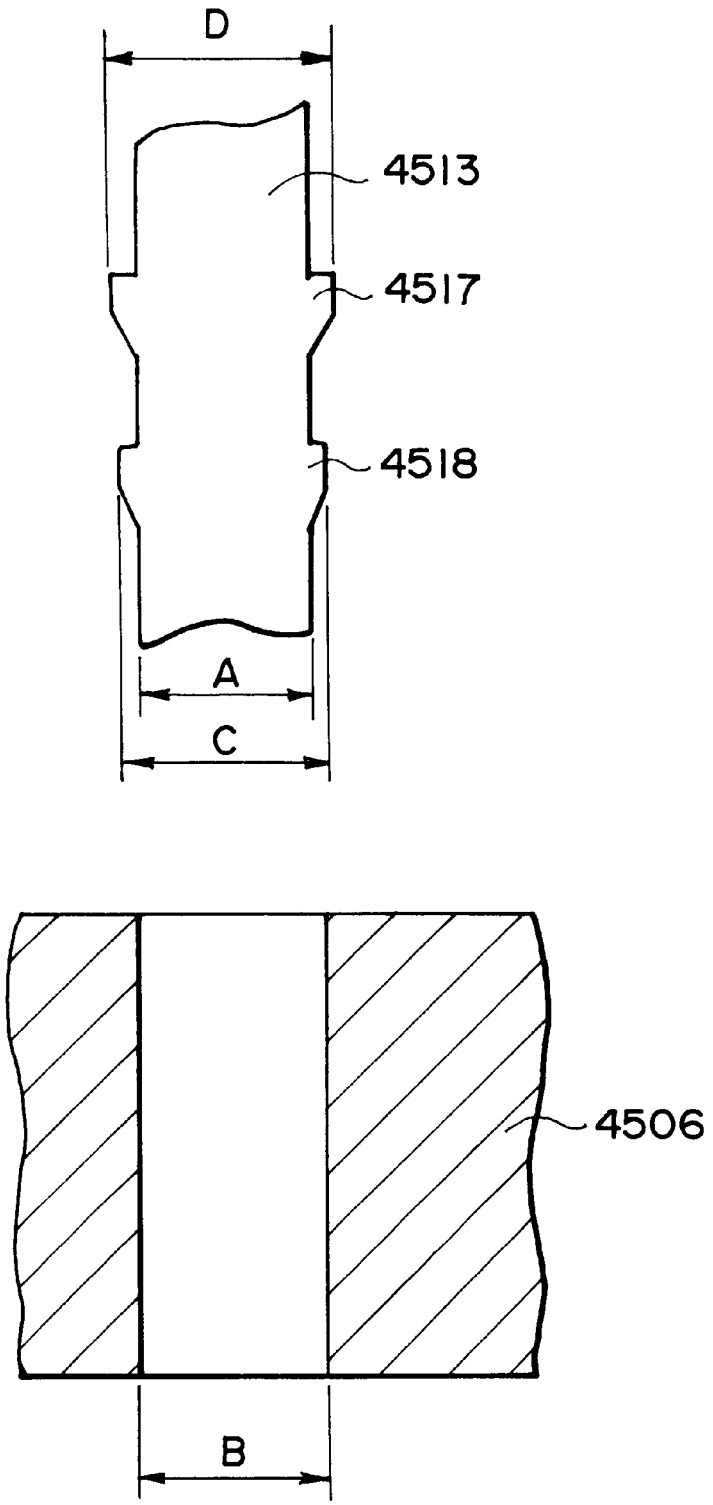
FIG. 16 is a perspective view illustrating a configuration of a terminal in the manufacturing shown in FIG. 15.

In FIG. 15, a receptor 8002 comprises a surface for receiving the housing 4506, an unshown positioning portion for positioning the housing 4506, and a groove 8003 for receiving the connectors 4509. By doing so, the positional accuracy is improved between the housing 4506 and the terminals 4501. By pushing the contacts 4515 of the terminals 4501 by an urging means 8001, so that the terminals 4501 are press-fitted from the position indicated by solid lines to a position indicated by the broken lines. Designated by reference numerals 4517 and 4518 are projections for the press-fitting formed on the terminal 4501, as shown in detail in FIG. 16. The dimensions of the projections 4517 and 4518 are so determined as to satisfy $A<B<C\leqq D$ relative to the dimension of the press-fitting portion of the housing 4506, as shown in FIG. 16.

The distances between a contact 4514 of the terminal 4501 and the other contact 4515, are made different depending on whether it is odd number position or even number position as shown in FIG. 15 or the like. By doing so, when the connectors 4509 are removed after the inserting molding or press-fitting, the possible short circuit between adjacent contacts can be avoided even if the positions of the contacts 4514 are deviated. This is particularly effective when the size of the relaying connector 4500 is reduced. Therefore, if the usable space is large, this is not used.

Figure 17:
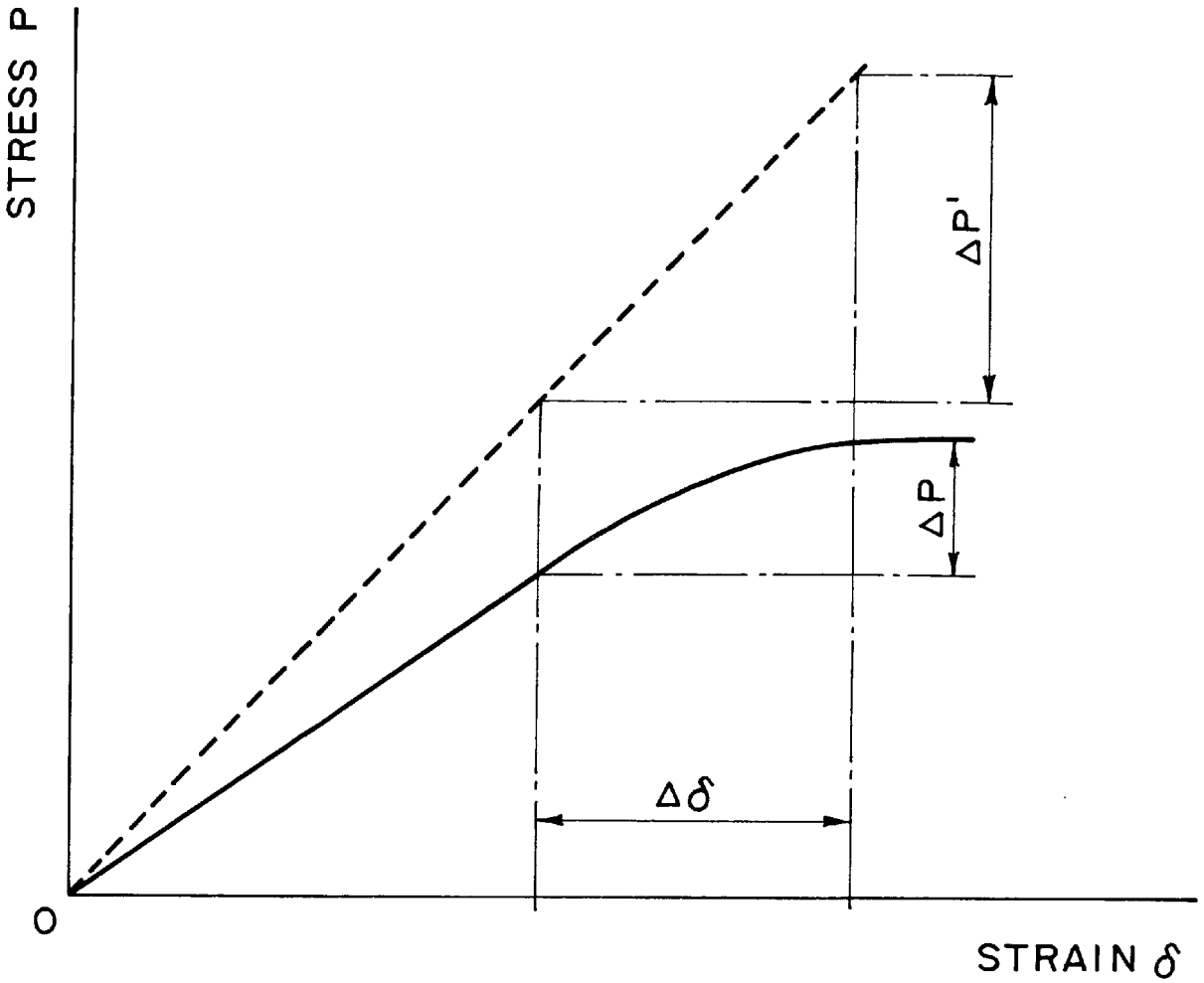
FIG. 17 is a graph of stress-strain explain the contact relation between the contact of the relaying connector and the contact of the recording head.

FIG. 17 is a graph of stress-strain curve of the terminal 4501 at the contact 4514. In this embodiment, the relationship between the contact 4514 and the pad of the recording head falls in a range before the elastic limit to the elastic limit. By doing so, the stress variation $\Delta T$ relative to the variation $\Delta\delta$ of the strain $\delta$ can be reduced as compared with $\Delta T'$ in the normal elastic range. As a result, even if the relative positional relations among the recording head, the housing of the relaying connector 4500 and the contact 4514, relatively greatly varies, the contact pressure is substantially uniform, thus increasing the reliability of the electric connection. In addition, the positional accuracy of the recording head can be maintained by preventing excessive force applied to the recording head correctly positioned in the unit frame 4000.

Figure 18:
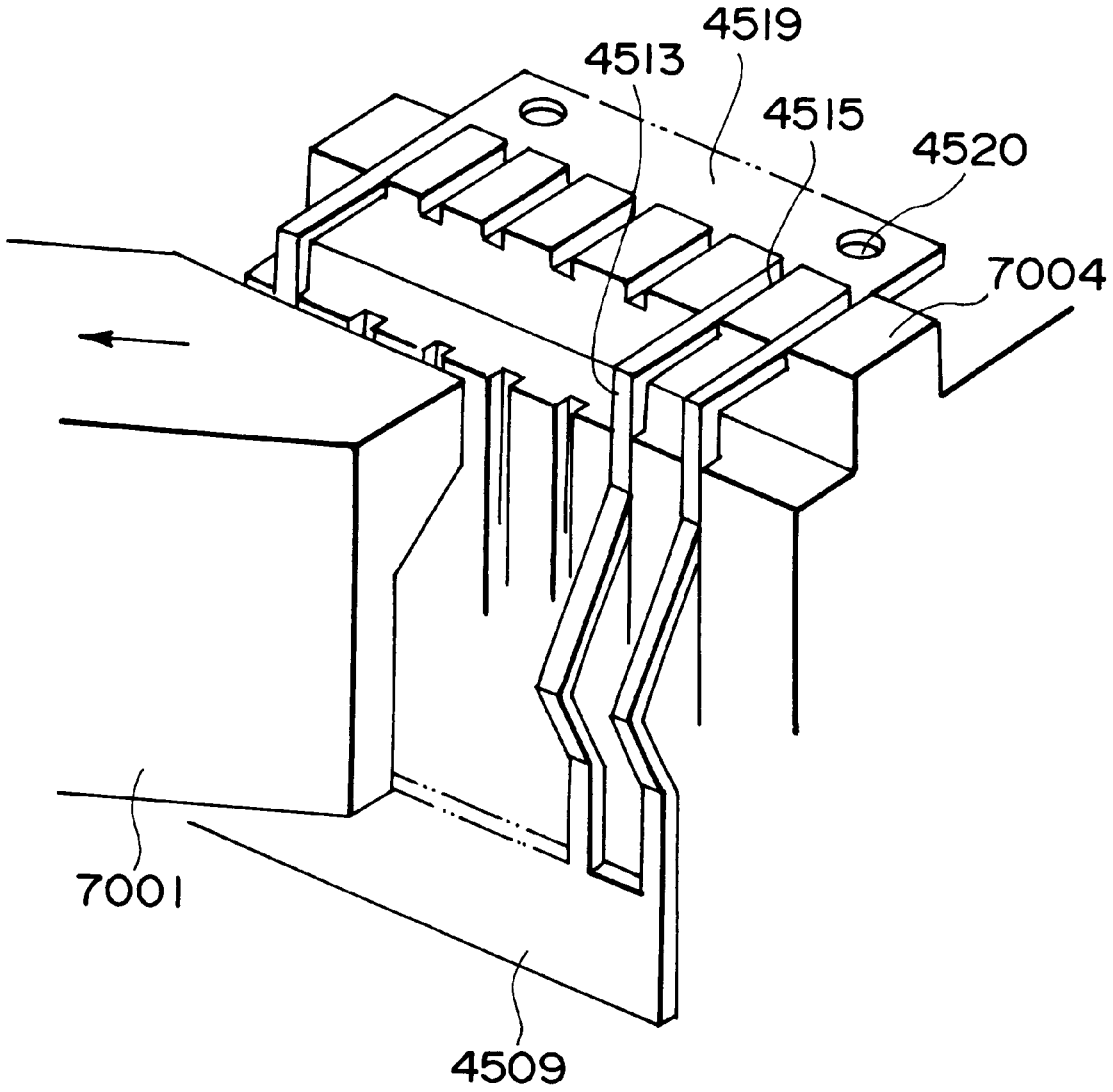
FIG. 18 is a perspective view of another example of the configuration of the terminal in the manufacturing of a relaying connector.
Figure 19:
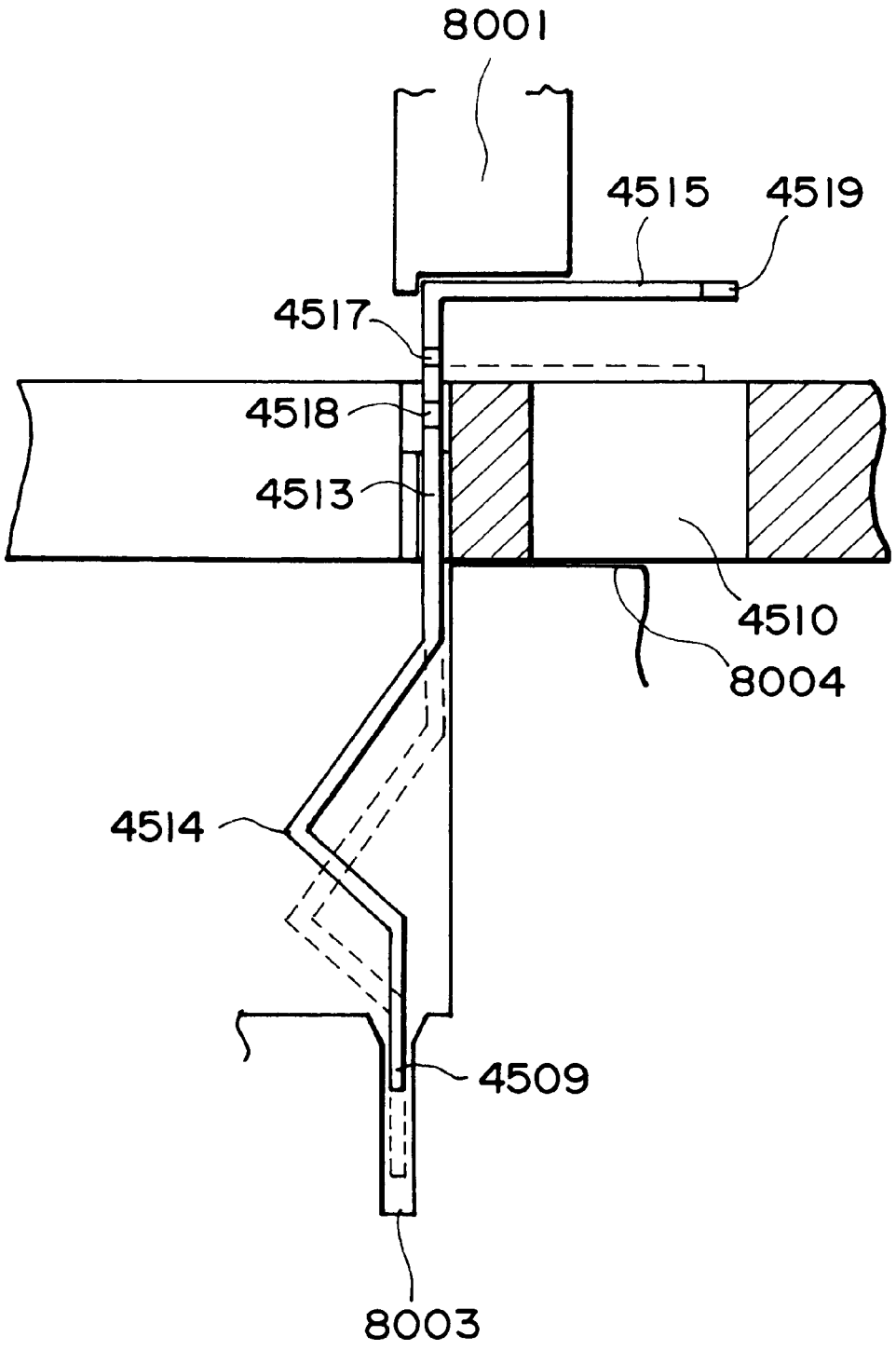
FIG. 19 is a schematic sectional view illustrating assembling of the terminal in the housing.

FIGS. 18 and 19 illustrate another embodiment in which a second connector 4519 is provided at a contact 4515 side in addition to the connector 4509 of the terminal 4501.

Designated by reference numeral 4520 are pilot holes formed in the second connector 4519. The holes 4520 are engaged with pins of a core 7002 of the metal mold. By the provision of the second connector 4519 at the contact 4515 side, when the contacts 4515 are set in the recesses 7004 of the comb-like portion of the core 7002 of the metal mold, the operatively is improved. This applied also to the press-fitting embodiment shown in FIG. 19.

The second connector 4519 is removed before connection with the wiring board 4507 (FIG. 8). The subsequent manufacturing steps are the same as described hereinbefore.

Figure 20:
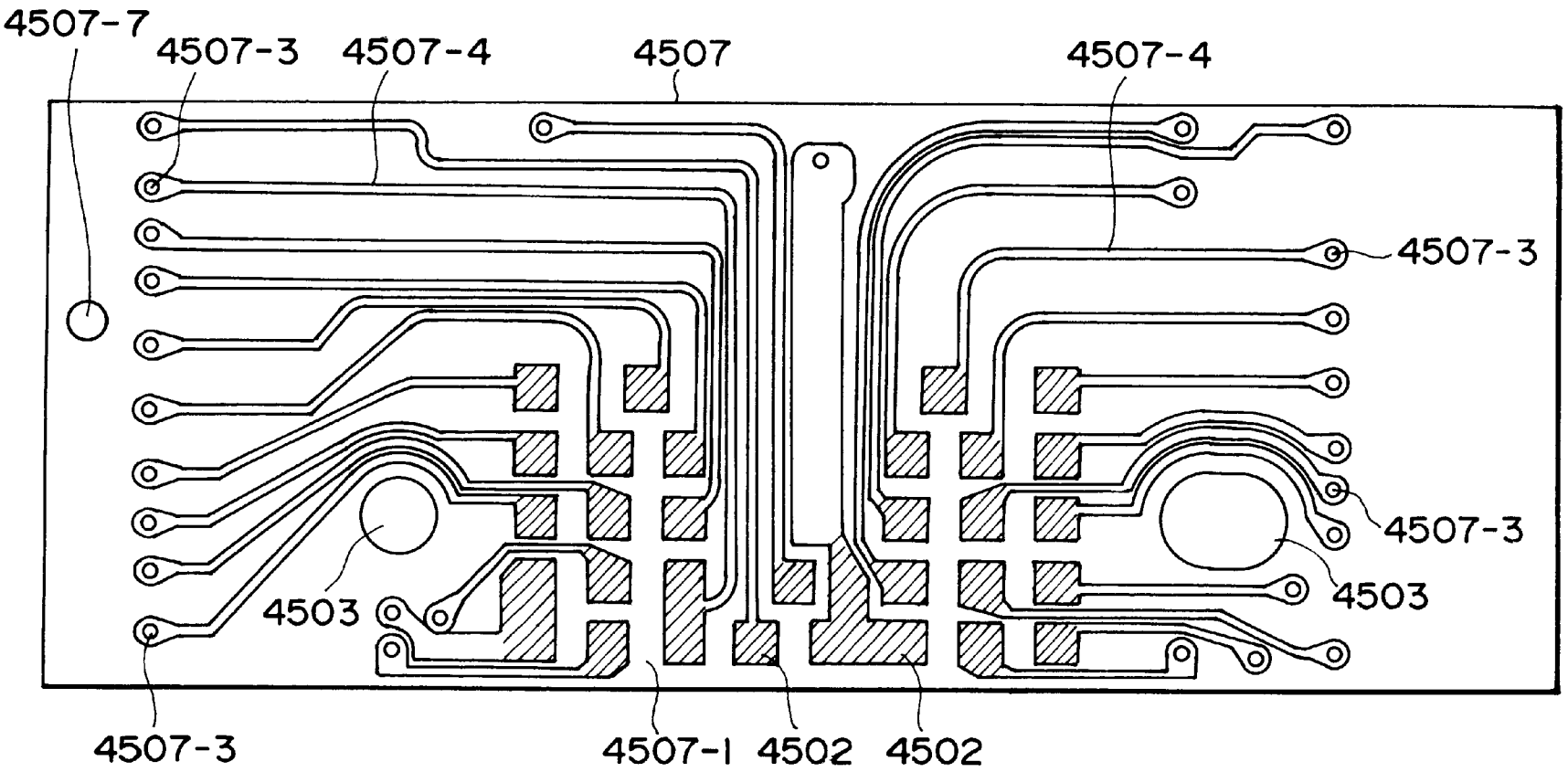
FIG. 20 is a top plan view of a front side of the wiring board functioning as the contact portion with the main assembly, in the relaying connector.

FIG. 20 is a top plan view of the wiring board 4507 when it is connected with the top housing 4506 the shown side is the front side when connected with the top housing 4506.

Designated by 4507-1 is a pad region having pads for receiving signals from the recording apparatus by contact with elastic contacts of the recording apparatus. A predetermined number of the pads 4502 are formed in the pad region 4507-1, and is indicated by hatching lines. A predetermined number of through holes 4507-3 are provided adjacent opposite ends of the wiring board 4507, so that the wiring is contacted with the backside of the wiring board 4507. Lead lines 4507-4 electrically connect the pad 4502 with the through holes 4507-3.

Designated by a reference numeral 4503 is a guiding hole for receiving a positioning projection of a connection pad of a carriage which is an electric contact of the main assembly of the recording apparatus. The guiding hole 4503 at the left side in the Figure is used for the positioning, and the right guiding hole 4503 functions as a guide for movement to the left or to the right at the time of the positioning. A hold 4507-7 formed adjacent an end of the board is effective to guide a positioning pin of the top housing 4506.

The board 4507 is of PCB having glass epoxy material as base material. However, another material is usable if the same advantageous effects are provided.

Figure 21:
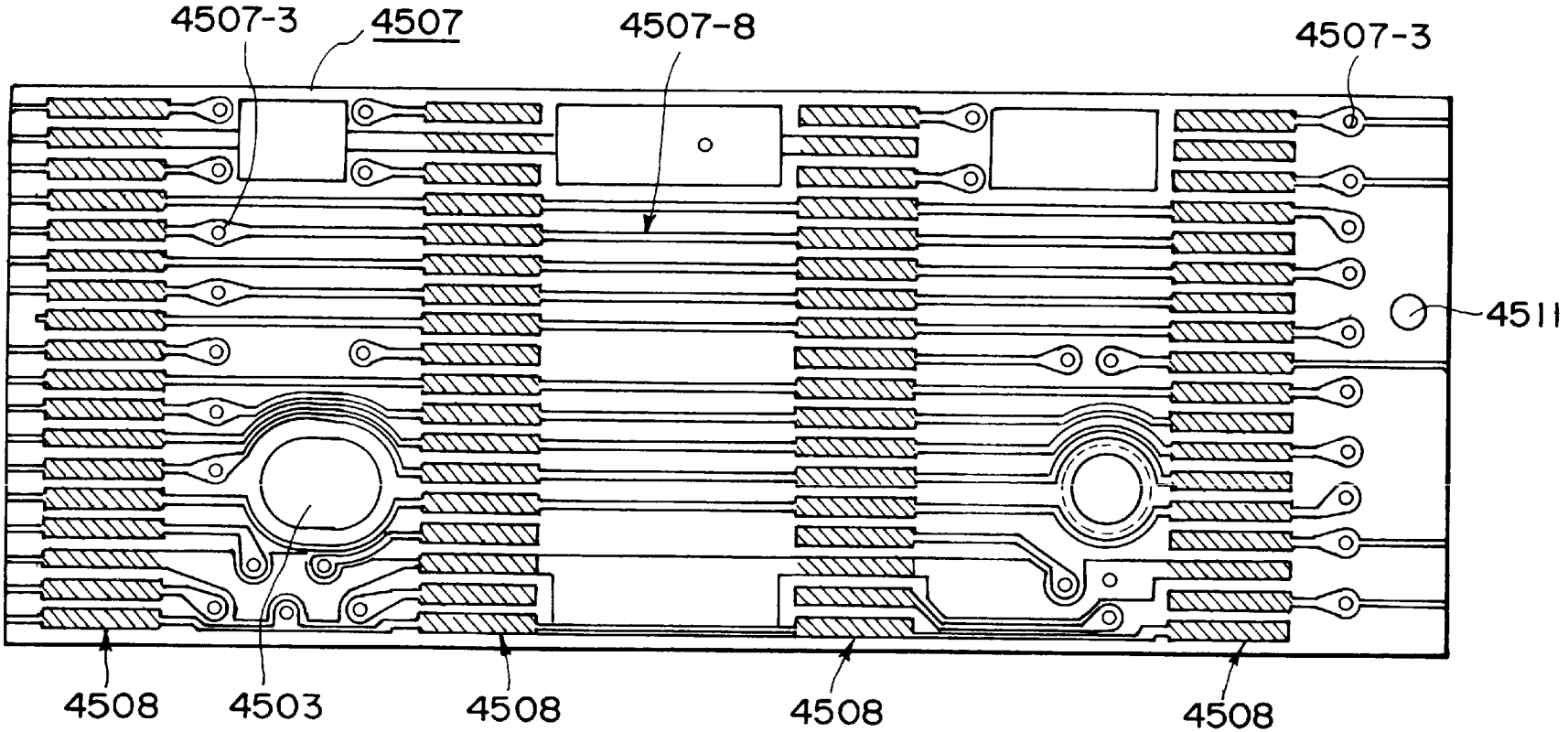
FIG. 21 is a plan view of a bottom side the wiring board.

FIG. 21 is a bottom plan view of the wiring board 4507.

A lead 4507-8 is electrically connected with a connecting surface 4508 for connecting the above-described through hole 4507-3 and the contacts 4515 of the terminal 4501. The connecting surface 4508 is indicated by hatching lines. Each of the connecting surfaces 4508 extends in parallel with the associated one of the recording heads.

Figure 22:
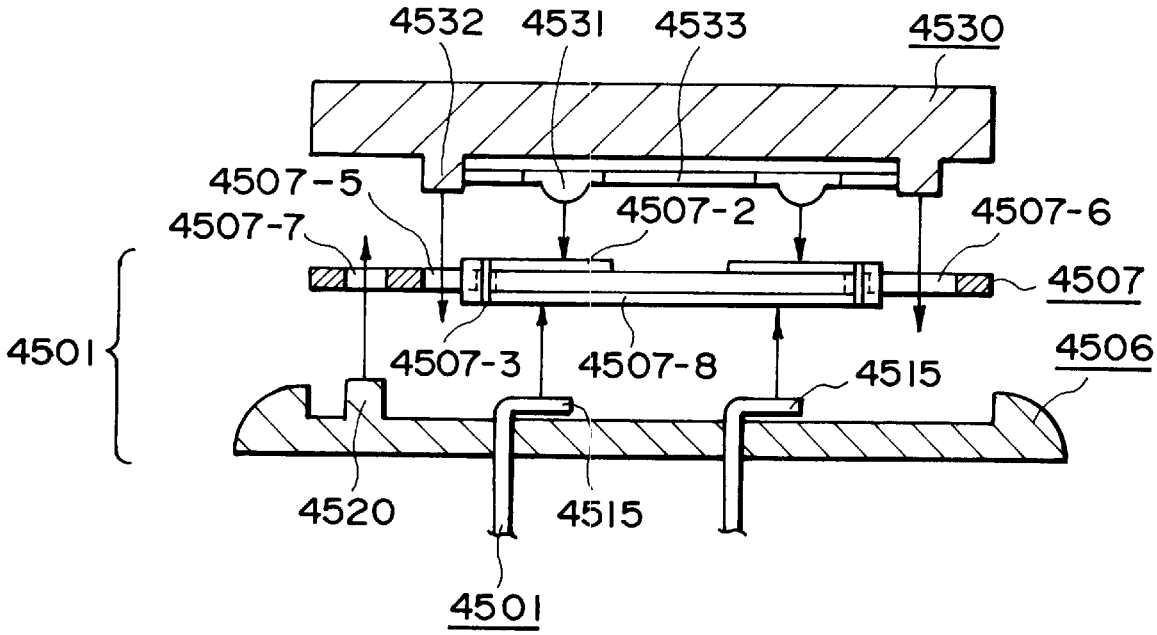
FIG. 22 is a schematic sectional view illustrating connection between the contacts of the main assembly and the wiring board.

FIG. 22 schematically shows the connection between the electric contacts of the main assembly (carriage) and the wiring board 4507.

Designated by a reference numeral 4530 is a connecting plate provided on the carriage of the recording apparatus, and is provided with a plurality of semi-spherical pads 4531 for signal transfer between the main assembly of the recording apparatus and the recording heads. The surface having the pads 4531 is provided with rubber press-contact member having flexibility.

The connecting plate 4530 is provided with positioning pins 4532 for accurate contact with the wiring board 4507 on the top housing 4506, by which the contact between the pads 4531 and the pads 4502 is assured.

The top housing 4506 is provided with positioning pine 4520 for accurate positioning between the top housing 4506 and the wiring board 4507.

With the above-described structure, the highly reliable connector can be provided to permit reliable electric signal transfer between the recording head and the main assembly of the recording apparatus.

As described in the foregoing, according to the structure of the wiring board, the portion having the electric contacts for signal transfer with the main assembly, can be disposed at a side opposite from the recording surface, so that it can be prevented from contamination with the ink and the contamination with the paper dust, thus improving the reliability of the electric connection.

The pads are disposed in the central portion of the wiring board, and adjacent to the positioning portion, and therefore, the pads can be correctly positioned.

The provision of the guiding hole for the connection with the contacts on the carriage, the connection accuracy is further improved.

The structure is advantageous when the wiring board is used as a connector for an external signal transfer of the recording head unit having a plurality of recording heads for the color recording or the like. The connecting pads are provided at an outer surface of the unit, and the connecting portion for connection with the recording head contacts is provided on the backside surface. To electrically connecting them, the wiring board is provided with a through hole at an end portion of the wiring board. The leads are extended parallel with each other in a crossing direction relative to the recording head. By doing so, the number of parts is reduced, and the wiring can be accomplished with high density with low cost and easy manufacturing.

Figure 23:
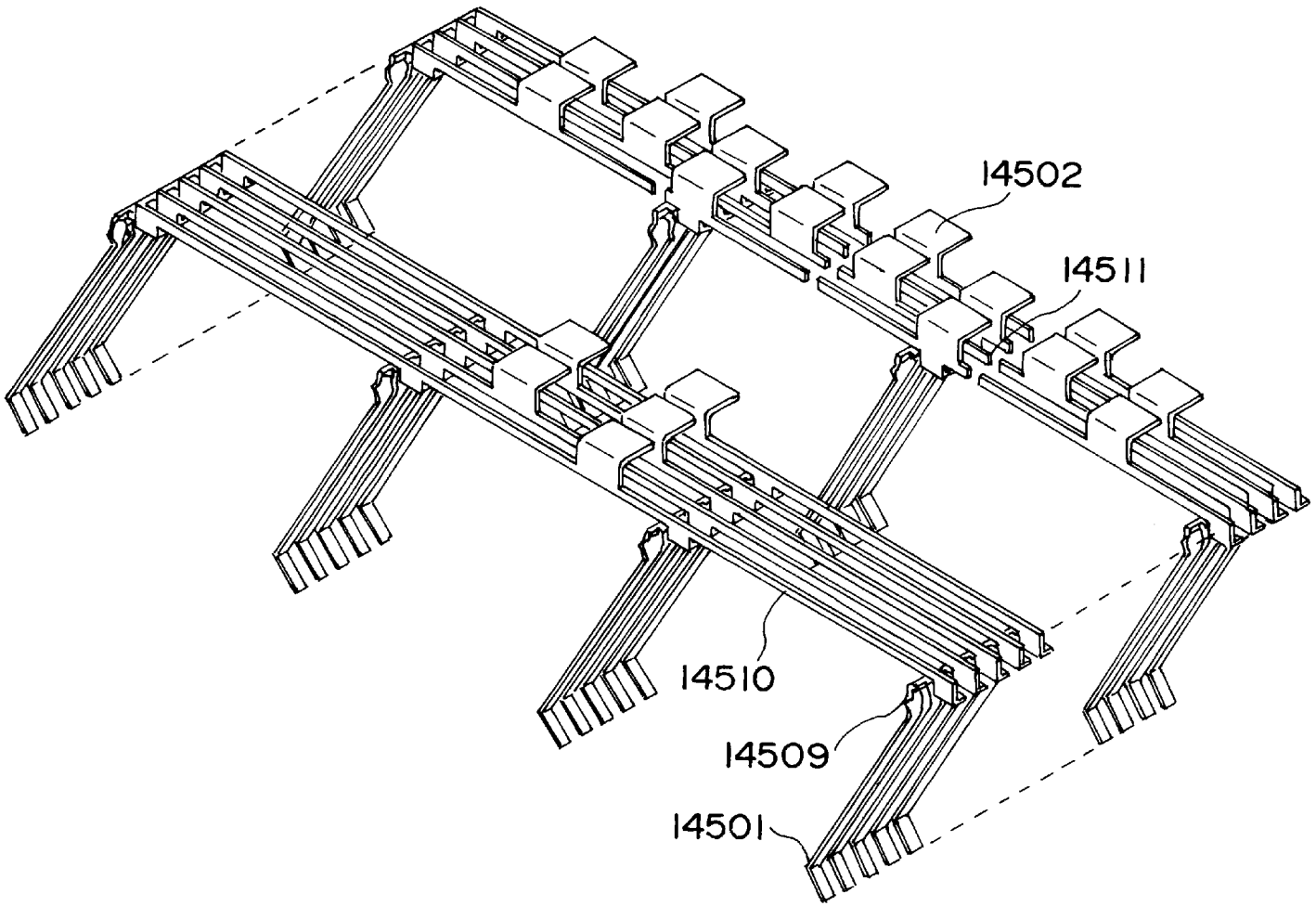
FIG. 23 is a perspective view of an electrode frame of a relaying connector
Figure 24:
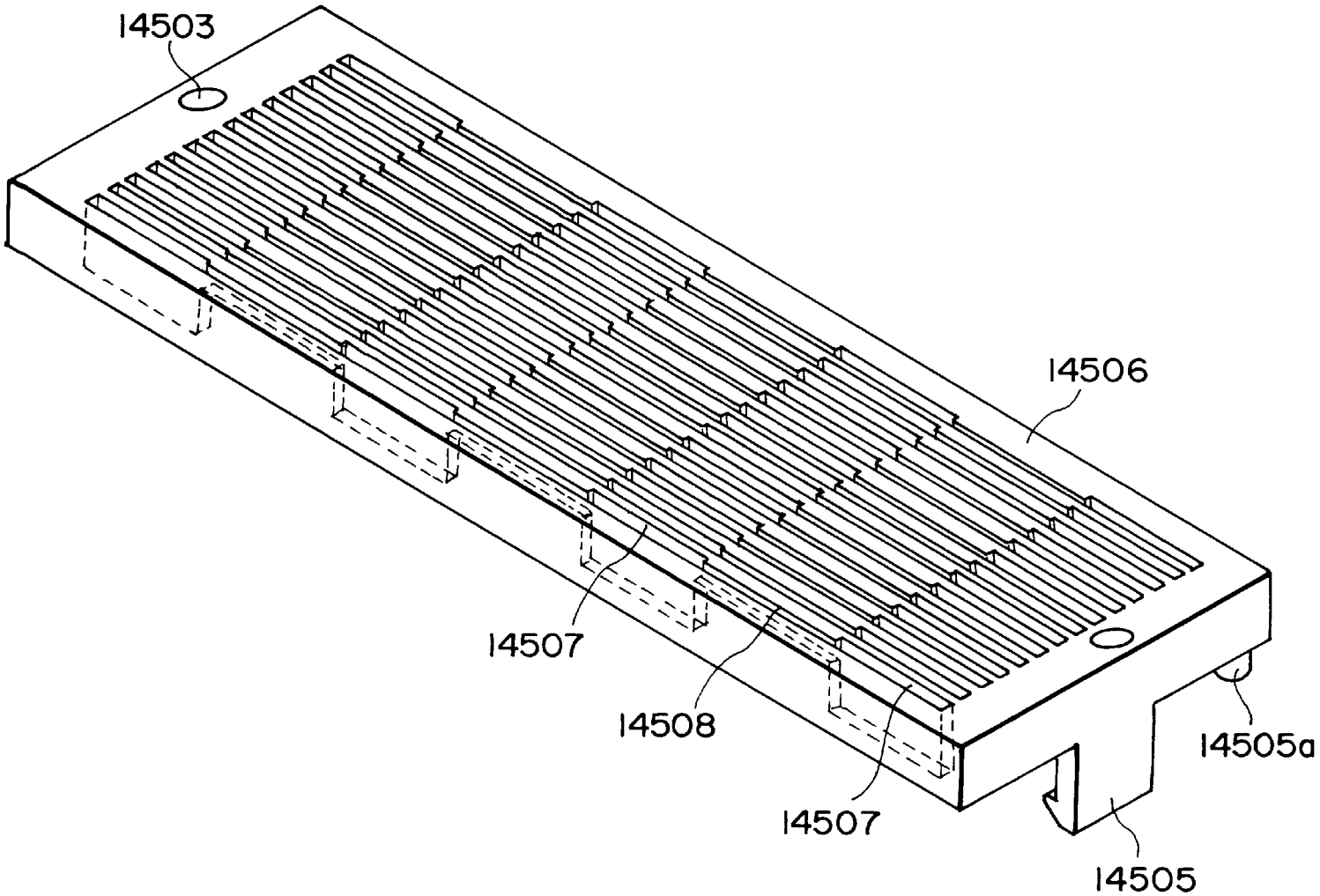
FIG. 24 is a perspective view of a covering member of the relaying connector.

Another embodiment of the relaying connector will be described. The above-described relaying connector 4500 (FIG. 5) functions are contacts and electrodes. Referring to FIGS. 23 and 24, the relaying connector of this embodiment comprises an electrode frame 14510 (FIG. 23) and a covering member 14506 (FIG. 24) of plastic mold for supporting the electrode frame 14510. The electrode frame 14510 is of highly elastic metal such as phosphor bronze SUS or the like. The contact portions thereof are plated with gold. The contacts 14501 are contactable with the respective recording chips. Designated by 14502 is electric signal receiving portion from the recording apparatus. The contacts may be plated with silver depending on contacting action between the contacts and the required reliability. The metal frame 14510 is formed by pressing, punching and bending processes from one sheet material. The frame 14510 is provided with press-fitting portion 14509 for the press-fitting when the frame 14510 is inserted into the covering member 14506.

The covering member 14506 of plastic mold is provided with holes 14507 for receiving the electrode frame 14510 and slits 14508 for retaining the frame 14510. Between a hole 14507 and a slit 14508, a fixing portion is provided for the press-fitting of the frame 14510. A required number of combinations of the slit 14508 and the hole 14507 are provided in parallel for each of the frame 14510. The plastic covering member 14506 is made of PPS resin material or the like since the moldability is good, the deformation by the external pressure is small, and the manufacturing accuracy is good. The covering member 14506 is provided with positioning pins 14505*a* for the positioning relative to the unit frame 4000 (FIG. 5) having the recording chips. It is also provided with an engaging arm 14505 for snap-on fixing relative to the unit frame 4000. Furthermore, a pair of holes 14503 is provided for the positioning relative to the electrodes of the main assembly of the recording apparatus.

Figure 25:
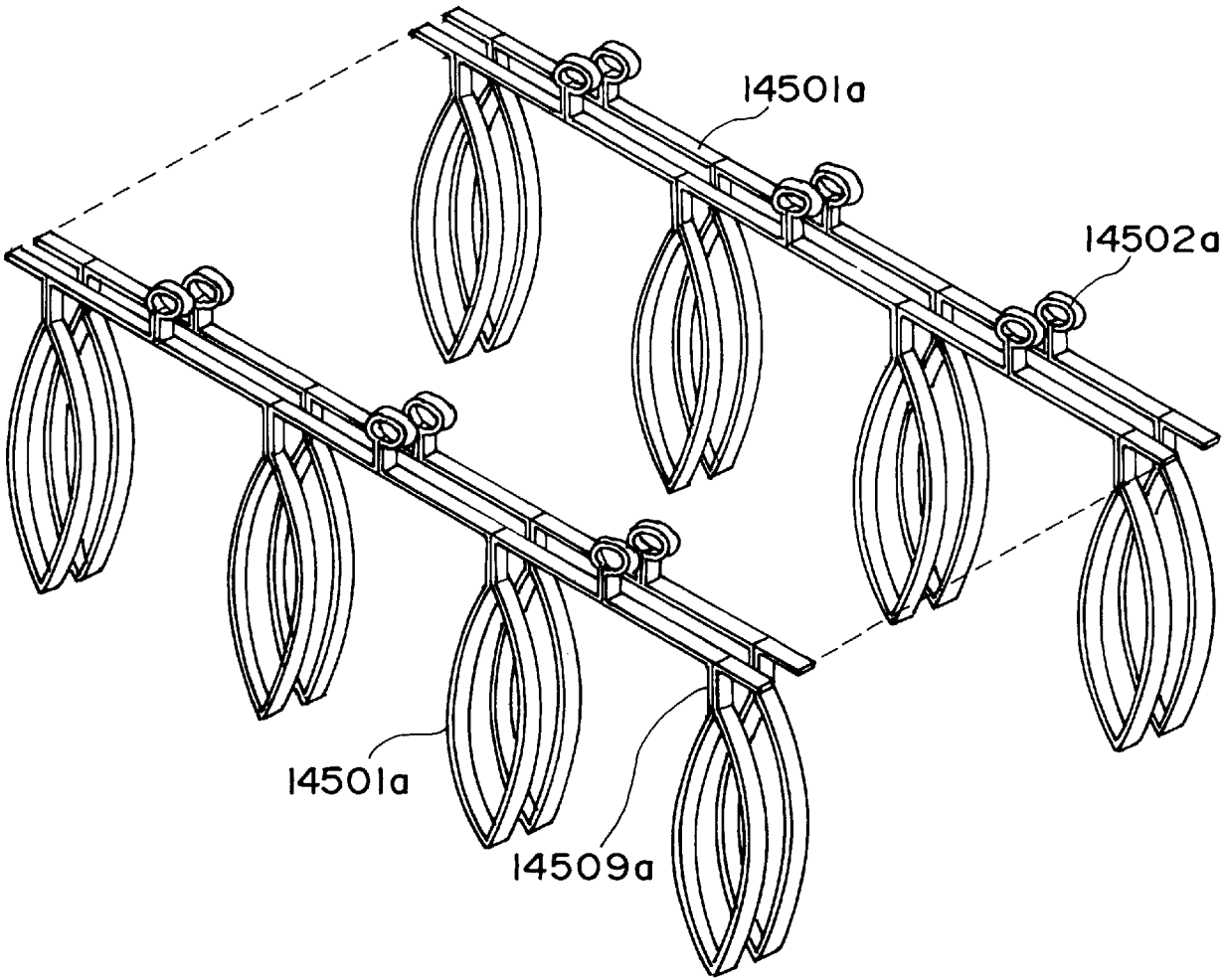
FIG. 25 is a perspective view of an electrode frame according to another embodiment of the present invention.

FIG. 25 shows a further embodiment of the relaying connector. This is similar to FIG. 24 embodiment, but the electrode frame is different. In this embodiment, the portion designated by 14501*a* constitutes a contact portion relative to the recording head, and the portion designated by 14509*a* is the fixing portion at the time of the press-fitting. The portion designated by 14502*a* constitutes a contact portion relative to the main assembly of the apparatus. This can be produced by processing one linear member or elongated plate or the like, and therefore, the cost is low, and the manufacturing is easy.

The opposite side of the head chip contact portion 14501*a* is supported by the covering member 14506, so that the contacts may be formed by bending force for the loop of the plate member constituting the contact portion 14501*a*, and therefore, the strength of the contacts is improved.

Figure 26:
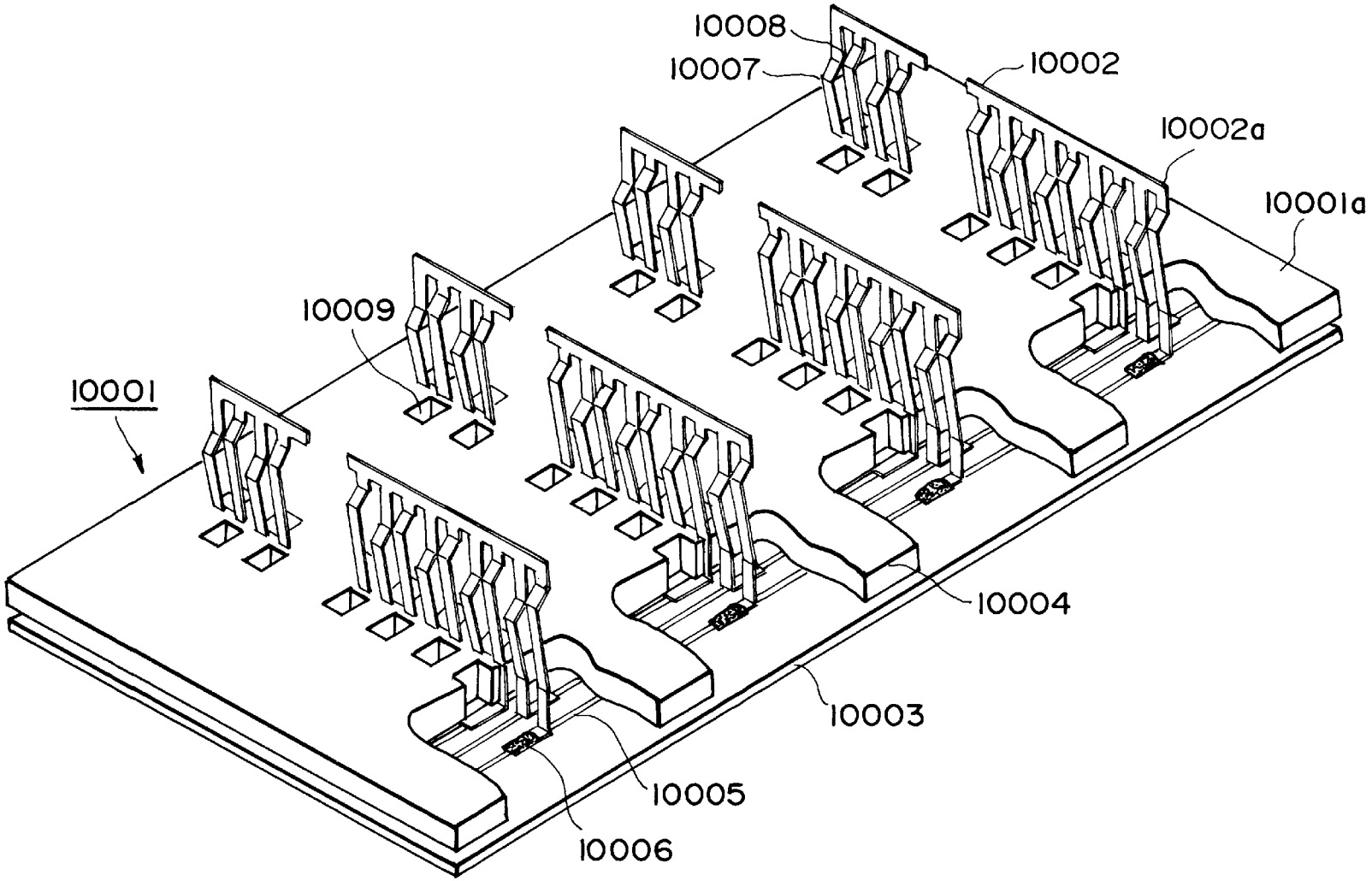
FIG. 26 is a perspective view of a relaying connector according to a further embodiment of the present invention.

FIG. 26 is a perspective view of a relaying connector according to a further embodiment. The relaying connector 10001 is provided with an electrode frame 10002 having tape contacts 10007 and 10008 in the form of a steps lead frame. It also comprises a supporting member 10004 into which the frame 10002 is inserted, and thereafter, the supporting member 10004 is molded. A portion penetrated through and projected beyond the supporting member 10004 is soldered by cream soldering or the like onto a print board (PCB) 1003. Designated by 10001*a* is a cover made of resin material.

The print board PCB 1003 is both sided, and comprises means 10005 for connecting the soldered portions of the frame 10002 and other necessary soldered portions, and electric signal receiving portion contacted to the apparatus is formed at an opposite side through an unshown through hole. The frame 10002 is thereafter cut, so that is separated into stepped contact portions 10007 and 10008. Designated by reference numeral 10009 are heat receiving openings.

Figure 27:
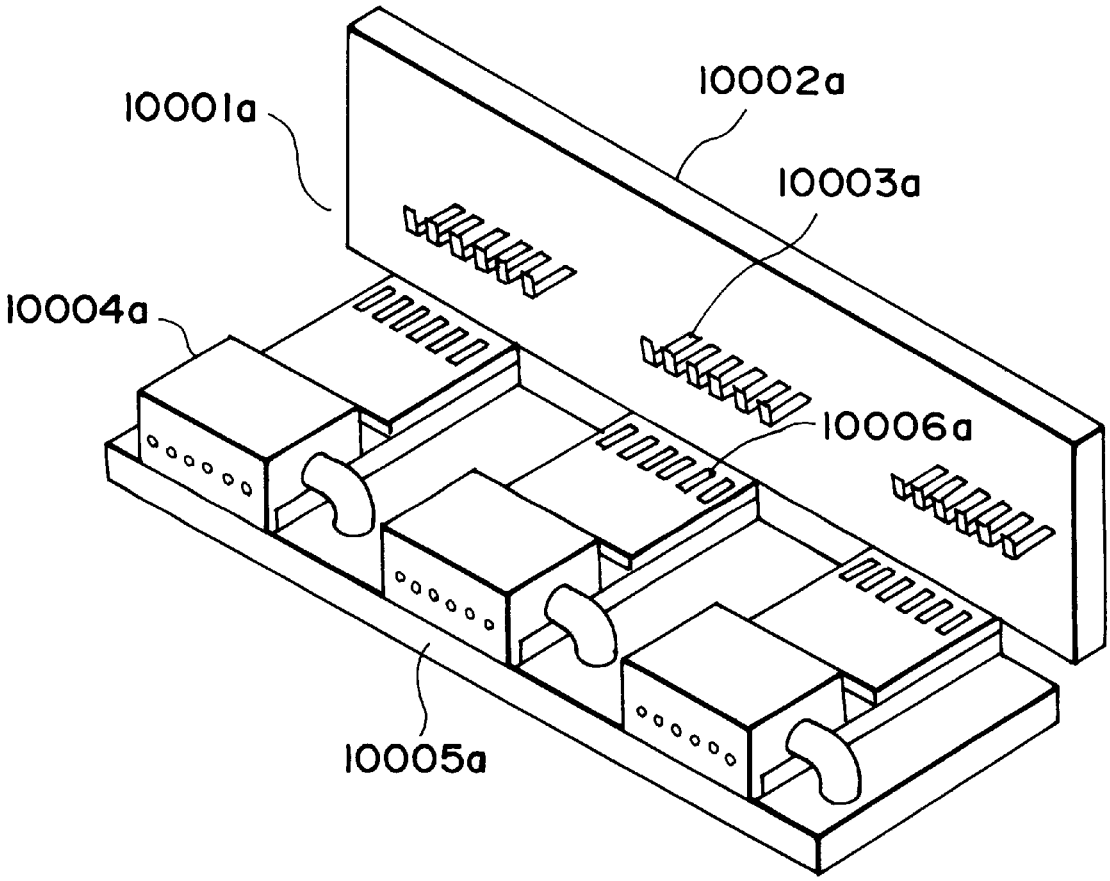
FIG. 27 illustrates a relaying connector according to a further embodiment of the present invention.

FIG. 27 shows a relaying connector according to a further embodiment, wherein a plurality of recording chips 10004 are arranged in parallel constituting a recording head 10002*a*. The relaying connector 10002*a* is provided with electrode 10006*a* of each of the recording chips 1004 and elastic contacts 10003*a* press-contacted thereto. The chips 10004*a* are arranged at high accuracy on the frame 10005*a* having a positioning portion. The ink is supplied at a backside of the frame 10005*a*. The recording head having chips 10004*a* in parallel to each other as in this embodiment, is suitable for color image recording or printing and to a high speed recording or printing.

Figure 28:
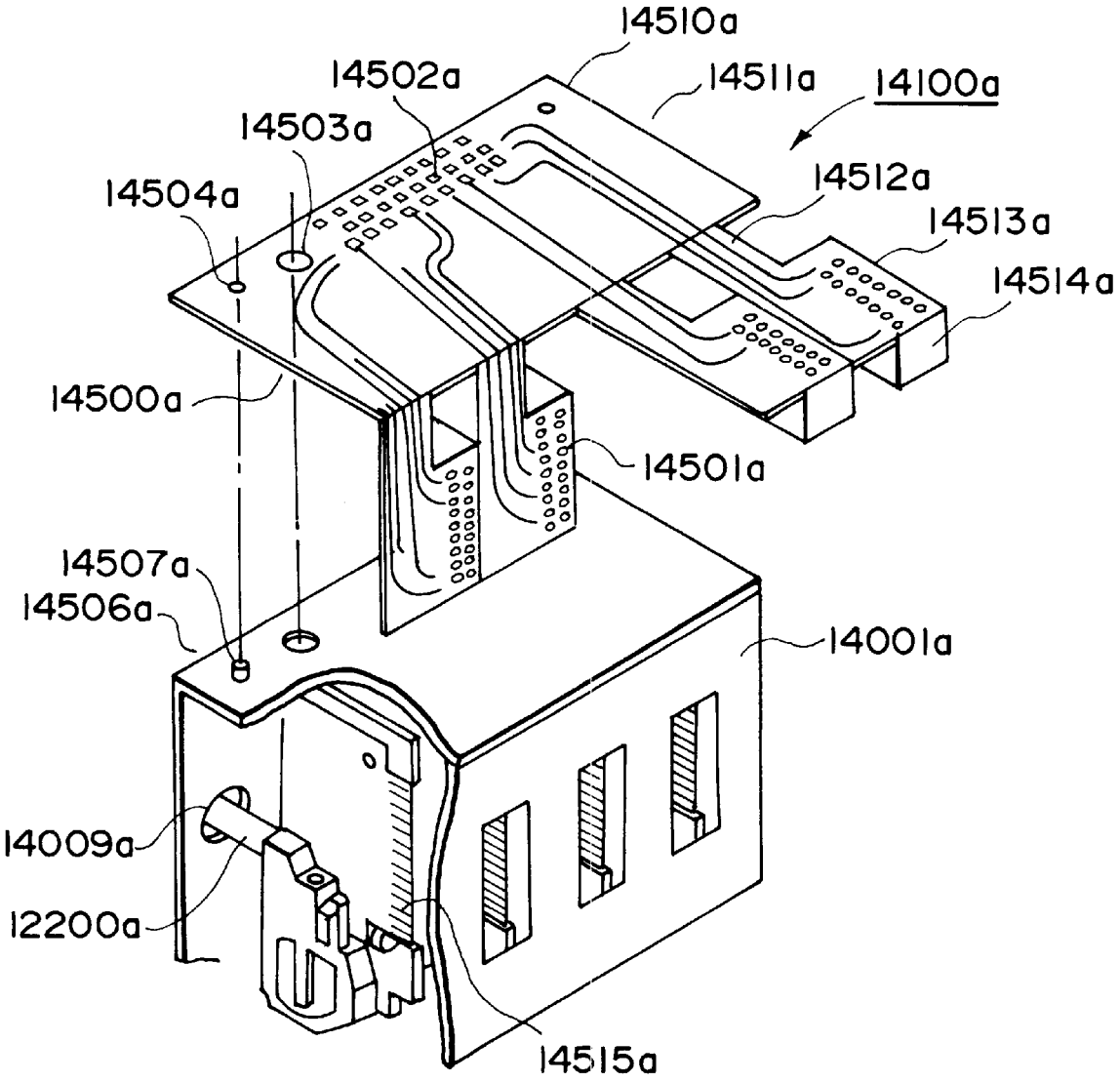
FIG. 28 is a perspective view of a head device according to a further embodiment of the present invention.

FIG. 27 shows a head device HD of an ink jet head device having a relaying connector, according to a further embodiment of the present invention. In FIG. 28, the ink jet head unit IJHU is mounted on a unit frame, as indicated by 14100*a*. Designated by 14500*a* is a relaying connector of this embodiment. A plurality of connectors 14501*a* for supplying electric signals to each of the ink jet head unit are arranged in a line, and the number of such lines are provided for the respective ink jet head units. They are positioned and supported on the housing 14506*a*. Designated by 14502*a* are connectors. They are contacted to connection pads on a carriage HC of the main assembly of the recording apparatus shown in FIG. 23, so that electric connection is established. Positioning holes 14503 are engaged with complementary positioning pins of the carriage HC, so that the positional deviation is prevented between the connection 14052*a* and the connection pads on the carriage, thus assuring the reliability of the contact. The wiring between the contacts 14501*a* and the connection part 14502*a*, are collected electrically together between the recording heads on the housing 14506*a*. However, they are grounded as a unit thus reducing the number of connections with the main assembly.

Designated by 14504*a* are positioning holes relative to the housing 14506*a* and are engaged with pins 14507*a* on the housing 14506*a*. There are provided a member engageable with an engaging portion of the unit frame 14001*a* to fix the relaying connector 14100*a* to the unit frame 14001*a*. An element 14506*a* covers the inner precision parts when the head device HD is completed. By doing so, the inner precision parts are protected. It is provided with an ink supply pipe 12200*a* and a hole 14009*a* for receiving a filter.

The wiring part 14510*a* of the relaying connector 14100 *a* comprises a flexible print board having the wiring on each of the opposite side surfaces, and is coated with polyimide resin. The wiring 14510*a* comprises a portion 14511*a* closely contacted and fixed to the housing 14506*a*, a portion 14512*a* branched to each of the recording chips, and a connector mounting portion 14513*a* having connector 14514*a*. The portion 14511*a* has collected wiring lines, and is provided with contact portions 14502*a* for electric connection with the main assembly and positioning holes 14503*a* and 14504*a*. The connector 14514*a* and the connector mounting portion are soldered with electrical and mechanical stability. The connectors 14514*a* are inserted into a card edge portion 14515*a* of the printed circuit board PCB on a recording tape, thus establishing the electric connection.

Figure 29:
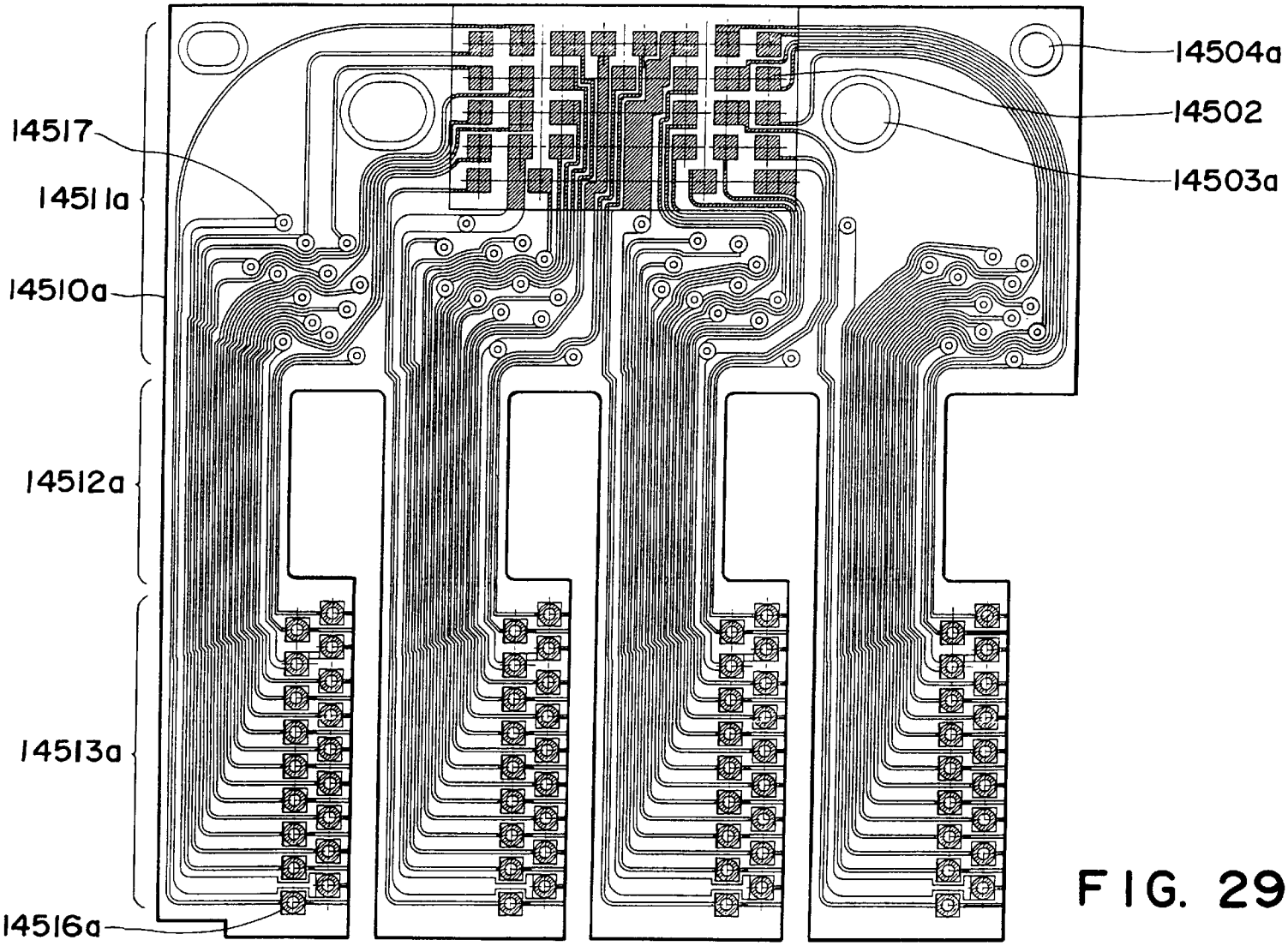
FIG. 29 is a schematic view of a wiring portion of a relaying connector.
Figure 30:
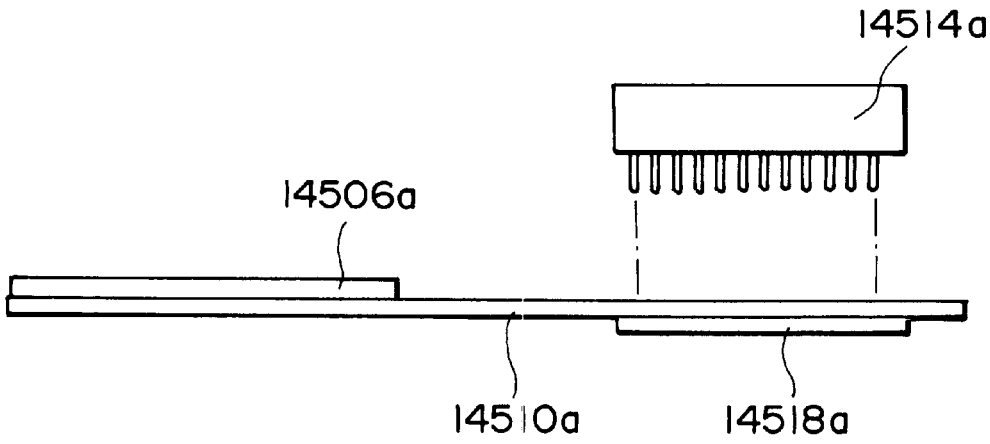
FIG. 30 illustrates a connector and its mounting portion.

FIGS. 29 and 30 show a relaying connector according to a yet further embodiment of the present invention, which comprises flexible wiring part 14510*a*. The flexible wiring part 14510*a* comprises a portion 14512*a* flexibility bent to be distributed to each of the recording chips, and a connector mounting portion 14513*a* for securedly mounting the connector 14514*a* connecting with the recording chip.

The connector mounting portion 14513*a* is provided with through holes 14516*a* for receiving connector pins which are soldered. The portion 14511*a* to be fixed to the housing 14506*a* is provided with through holes 14517*a* for collecting the wiring lines. There are provided unshown electric wiring for connecting common through holes for the recording chips, at the backside of the portion 14511*a*. Thus, the common wiring is concentrated at one side as much as possible to reduce the number of separate wiring lines.

Supporting members 14518*a* may be provided above and below the flexible wiring 14510*a*, for the insertion and soldering of the connectors 14514*a*. The supporting member 14518*a* shows heat-resistivity against the soldering, and maintains the insulation between pins. The material preferably shows high processing accuracy and high strength.

Figure 31:
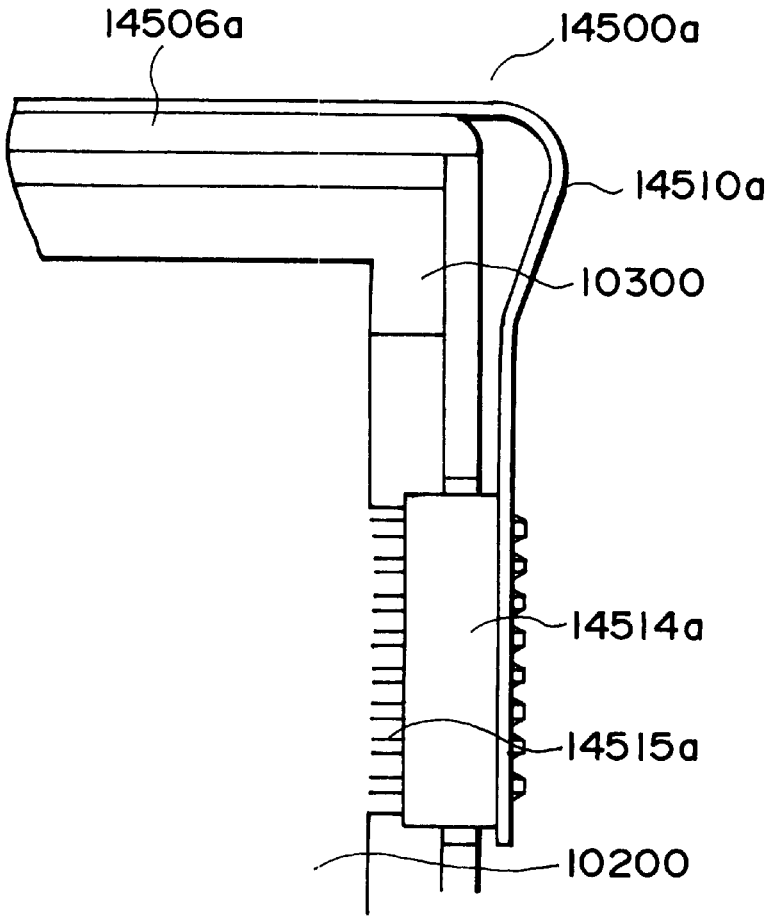
FIG. 31 illustrates a head frame mounting portion of a relaying connector.

For the mounting of the relaying connector to the head frame, as shown in FIGS. 29–31, the flexible wiring 14510*a* is disposed in the portion 14512*a* with sufficient margin in consideration of mounting the connector. By doing so, even if the mounting portion of the housing 14506*a* is deviated, and even if the vertical, or horizontal deviation occurs after the positioning of the recording head 14300, the interference can be prevented by the margin of the portion 14512*a* in the assembling.

Figure 32:
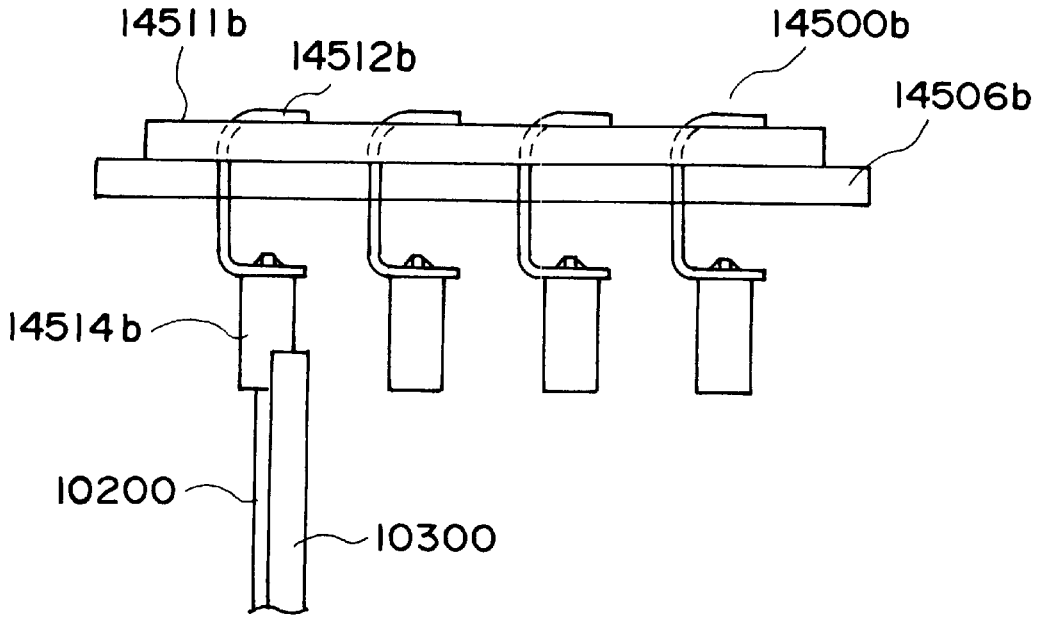
FIG. 32 illustrates a relaying connector according to a further embodiment of the present invention.

FIG. 32 shows a relaying connector according to a further embodiment 14500*b* of the present invention. In this embodiment, a common wiring 14511*b* comprising a flexible wiring 14512*b* and a printed board (PCB) 10200 is soldered with a wiring 14512*b*. The wiring 14511*b* is provided with electrodes for receiving electric signals from the main assembly of the recording apparatus. The common wiring 14511*b* is securedly bonded or fused on a supporting member 14506*b*. One end of the flexible wiring 14512*b* is provided with a connector mounting portion 14514*b*, and is soldered. The connector 1451*b* is inserted into a card edge portion of the PCB 10200 of the recording head 10300, thus establishing the electric connection.

Figure 33:
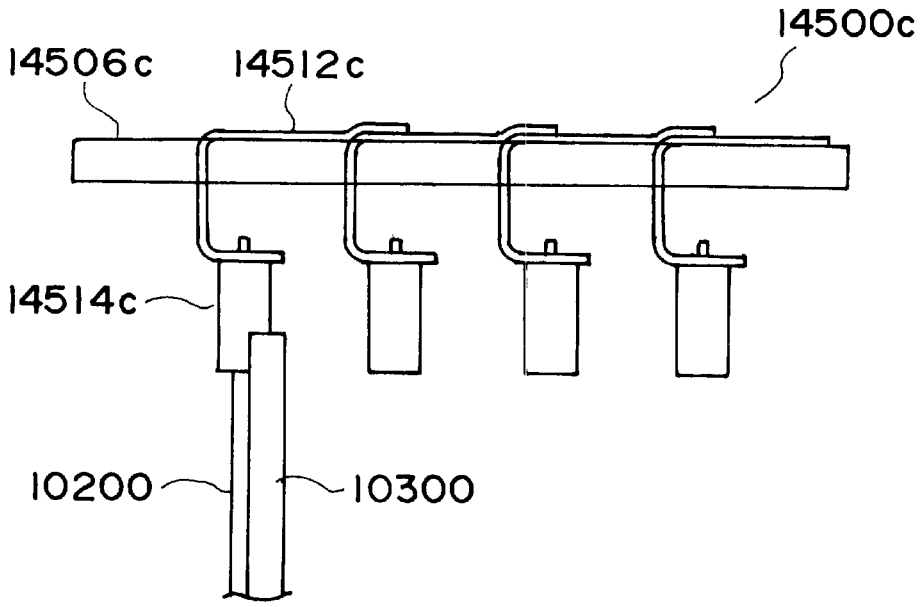
FIG. 33 illustrates a relaying connector according to a further embodiment of the present invention.

FIG. 33 shows a relaying connector according to a yet further embodiment. The relaying connector 14500*c* comprises connectors 14514*c* which are connected with flexible wirings 14512*c* connected with a recording head 10300, which is supported on a supporting member 14506*c*, and which is connected with a card edge portion of the printed circuit board 10200 of the recording head 10300. The flexible wirings 14512*c* are overlaid with each other, and are electrically connected by soldering and press-contact with a common wiring between adjacent ones, between the recording heads 10300. At a part of an upper portion, there are provide contacts for receiving electric signals when it is mounted on this main assembly of the recording apparatus.

Figure 34:
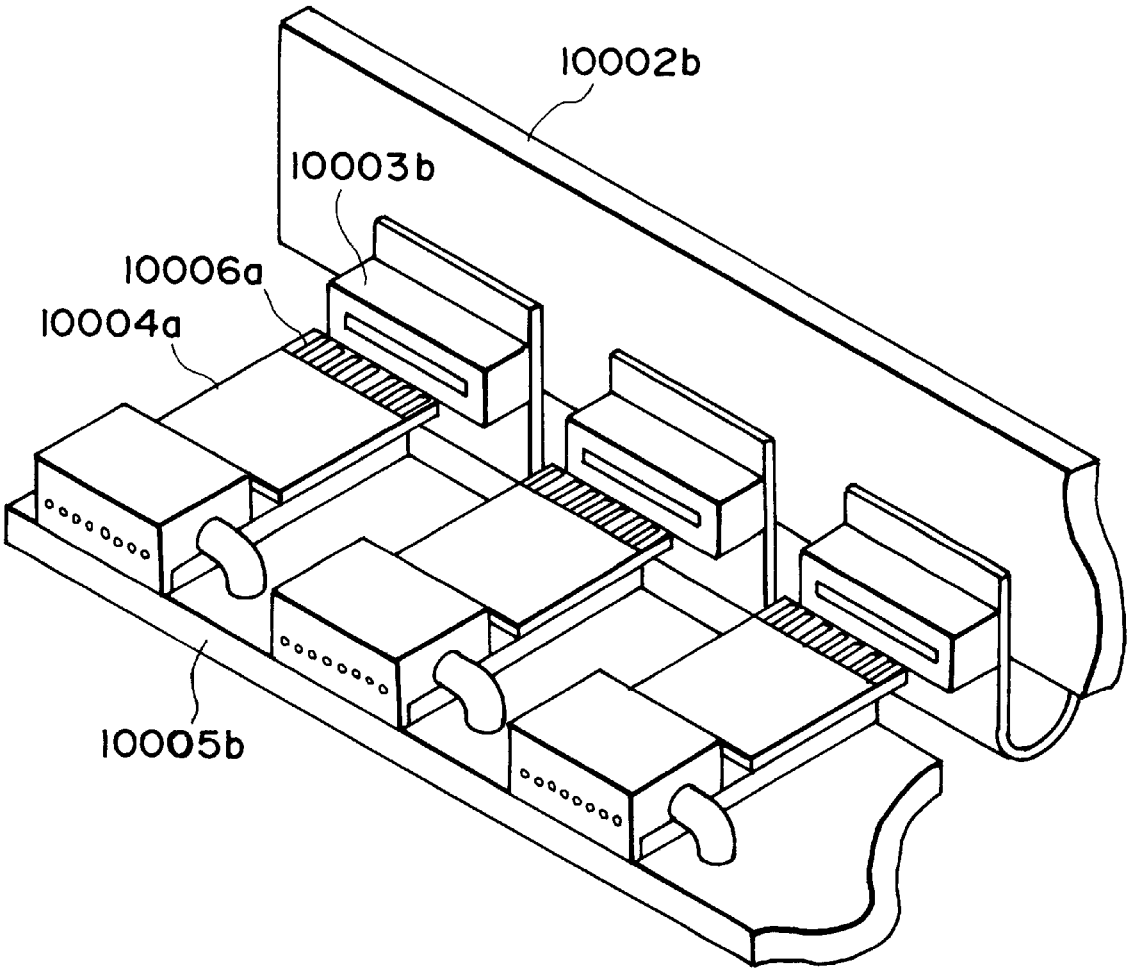
FIG. 34 illustrates a relaying connector according to a further embodiment of the present invention.

FIG. 34 shows a yet further embodiment in which the recording heads 10004*a* are arranged in parallel. The relaying connector 10002*b* is provided with connectors 10003*b* contactable with electrodes 10006*a*of each of the recording heads 1004*a*. The recording heads 10004*a* are arranged accurately in parallel on the frame 10005*b* having the positioning portions. The ink is supplied to the backside of the frame 10005*b*. The recording unit having the parallel recording heads 10004*a* as shown in the Figure is proper for color recording and high speed recording.

The description will be made as to a further embodiment as to the positioning structure when the relaying connector is mounted on the unit frame.

Figure 35:
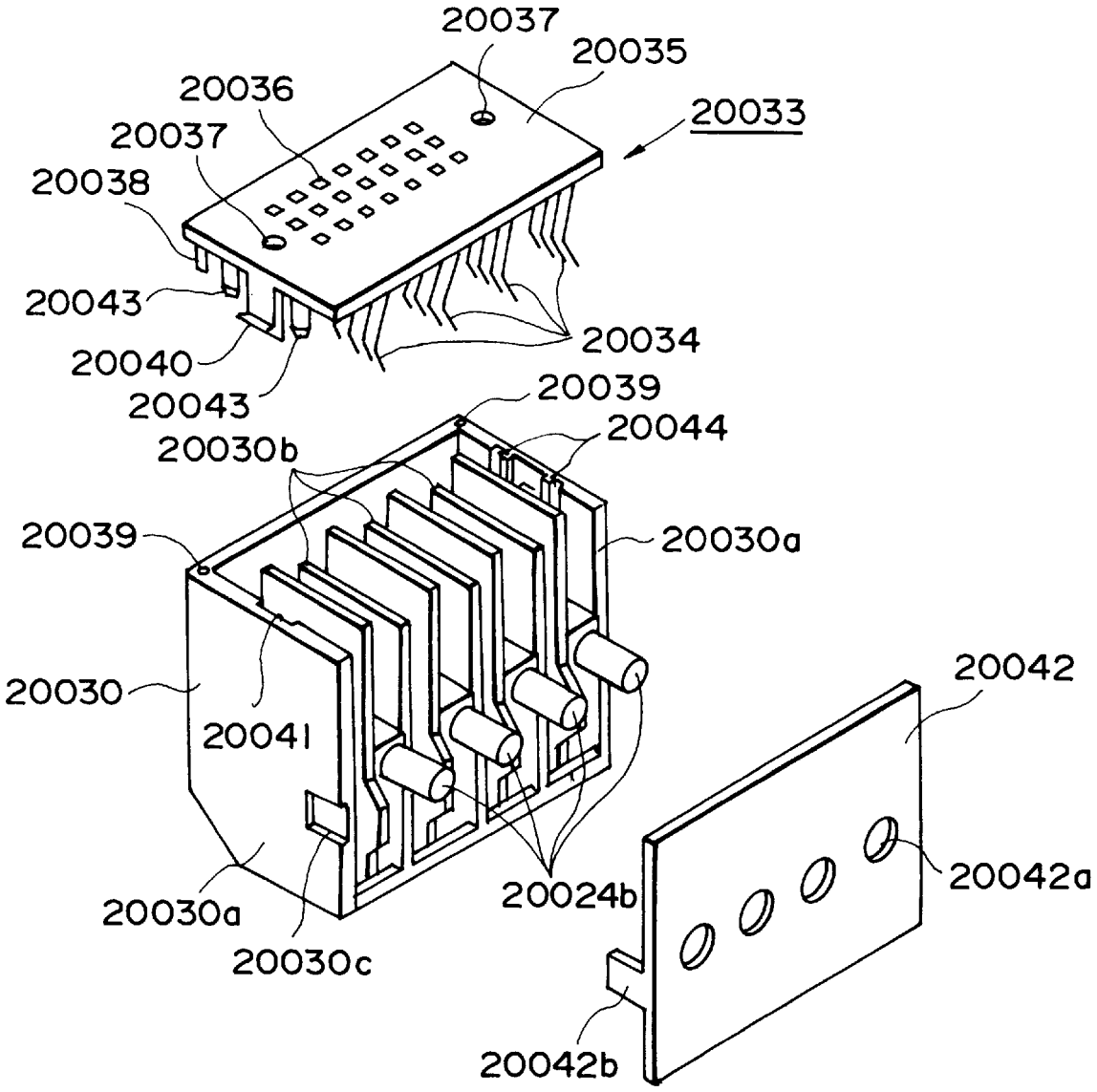
FIG. 35 is an exploded perspective view of a recording head unit.

FIG. 35 shows a state in which the recording heads 20030*b* are supported and fixed in recording head supporting portions 20030*a* of a unit frame 20030. A relaying connector 20033 is provided, on the backside thereof, a plurality of contact members 20034 for supplying electric signals to each of the recording heads 20030*b*. The contact members 20034 constitutes a line for each of the recording heads. The contact members 20034 are correctly positioned and supported by the housing 20035. Connecting portions 20036 are in contact with connection pads (not shown) of a carriage to establish electric contact therewith.

Positioning holes 20037 are engaged with positioning pins (not shown) of the carriage corresponding thereto, by which the positional deviation is prevented between the connecting portion 20036 and the connection pads of the carriage, thus assuring the electric connection. As many as possible wiring lines between the contact members 20034 and the connecting portions 20036, are collected together electrically among the recording heads 20030*b* in the housing 20035. For example, grounding lines are collected together, thus reducing the number of connections. Designated by reference numeral 20038 are a pair of positioning pins for positioning relative to the unit frame 20030 and for receiving force from contact members 20034, and are projected at the corner portions of the backside of the housing 20035. The positioning pins 20038 are engaged with positioning holes 20039 formed on a top surface of the unit frame 20038 corresponding thereto.

A pair of locking arms 20040 are projected adjacent a side surface of the backside of the housing 20035. Engaging portions 20040*a* in the form of hooks are formed at ends of the locking arms 20040. Engaging recesses 20041 are formed in an inside surface of the outer wall 20030*a* of the unit frame 20030. As will be described hereinafter, the engaging arms 20040 are engaged with engaging recesses 20041, and the positioning pins 20038 are engaged with the positioning holes 20039, by which, the relaying connector 20033 is mounted and fixed to the unit frame 20030. At the opposite sides of the engaging arm 20040, guiding ribs 20043 having tapered surfaces 20043*a* at the ends, are projected. At the opposite sides of the engaging recess 20041 of the unit frame 20030 corresponding to the guiding ribs 20043, guiding grooves 20044 are formed.

Figure 36:
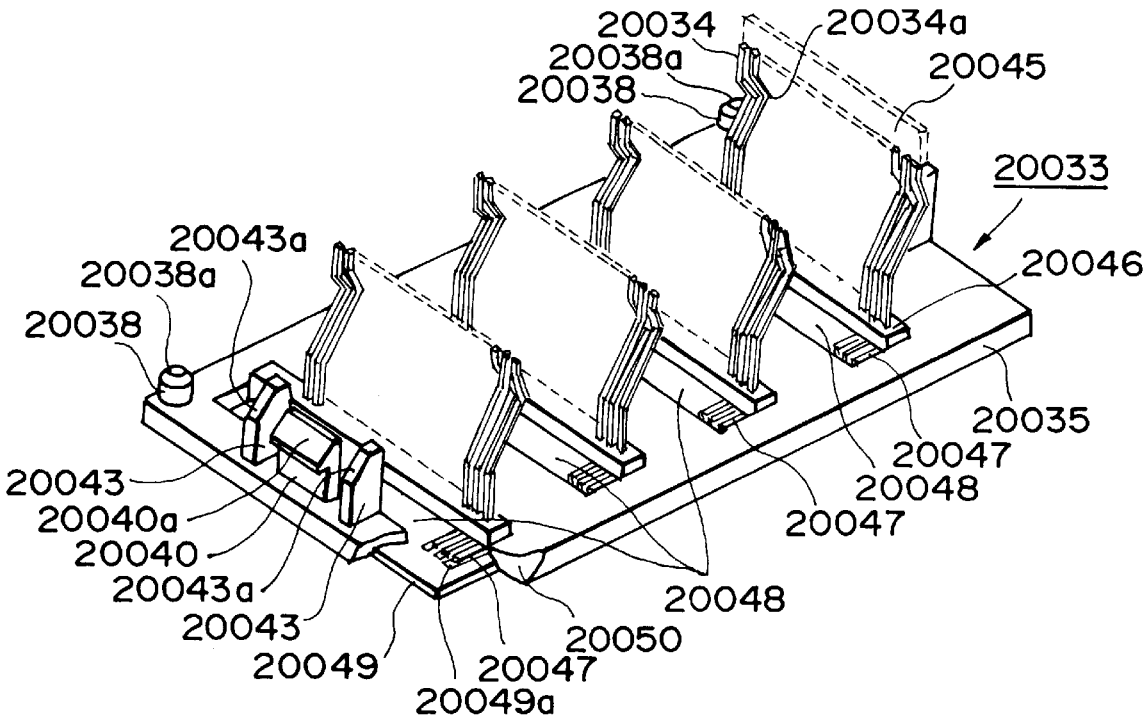
FIG. 36 illustrates a relaying connector.
Figure 37:
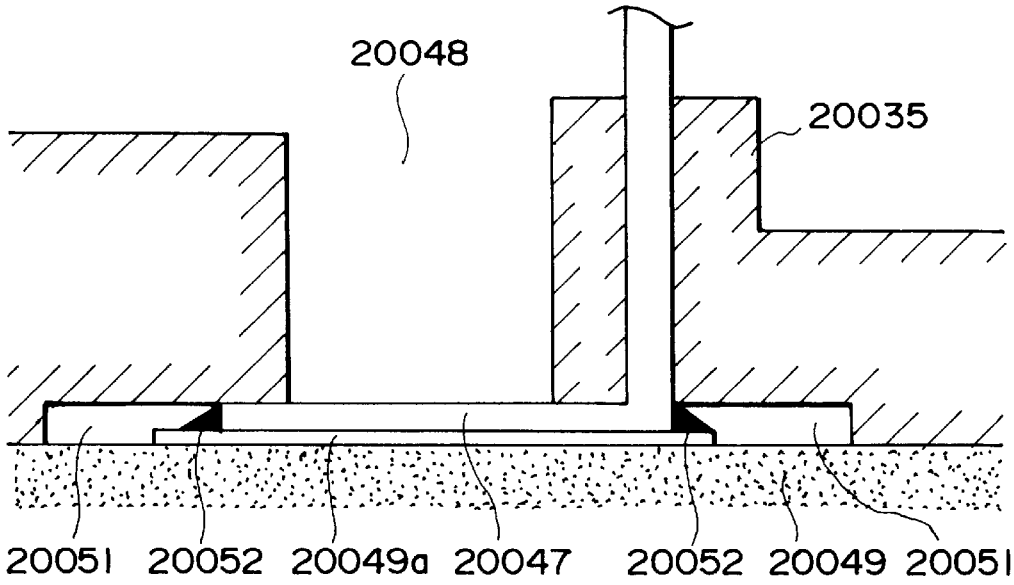
FIG. 37 is a partly enlarged view of a relaying connector.

Designated by a reference numeral 20042 is a cover for covering and protecting inner precision parts of each of the recording heads 20030*b*. The cover 20042 has four holes 20042*a* for receiving ink supply pipes 20024*b* and filters 20024*d*. In this embodiments, four recording heads 20030*b* are arranged in the unit frame 20030*a*. The cover 20042 is mounted on the unit frame 20030 by engaging the engaging poles 20042*b* at the opposite ends with the corresponding engaging portions 20030*c* of the unit frame 20030. Referring to FIGS. 36 and 37, the detailed structure of the relaying connector 20033 will be described.

In FIG. 36, the relaying connector 20033 is shown with its backside face up. In this Figure, the contact members 20034 for one recording head are integrated by a connector 20045 adjacent the bent contact 20034*a*. In FIG. 36, the connector 20045 has been removed, and therefore, it shows the final form.

Designated by 20046 are fixing members for fixing the contact members 20034 on the housing 20035, and they are insert molded or press-fitted into the housing 20035. Designated by 20047 are electric contact portions for electrically connecting the contact members 20034 with the wiring member 20049. The connecting portions 20047 are in an elongated opening formed in the housing 20035. A wiring member 20049 is a substrate for establishing electric connection between the contact members 20034 and the connecting portions 20036. Pads 20049*a* are formed at positions of the elongated openings corresponding to the electric connecting parts 20047 of the wiring member 20049. Therefore, the elongated opening 20048 is used when the electric connecting parts 20047 are connected with the pads 20049*a*. For example, when the laser soldering is carried out, the laser beam is applied through the opening. If the re-flow soldering is effected, the thermal energy from thermal source is applied through the opening. The soldering method is not limited to these.

As described hereinbefore, at two corner portions of the housing 20035, positioning pins 20038 are projected for the purpose of positioning relative to the unit frame 20030. Adjacent the opposite sides of the housing 20035, locking arms 20040 are projected to snap-fix it relative to the unit frame 20030.

As shown in FIG. 37, adjacent a periphery 20050 (FIG. 36) of the electric connecting portions 20047 in the housing 20035, spaces 20051 are formed adjacent the pads 20049 of the wiring members 20049. This is effective to produce meniscus of fused soldering metal 20052 between the electric connecting parts 20047 and the pads 20049*a*. If the space 20051 has sufficient size, the fused metal not establishing the meniscus might produce short circuit between adjacent ones. Therefore, when the contact members 20034 are press-fitted or insert-molded in the housing 20035, the formation of the spaces 20051 is assured.

In FIG. 36, guiding ribs 20043 are projected at the opposite sides of the locking arm 20040. The guiding ribs 20043, are disposed at positions corresponding to guiding grooves 20044 formed in the unit frame 20030, as described hereinbefore. The contact members 20034 are provided to oppose the pressure or contact between the recording head 20030*b* and the wiring board. The guiding rib 20043 has a formed inclined surface 20043*a*. In accordance with the configuration of the guiding groove 20044, the locking arm 20040 can be introduced to a predetermined position of the locking recess 20041.

Figure 38:
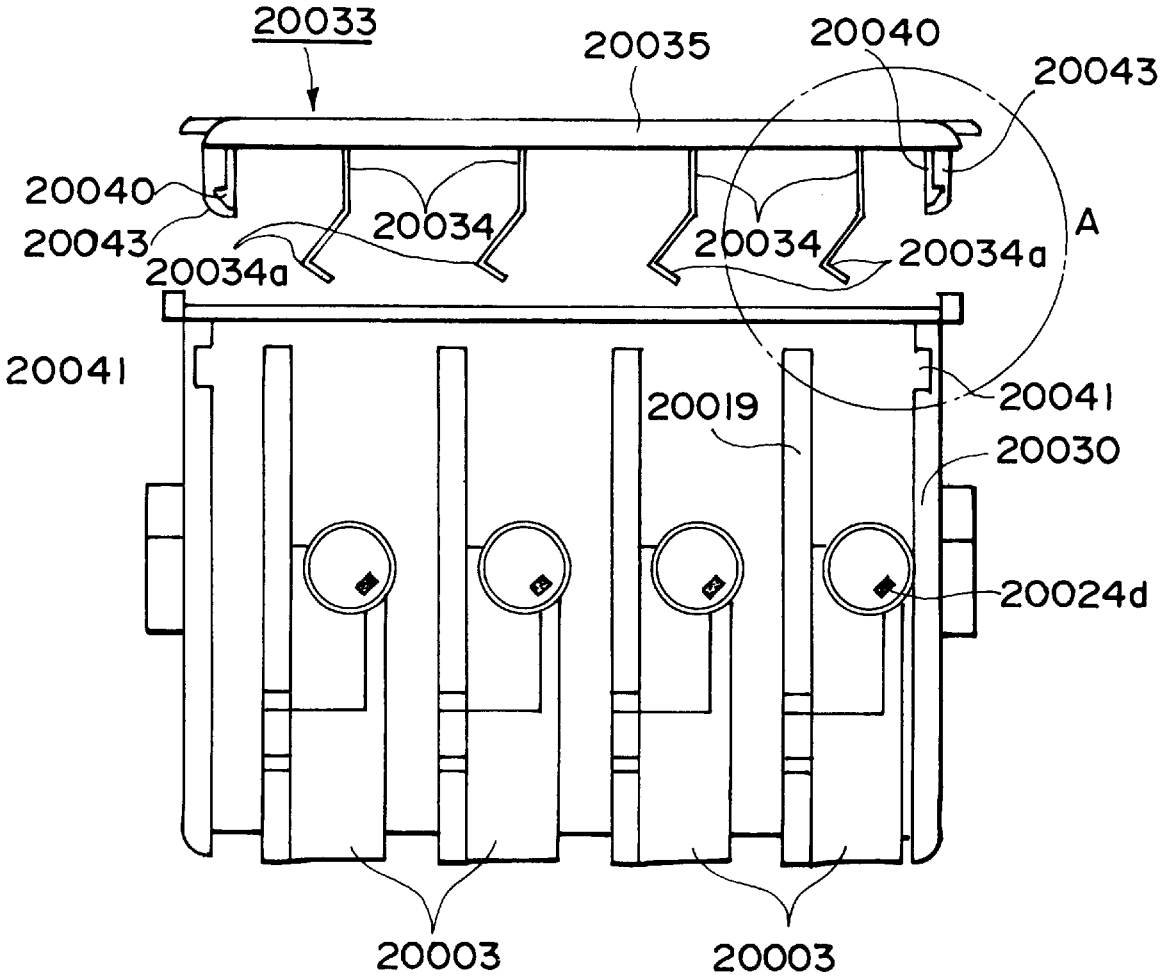
FIG. 38 illustrates a state immediately before the relaying connector is mounted in the frame.

Mounting of the relaying connector:

Referring to FIGS. 38–43, the description will be made as to the assembling operation for mounting the relaying connector 20033 into a unit frame 20030 having fixed recording heads 20003. As shown in FIG. 38, the relaying connector 20033 is fixed by inserting the contact members 20034 from the top of the unit frame 20030 with the locking arm 20040 and the guiding ribs 20043 faced downward, so as to be contacted to the wiring board 20021 of each of the recording heads 20003. Referring to FIG. 38 (enlarged view), the mounting operation of the relaying connector will be described.

Figure 39:
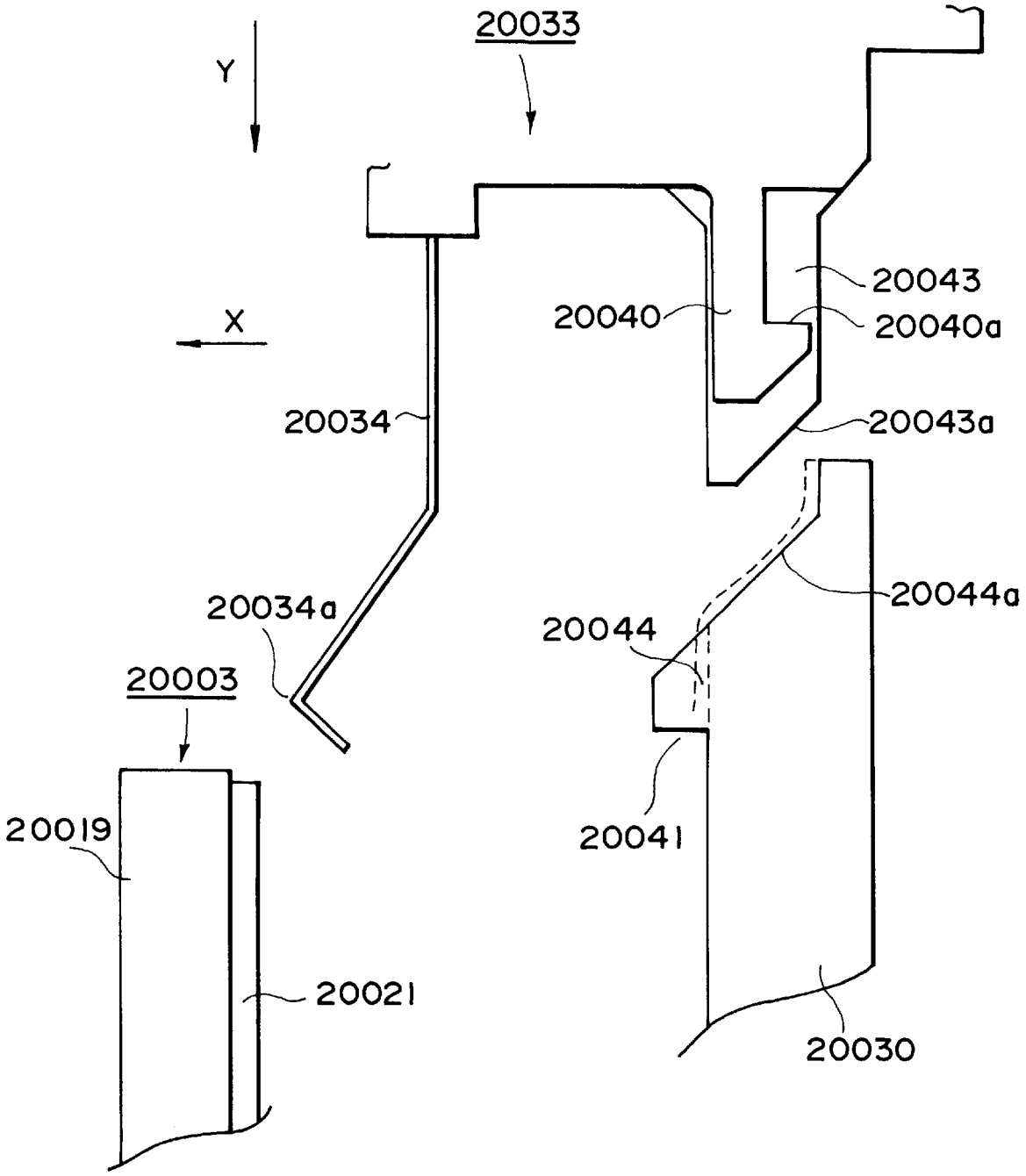
FIG. 39 illustrates an assembling operation when the relaying connector is assembled into the frame.

In FIG. 39, when the relaying connector 20033 is moved toward the unit frame 20030 in a direction Y, the guiding ribs 20043 are inserted along the guiding groove 20044 of the unit frame 20030, by which the relaying connector 20033 can be positioned in the unit frame 20030 without the contacts 20034*a* of the contact members 20034 being out of contact with the wiring board 20021 of the recording head 20003.

Figure 40:
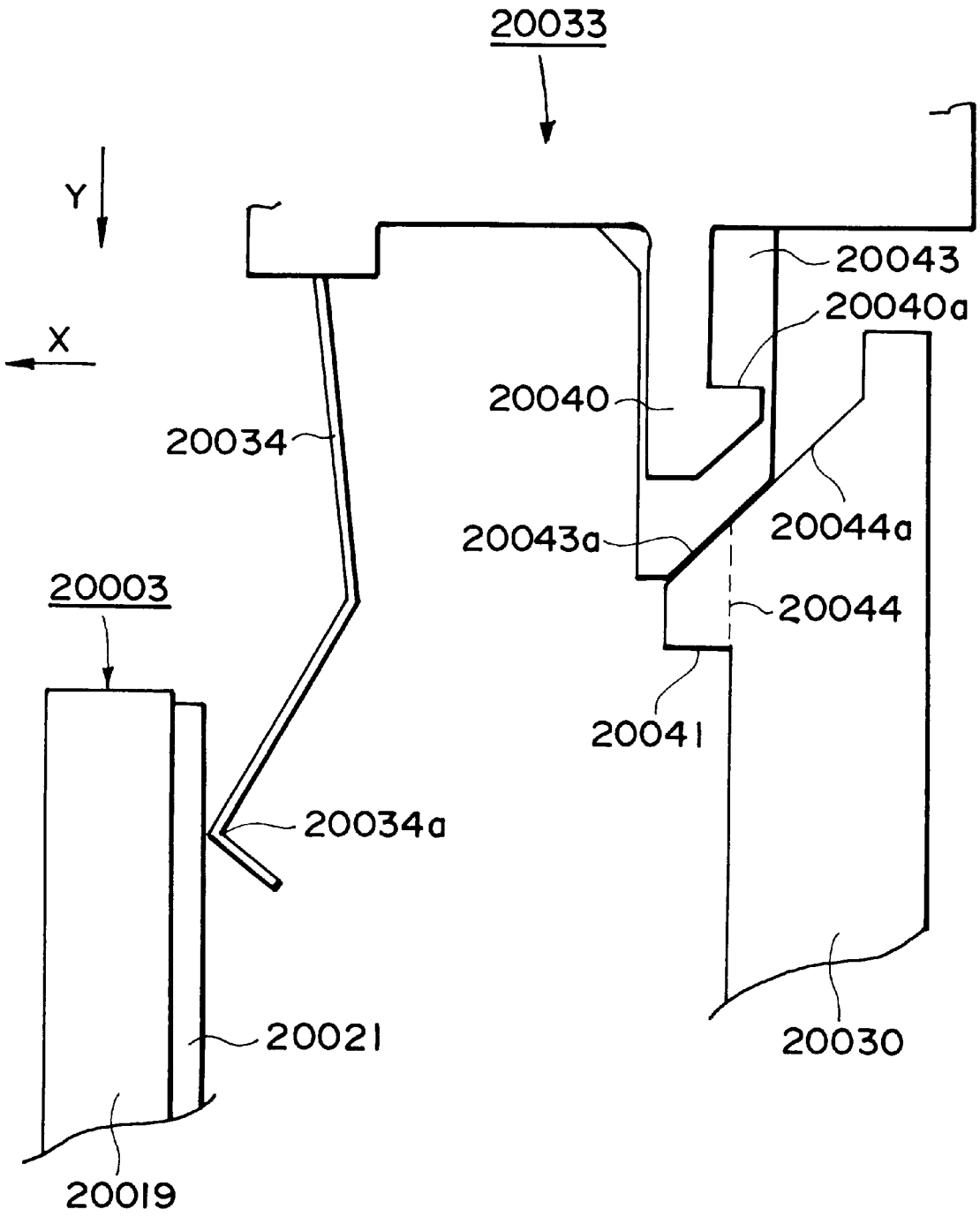
FIG. 40 illustrates an assembling operation of the relaying connector into the frame.

As shown in FIG. 40, when the relaying connector 20033 is moved to such an extent that the inclined surface 20043*a* of the guiding rib 20043 is abutted to an inclined surface 20044*a* of the groove 20044, the relaying connector 20033 starts to move in a direction X, so that the contacts 20034*a* of the contact members 20034 are brought into contact to the wiring board 20021. Even in this state, the locking arm 20040 does not received any force, and retains its state.

Figure 41:
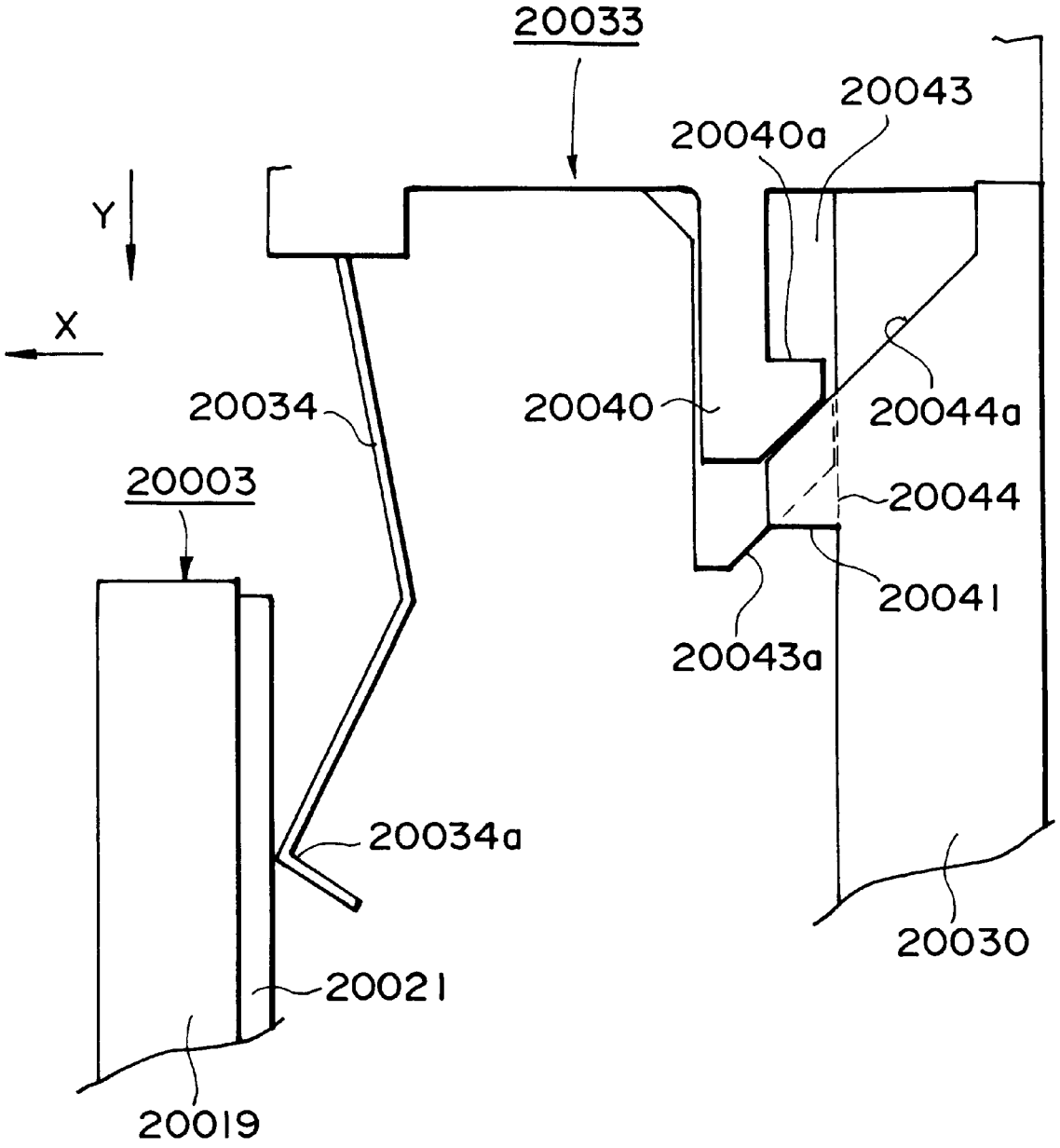
FIG. 41 illustrates an assembling operation of the relaying connector into the frame.

As shown in FIG. 41, when the relaying connector 20033 is further moved in the direction Y, the guiding rib 20043 passes by the inclined surface 20044*a*, so that the relaying connector 20033 comes to move only in the direction Y. With this state, the deflection of the contact members 20034 is in the final state. In other words, the contact pressure between the contact members 20034 and the wiring board 20021 is substantially maximum (MAX). Even in this state, what receives the reaction force of the contact pressure is the guiding ribs 20043, and therefore, the locking arm 20040 does not receive force.

Figure 42:
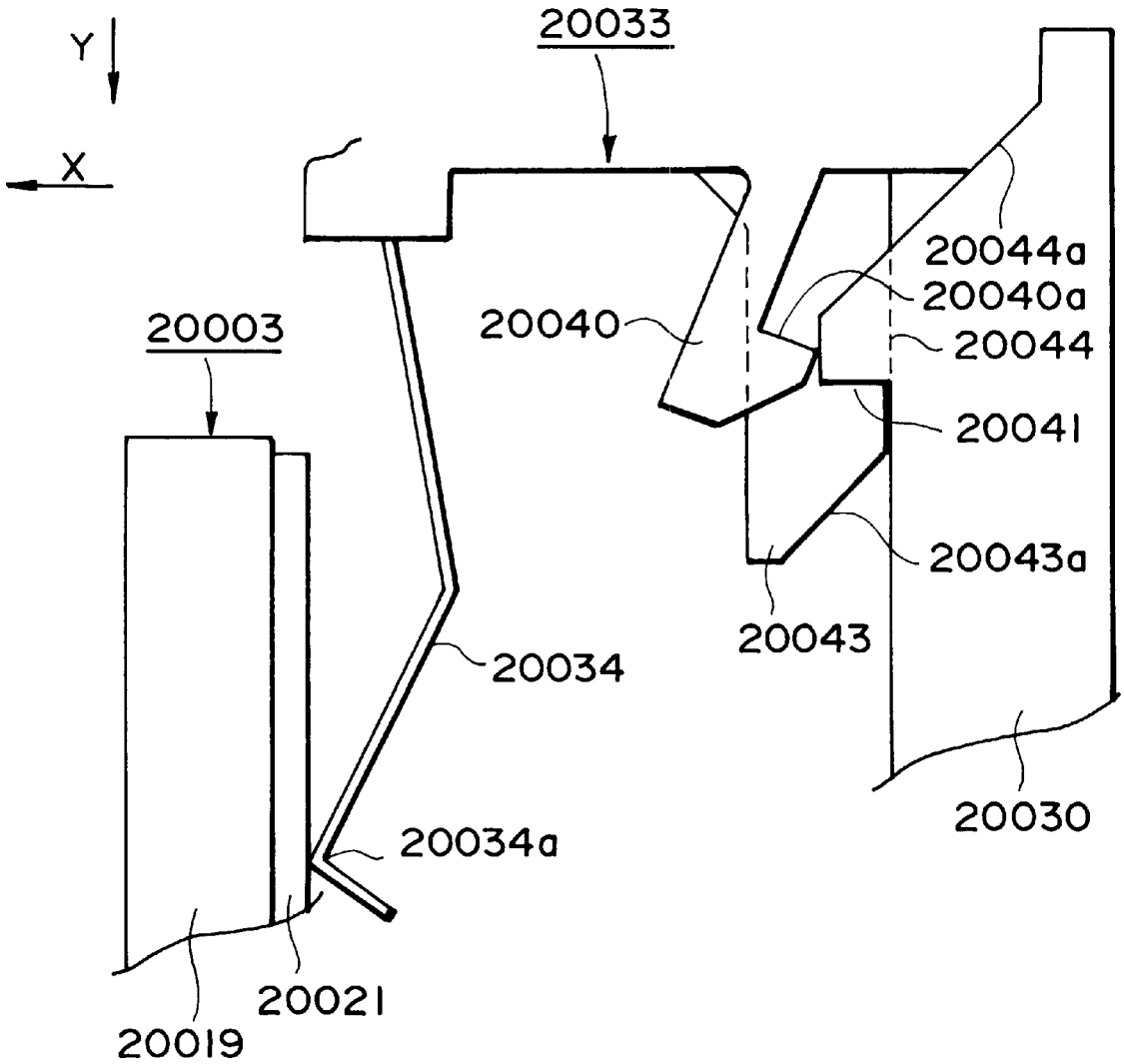
FIG. 42 illustrates an assembling operation of the relaying connector into the frame.
Figure 43:
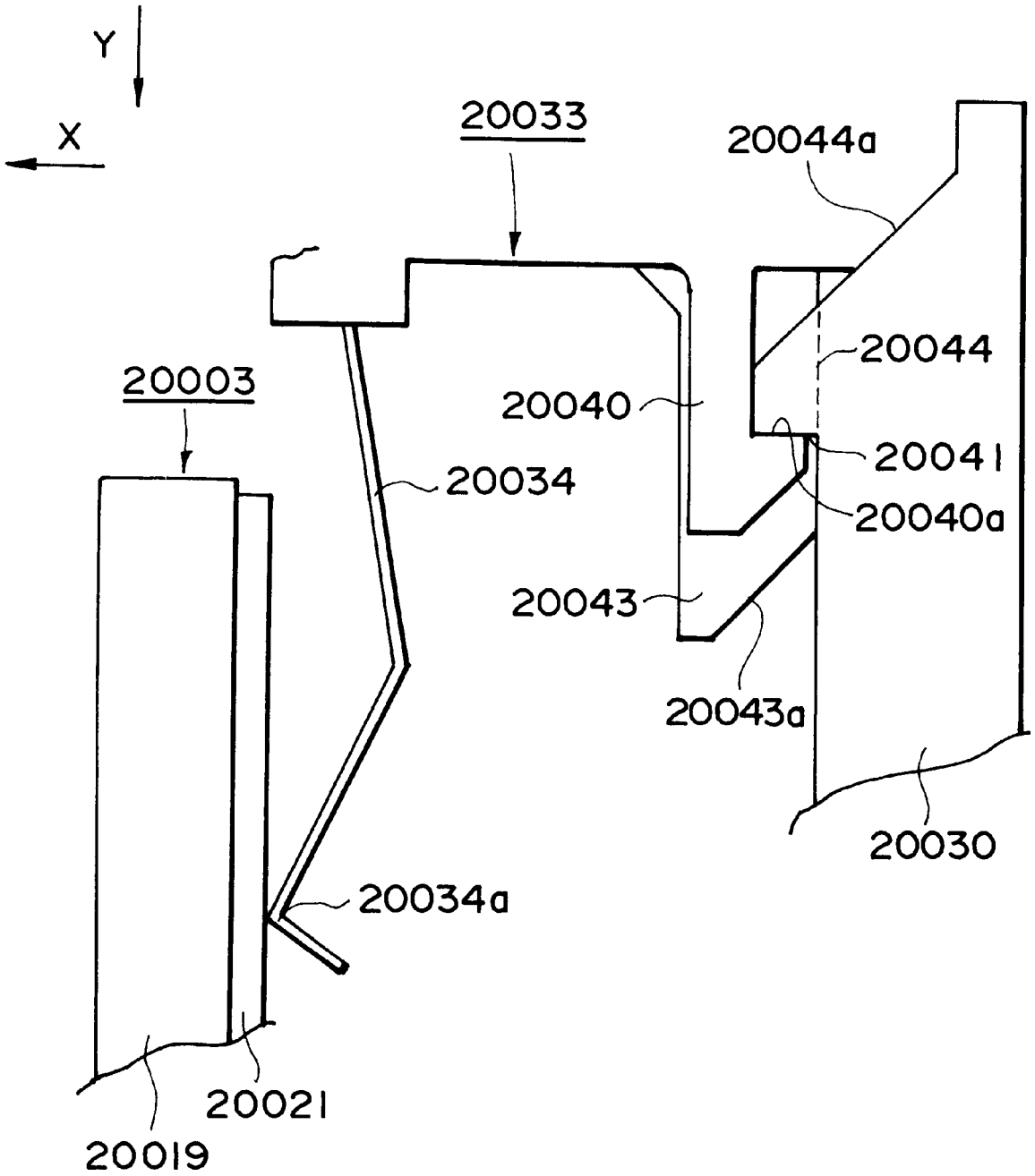
FIG. 43 illustrates an assembling operation of the relaying connector into the frame.

Subsequently, the relaying connector 20033 is further moved in the direction Y. As shown in FIG. 42, the locking arm 20040 is abutted to the unit frame 20030 and starts to deflect in the direction X. Subsequently, as shown in FIG. 43, a locking portion 20040*a* is engaged with an engaging recess 20041. As shown in FIG. 42, when the locking arm 20040 deflects, the contact pressure between the contact members 20034 and the wiring board 20021 is not influenced.

When the locking arm 20040 and the locking recess 20041 are locked, the positioning pin 20038 of the relaying connector 20033 is engaged with the positioning hole 20039 of the unit frame 20030. An end 20038*a* of the positioning pin 20038 has a formed surface as shown in FIG. 36, and the corresponding positioning hole 20039 is also formed, thus permitting smooth engagement and positioning.

With this structure, when the relaying connector 20033 is assembled into the unit frame 2003, there is not liability that the contact members 20034 are abutted to the recording head 20003 with the result of excessive load to the contact members 20034 and the recording head 20003. By doing so, the mounting operation of the relaying connector 20033 to the unit frame 20030 can be carried out efficiently and safely. In addition, the positional accuracy of the recording head relative to the unit frame 20030 can be assured.

If the contact members 20034 receive excessive load, they may deform. However, in this embodiment, only the necessary contact pressure is applied, so that the electric connection with the recording head is reliably assured.

In addition, the reaction force due to the contact pressure between the contact members 20034 and the recording head 20003, is received by the guiding ribs 20043, and therefore, the locking arm 20040 received only the load required for the locking with the locking recess 20041, and therefore, the locking arm 20040 is not deformed. This is effective to assure the connection between the relaying connector 20033 and the unit frame 20030 when the former is assembled into the latter. This is effective to assure the reliability of the electric connection between the contact members 20034 and the recording head 20003.

Furthermore, the relaying connector 20033 and the unit frame 20003 or the like, can be integrally molded from a molding material, and therefore, it is suitable for mass-production at low cost, and the ink jet recording apparatus of highly accurate and highly reliable, can be provided.

Referring to FIGS. 44–51, a confining post 40011 according to a further embodiment of the present invention will be described in detail.

Figure 44:
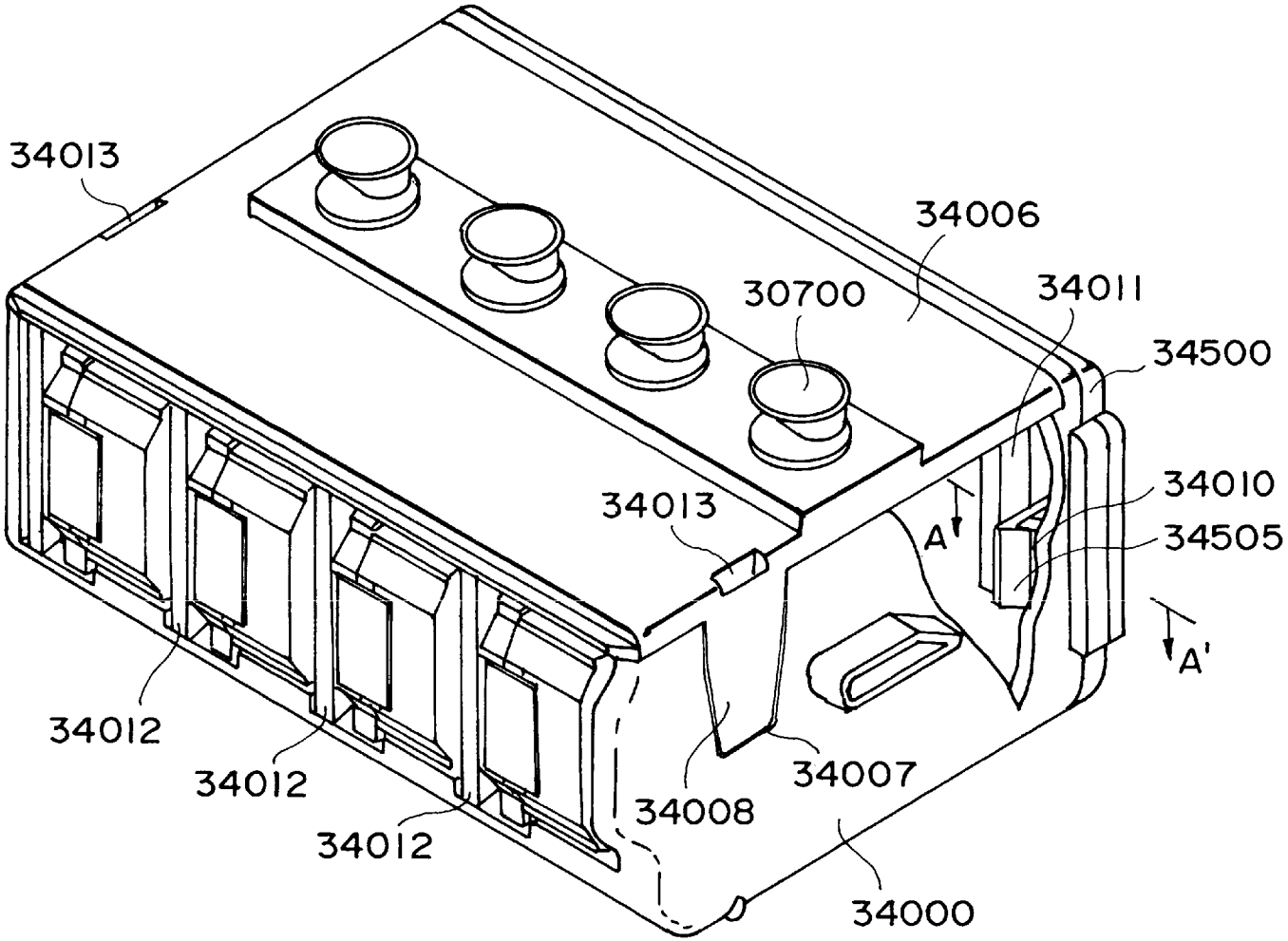
FIG. 44 illustrates a supporting post according to an embodiment of the present invention.

FIG. 44 shows the state in which the head unit has been assembled. As regards the relaying connector 34500, the unit frame 34000 and the covering member 34006, are partly broken for the sake of easy understanding.

As will be understood from the Figure, a locking pawl of the locking arm 34505 of the relaying connector 34500 is engaged with an engaging recess 34010 of the unit frame 34000, so that the relaying connector 34500 is set in the unit frame 34000. Designated by reference numeral 34011 is a confining post integrally molded with the cover 34006. It is disposed adjacent a back surface of the locking arm 34505 of the relaying connector 34500. This positional relation is established when the relaying connector 34500 is assembled into the unit frame, and the cover 34006 is mounted.

Figure 45B:
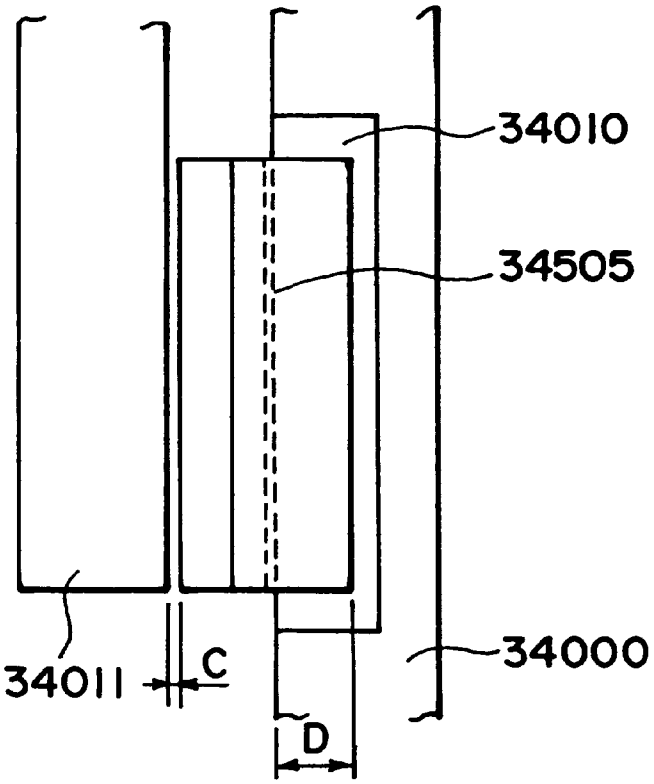
FIG. 45 illustrates in more detail the supporting post.
Figure 45A:
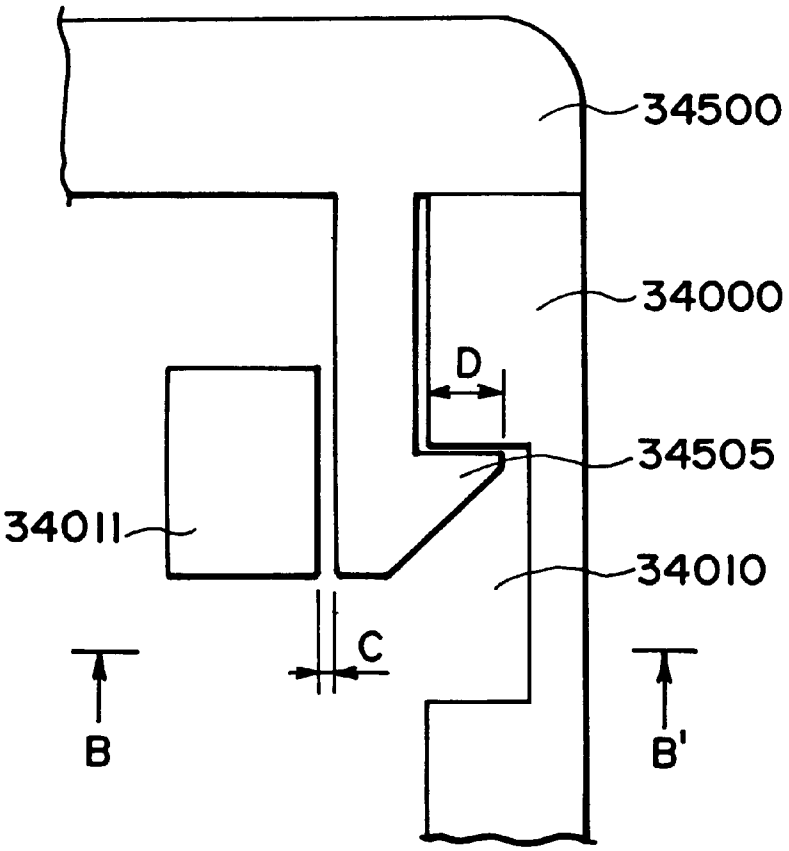

The left part of FIG. 45 shows a sectional view taken along a line A–A' in FIG. 44. Here, the confining post 34011 is disposed so as to satisfy C<D relative to the locking arm 34505 and the locking recess 34010. The right part of FIG. 45 is a sectional view taken along a line B–B' in the left part of FIG. 45.

With the structure described above, the locking arm 34505 is confined by the confining post 34001 at the backside even if it receives impact force by falling or the like, and no disengagement occurs.

Figure 46B:
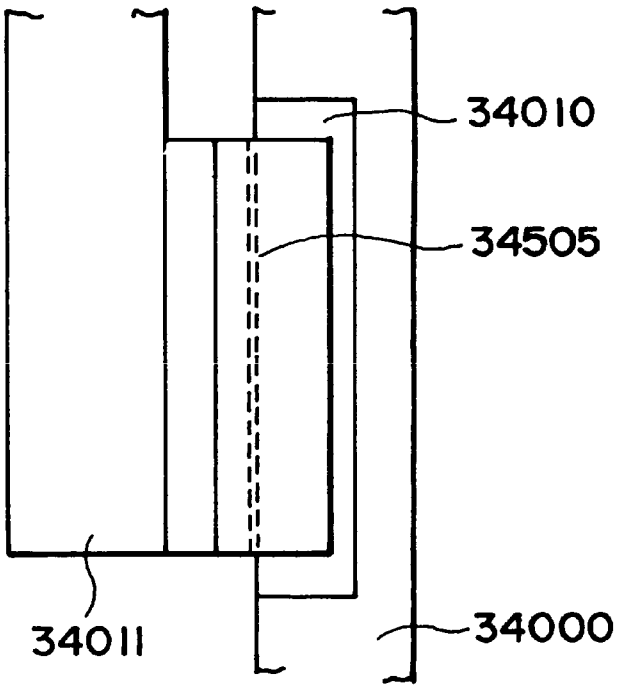
FIG. 46 illustrates the supporting post.
Figure 46A:
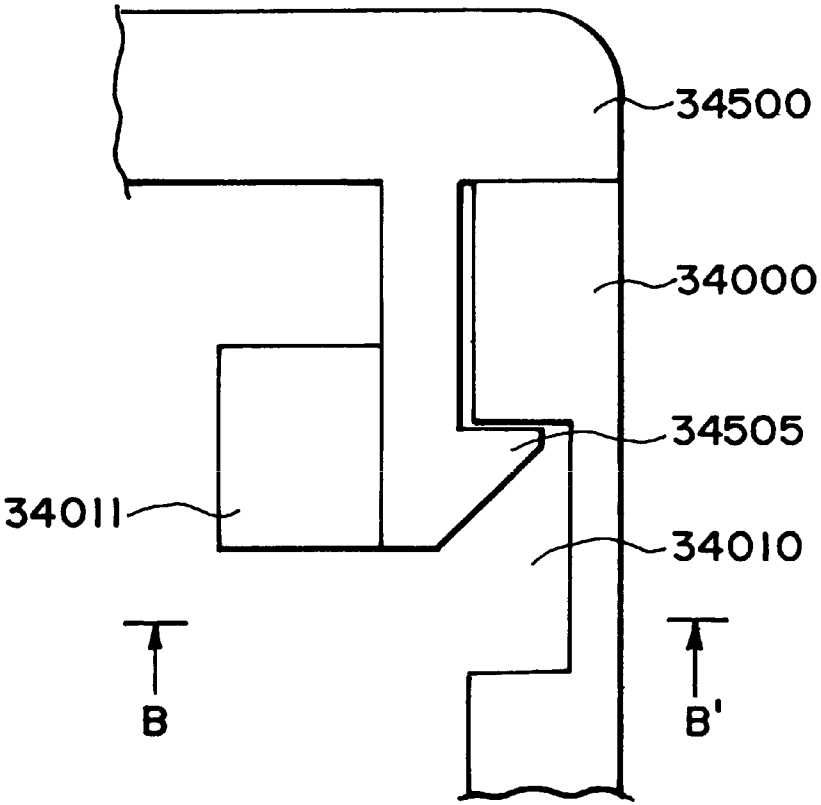

In FIG. 46, the confining post 34011 is contacted to the backside of the locking arm.

This case is better in the locking arm retaining effect, but the assembling is less easy. So, the contact structure or the proximity structure may be selected properly by one skilled in the art.

A hole 34013 is formed when the locking pawl 34008 of the cover 34006 is formed by metal mold, and therefore, it is not formed as the case may be, depending on the structure of the mold.

By supplying an adhesive or bonding material through the hole 34013, the cover 34006 and the unit frame 34000 are securedly bonded, so that the effect of the confining post 340011 can be assured.

Figure 47:
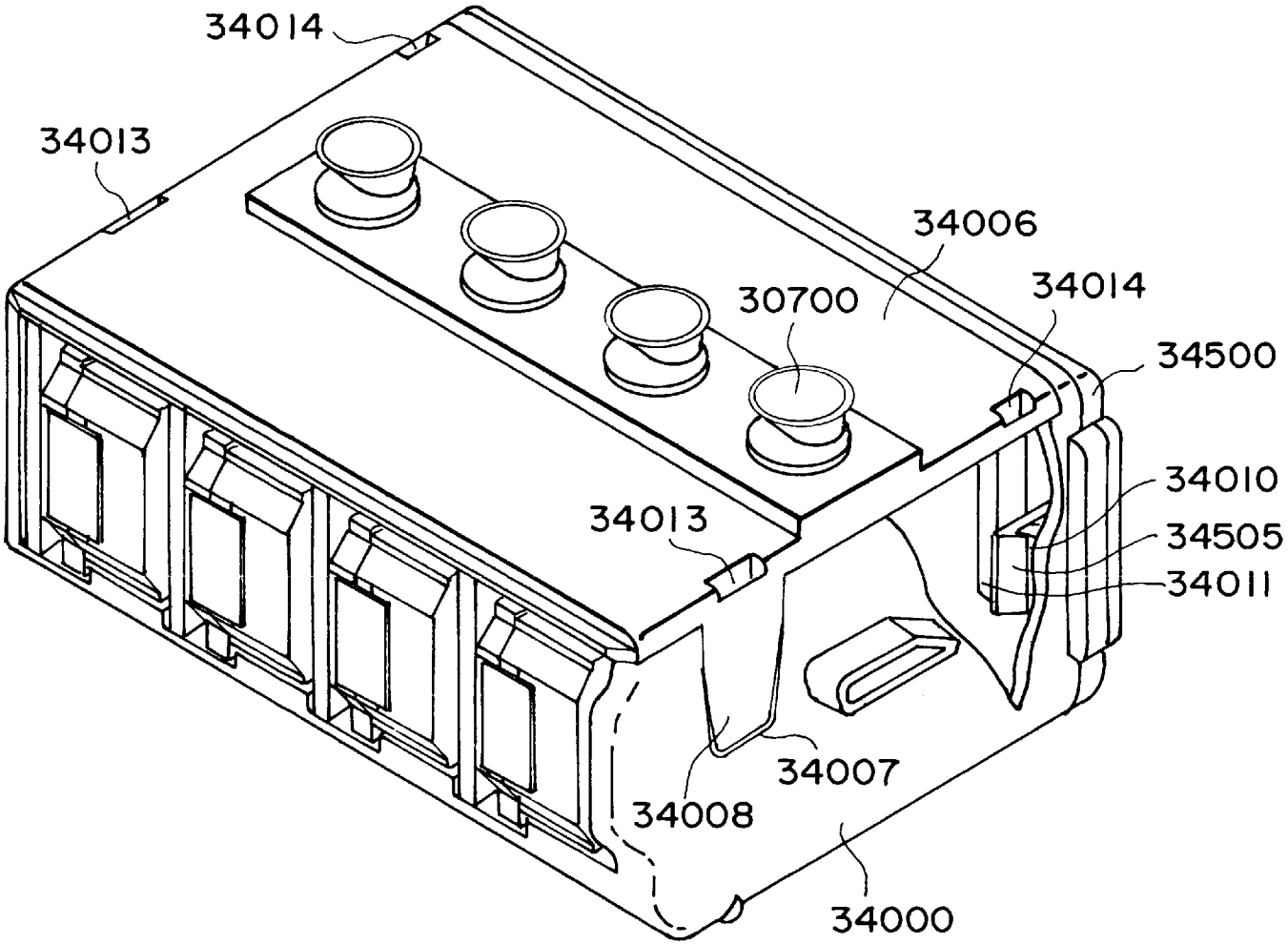
FIG. 47 illustrates a supporting post and an adhesive injection hole.
Figure 48:
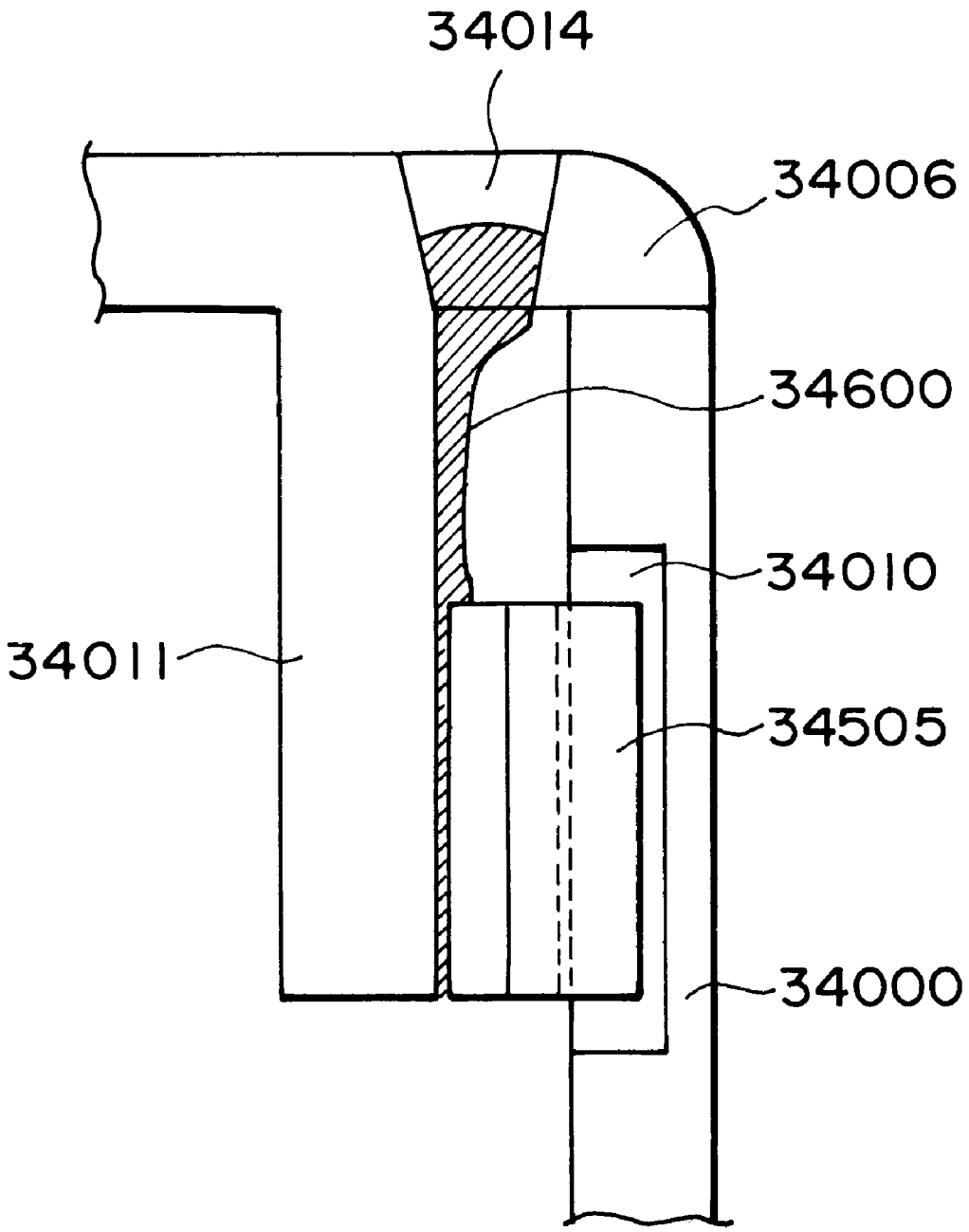
FIG. 48 illustrates a supporting post and an adhesive injecting hole.

Referring to FIGS. 47–51, a confining member according to a further embodiment will be described. In FIG. 47, designated by a reference numeral 34014 is a hole for injecting the adhesive. The hole penetrate through the cover 34006, as shown in FIG. 48, and it is desirably close to the confining post 34011. The adhesive 34600 is supplied through the injection hole 34014, and reaches to the locking arm along the confining post 34011. The amount of the adhesive material 34600 is determined so as to be sufficient to reach to the locking arm 34505.

By doing, so, the locking arm 34505 and the confining post 34011 are bonded and fixed, and therefore, rigid structure is accomplished. By doing so, the cover 34006 is prevented from being taken out without the bonding in the hole 34013.

By this bonding, two surfaces not formed by the unit frame in a direction other than the ink ejecting direction, among the surfaces constituting the head unit, are unified, and therefore, the reliability is further increased as the head unit.

Figure 49:
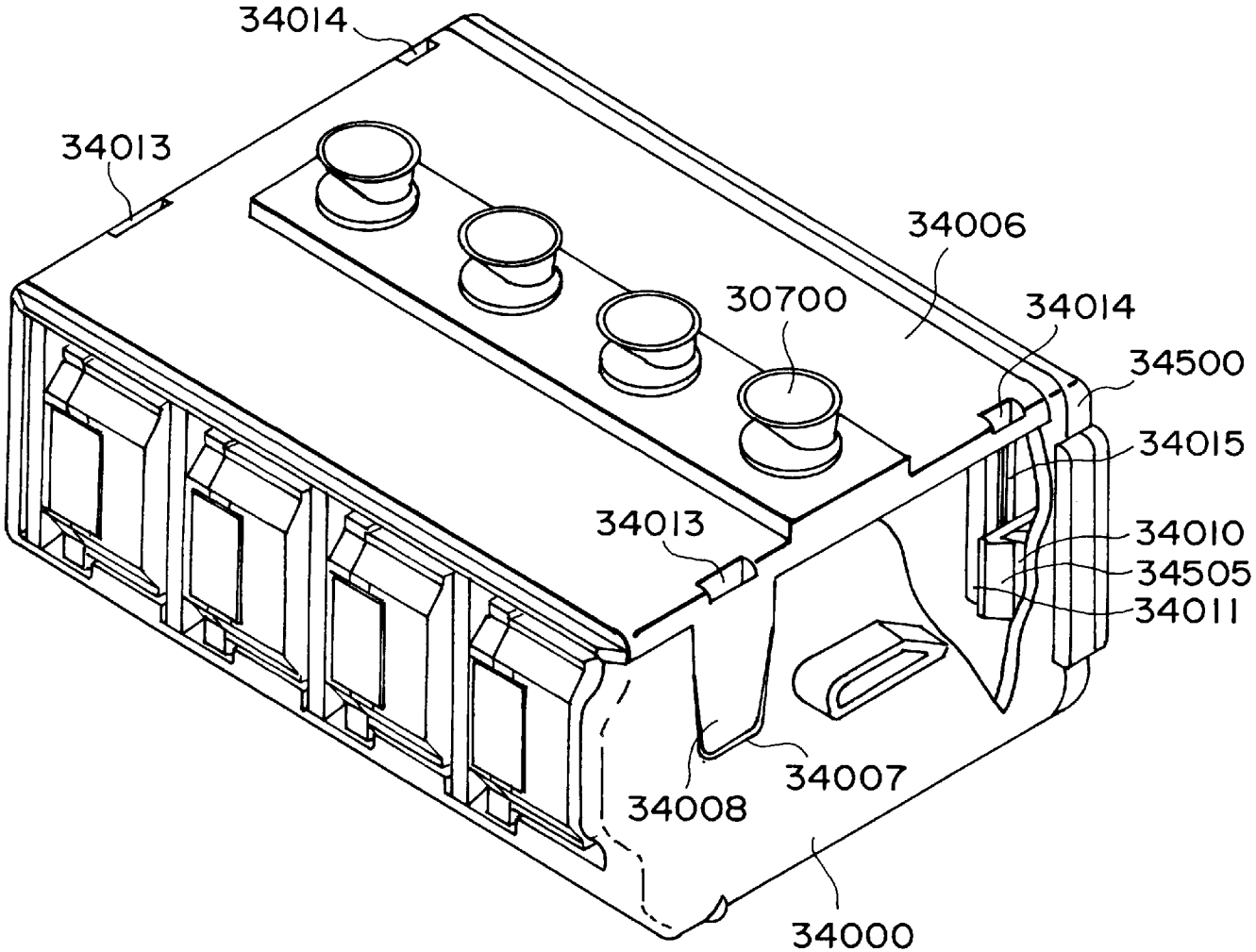
FIG. 49 illustrates a supporting post and an adhesive injecting hole, and a guiding groove.
Figure 50:
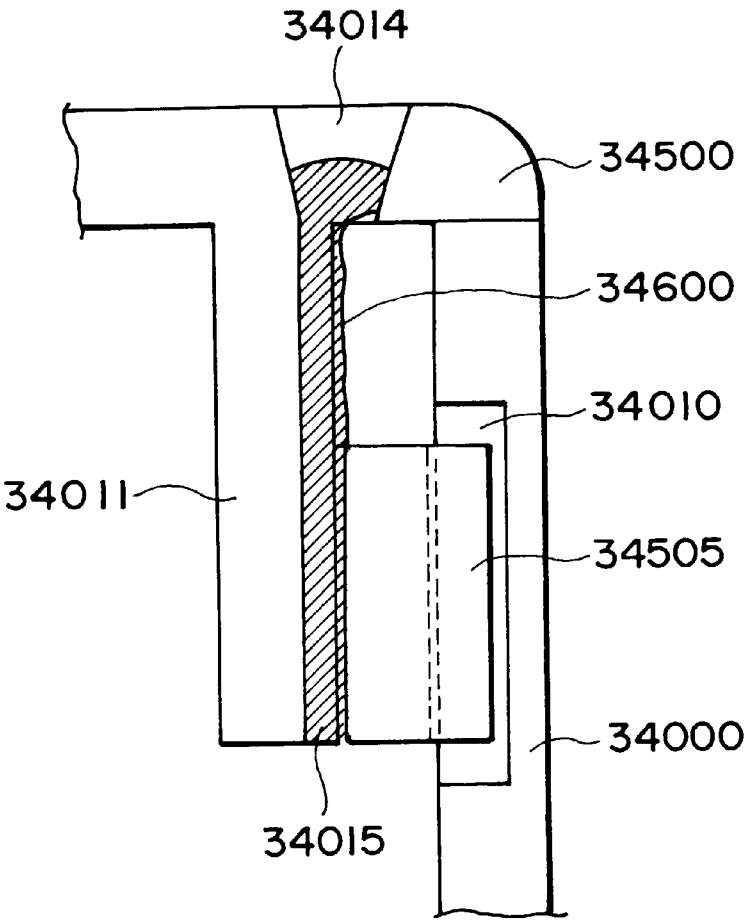
FIG. 50 illustrates a supporting post, an adhesive injecting hole and a guiding groove.

Referring to FIGS. 49 and 50, a further development is shown in which confining post 34011 is provided with a groove 34015. The groove 34015 is effective to assuredly introduce the adhesive material 34600 through the injection hole 34014 to the locking arm 34505, so that the advantageous effects are further assured with small amount of the adhesive material.

Figure 51:
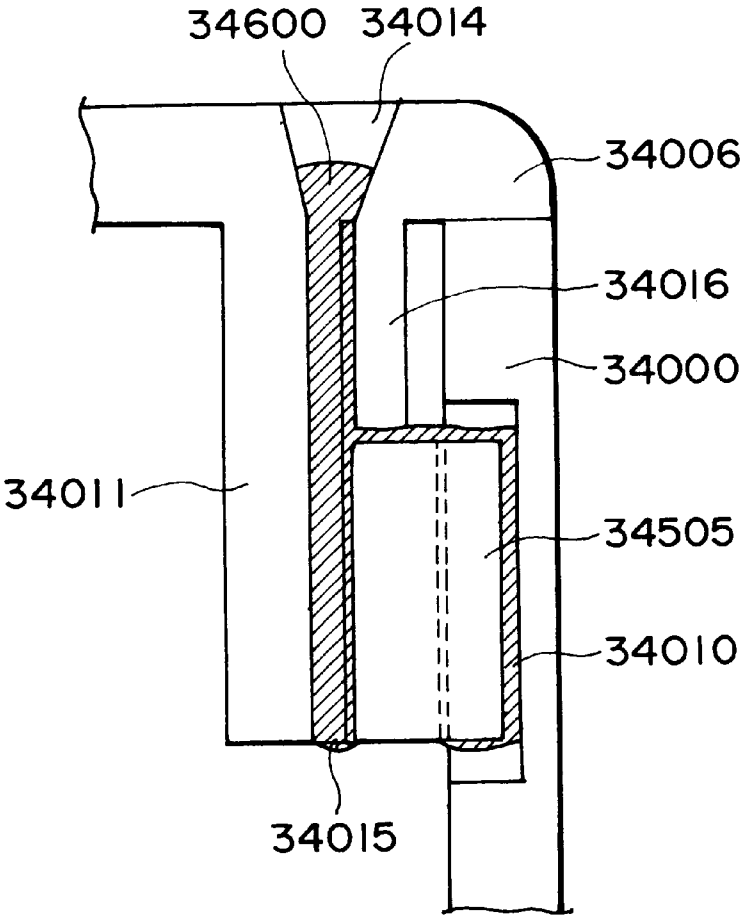
FIG. 51 illustrates a supporting post, an adhesive injecting hole and an auxiliary rib.

FIG. 51 shows a further embodiment in which the confining post 34011 is provided with auxiliary ribs with the injection hole 34014 therebetween. The auxiliary ribs extend to the neighborhood of the locking arm 34505 and also to the neighborhood of the locking recess 34010 of the unit frame 34000. When the adhesive material 34600 is applied, it reaches to the locking arm 34505 and the locking recess 34010 along the confining post 34011 and the auxiliary ribs 34016. By doing so, the three members, i.e., the cover 34006, the relaying connector 34500 and the unit frame 34000, are securedly bonded.

The advantageous effects of the present invention are further enhanced if the recording head unit shown in FIGS. 1–22, is unit with the relaying connector of FIGS. 23–34, the positioning structure shown in FIGS. 35–39, and the confining members shown in FIGS. 44–51.

In the foregoing embodiments, the reference surfaces of the plurality of the recording heads are abutted to the positioning portion of the head frame.

However, there is a liability that foreign matter is disposed between the recording head and the wall because the positioning is effected by urging the plurality of the recording heads to the wall of the carriage. If this occurs, the ink droplet shot position may be deviated with the result of degradation of the image quality.

The positional deviation of the recording head in the sub-scan direction and the inclination of the nozzle row is determined by the positional accuracy between the recording head and the carriage, and therefore, the manufacturing accuracy of the carriage is desirably high, with the result of high manufacturing cost and less design latitude.

The description will be made as to an embodiment in which this problem is solved.

Figure 52:
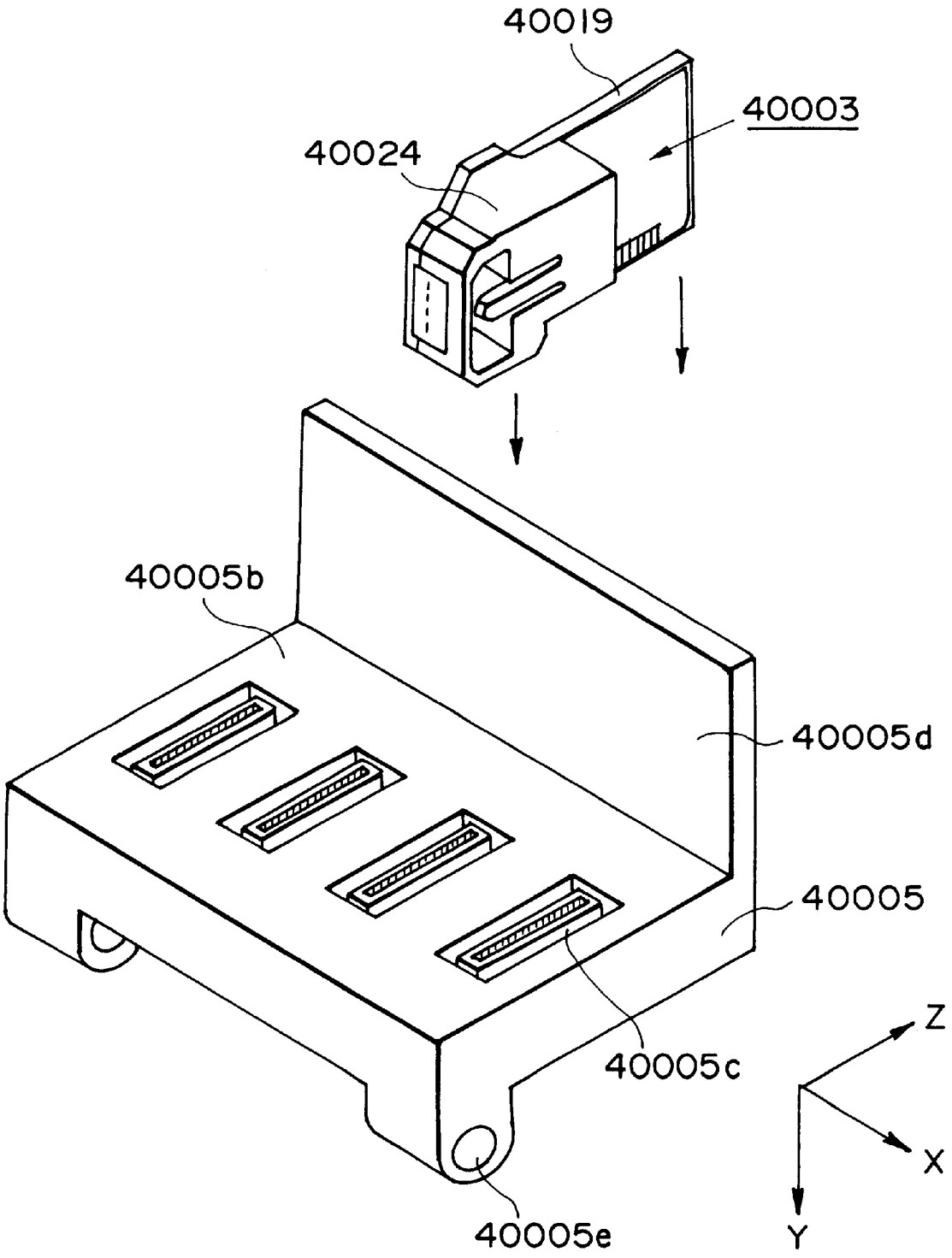
FIG. 52 illustrates a structure for mounting a recording head on a carriage.

Mounting structure for the recorded head:

Referring to FIG. 52, the mounting structure for mounting the recording head 4003 on the carriage 4005 will be described. A color recording is possible by ejecting different color inks from a plurality of recording heads 4003 juxtaposed. When the same color inks are ejected, a high speed recording is possible. In any case, the recording heads 4003 are positioned with high accuracy relative to the carriage 4005.

In FIG. 52, the surface of the carriage 4005 for carrying the recording heads 40005*b* has connectors 40005*c* for receiving electric signals from the main assembly of the recording apparatus. The connector 40005*c* is freely movable so as not to apply excessive force to the recording head 40003. The recording head 40003 is set to the connector 40005*c* so that a reference position of the recording head is aligned with a connecting portion 40005*e* for connecting the lead screw. At this time, the recording head 40003 is positioned leaving a small gap without contact to a wall 40005*d* of the carriage 40005.

Figure 53A:
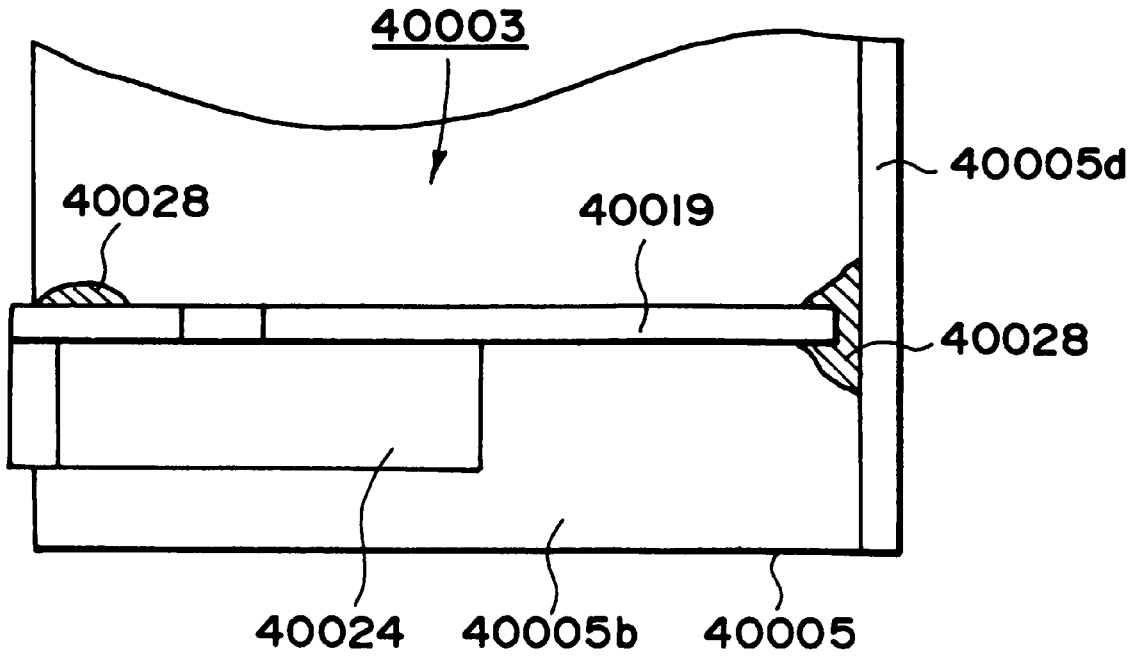
FIG. 53 illustrates a bonding portion between the recording head and the carriage.
Figure 53B:
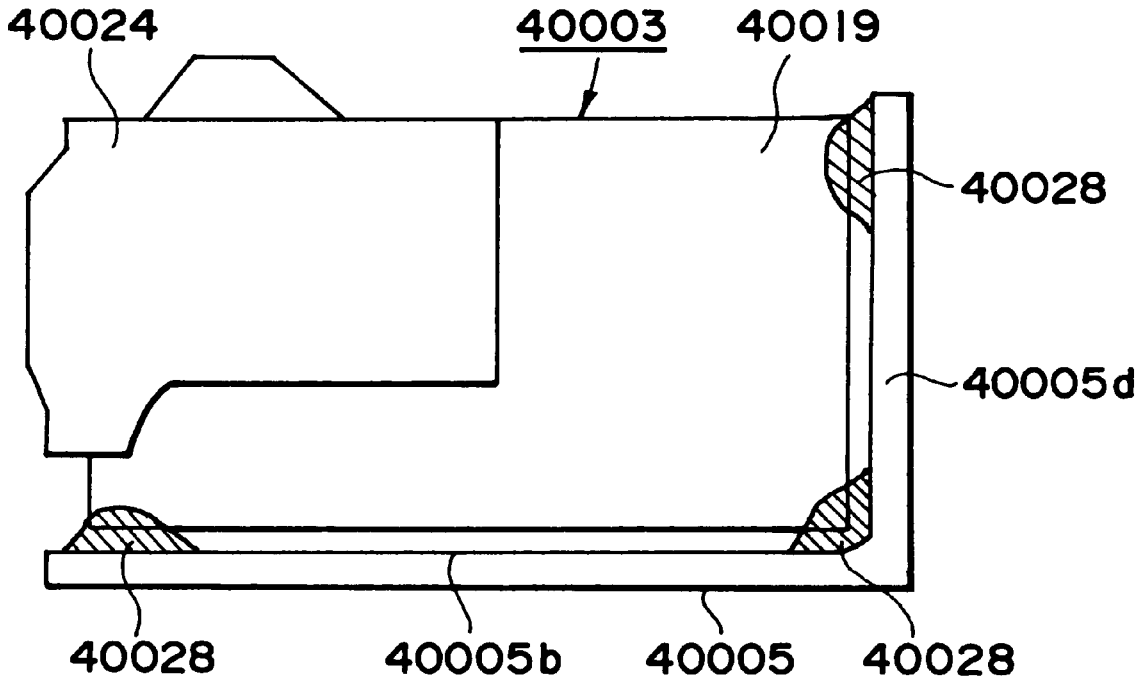

As shown in FIG. 53, the recording head 40003 thus positioned is fixed by application of an adhesive 400028 into the gap formed with the carriage 40005. The number of bonding portions is three at minimum as shown in FIG. 53. the strength can be further increased by applying it over the whole surface. In this embodiment, they are temporarily fixed by UV bonding agent having short tact, and thereafter, a bonding agent 40028 having a stronger bonding force is used to fix them. With the structure described in the foregoing, the recording head 40003 is positioned without being press-contacted directly to the carriage 40005, and therefore, the recording head 40003 can be accurately positioned not depending on the manufacturing accuracy of the carriage 40005. Accordingly, the high print quality can be maintained by avoiding the positional deviation due to the foreign matter introduced at the time of recording head mounting.

When the recording head 40003 is fixed, the height between the connecting portion 40005*e* of the carriage 40005 and the nozzle of the recording head is positioned by the recording apparatus, and therefore, the positional deviation of the recording head 40003 is determined by the manufacturing accuracy of the carriage 40005. Therefore, the ink shot position deviation of each of the recording heads 40003 other than those in the x direction (directions y and z), are all collected, when it is mounted. The correction of the droplet shot position the direction x (main scan direction), can be accomplished by electrically deviating the ink ejection timing for each of the recording heads and the basis of detection of the droplet shot position deviation, as in the prior art.

Figure 54:
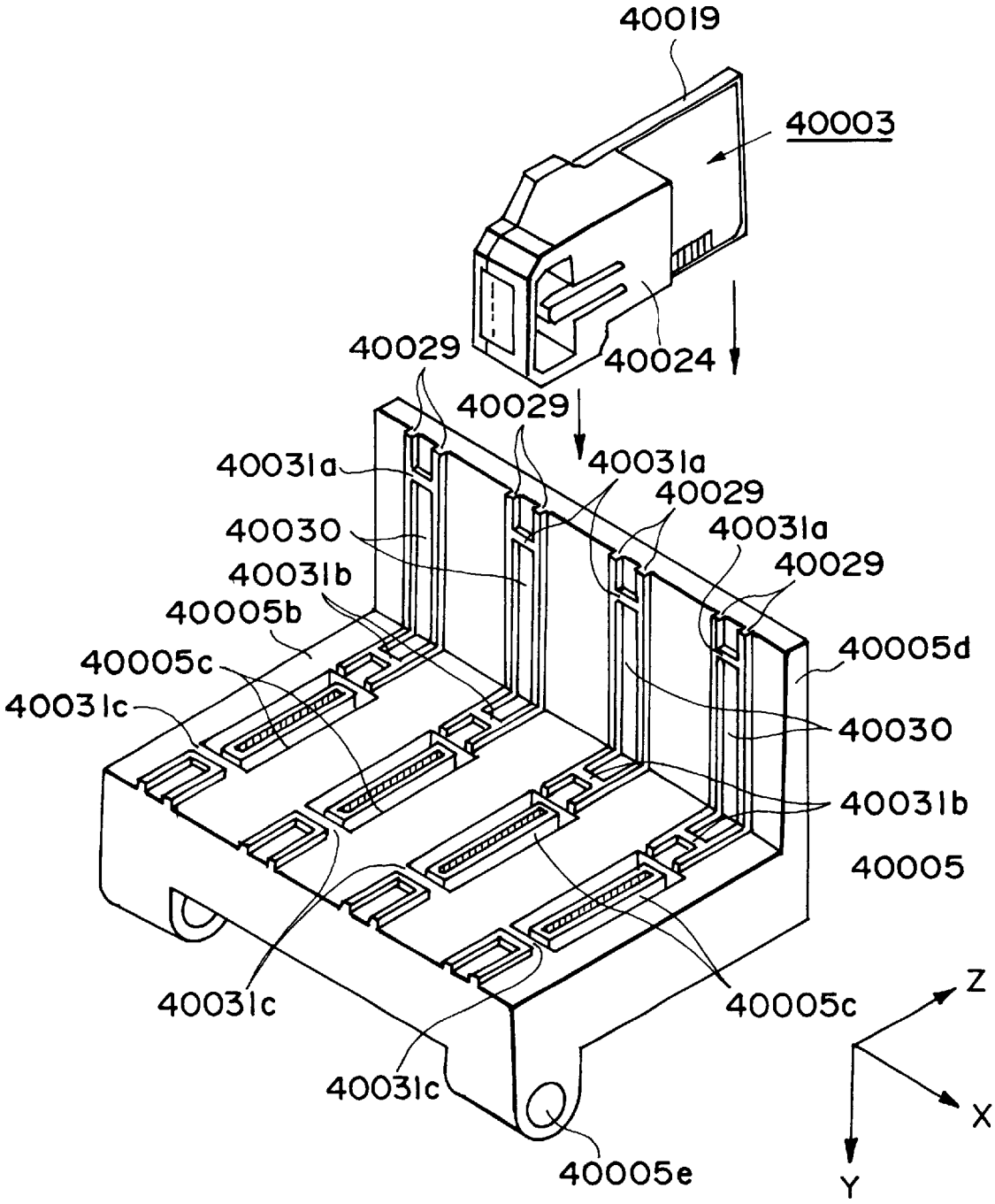
FIG. 54 illustrates mounting of the recording head on the carriage, according to a further embodiment of the present invention.
Figure 55A:
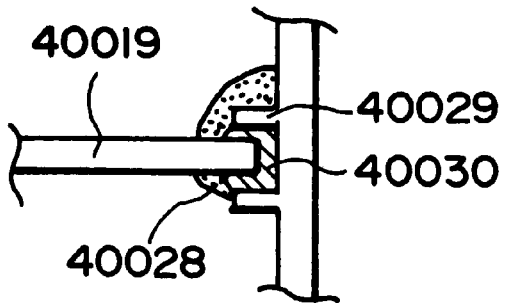
FIG. 55 illustrates bonding portion between the recording head and the carriage.
Figure 55B:
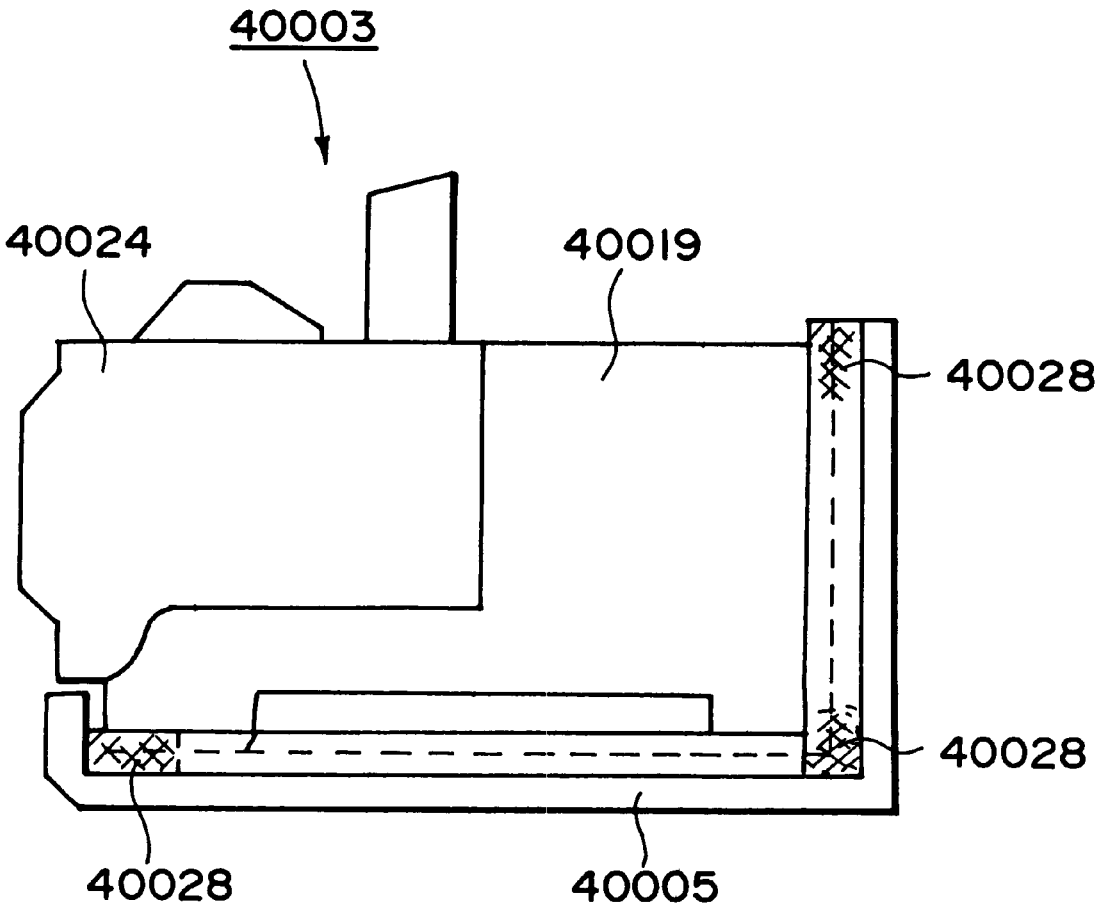
Figure 56:
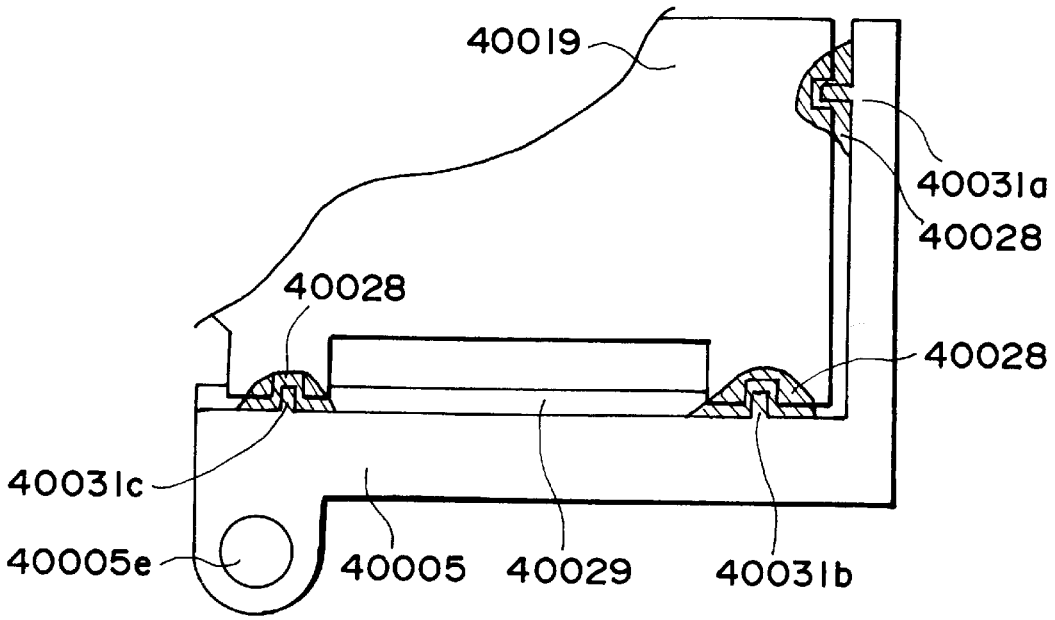
FIG. 56 illustrates bonding portion between the recording head and the carriage.

Recording head mounting structure according to a further embodiment:

Referring to FIGS. 54, 55 and 56, the description will be made as to a further embodiment.

Referring to FIG. 54, on a recording head carrying surface 40005*b* of the carriage 40005 and the wall 40005*d*, parallel rails 40029 are formed in the x and z directions continuing from a connector 40005*c* position. The recording head 40003 is mounted so that the supporting member 400019 is caught by the groove 400030 formed between the rails 40029. The groove 40030 has connecting portions 40031*a*, 40031*b* and 40031*c* for connecting the two rails 40029 in the vertical direction (parallel with the x direction). As shown in FIG. 56, they are engaged with the groove of the supporting member 40019 of the recording head 40003, so that the positions in the y and z directions are confined.

As shown in FIG. 55, the recording head 40003 forms a gap with the bottom of the groove formed between the rails 40029, and the gap is applied with the bonding agent 40028. The bonding material 40028 is applied at least three positions in the groove 40030. If the bonding agent 40028 has a sufficient rigidity, the bonding force may be weaker than in the foregoing embodiment, thus permitting wider choice.

When the recording head 40003 is fixed on the carriage 40005, the height between the connecting portion 40005*e* of the carriage 40005 and the nozzle of the recording head, is determined by the recording apparatus, and therefore, the positional deviation of each of the recording heads 40003 is determined by the manufacturing accuracy of the carriage 40005 of the apparatus. Therefore, the deviation in y and z directions other than x direction, have all been corrected when it is mounted on the carriage. The correction in the x direction (main scan direction) can be effected by electrically deviating the ink ejection timing for the respective recording heads on the basis of detection of the deviation in the record, according to the prior art.

A further embodiment of the recording head mounting:

Referring to FIGS. 57–60, a further embodiment will be described.

Figure 57:
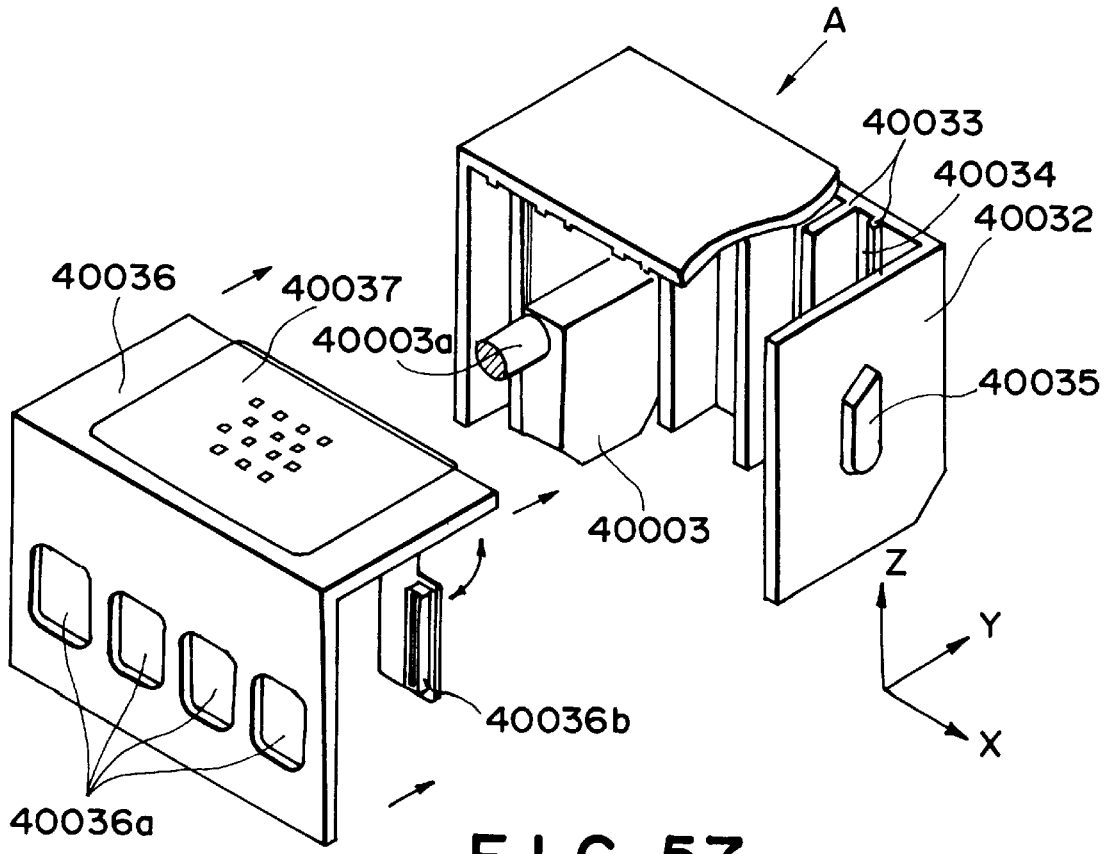
FIG. 57 illustrates a mounting structure of a recording head to a frame according to a further embodiment of the present invention.

In this embodiment, a plurality of recording heads are integrally supported on a frame, and they are mounted on the carriage as a unit. Referring first to FIG. 57, the description will be made as to the structure of the frame for supporting the recording heads 40003. The frame 40032 supports a plurality of recording heads 40003 in parallel. The internal wall of the frame 40032 is provided with a pair of ribs 40033 having different height. The recording head is fixed so that a supporting member 40019 of the recording head 40003 is set in a groove 40034 formed between the ribs 40033, without the supporting member 40019 contacting the bottom of the groove 40034. A higher rib serves to enhance the strength of the frame 40032.

On the outer side wall of the frame 40033, a slide projection 40035 is formed, which is used for engagement with the carriage, which will be described hereinafter.

The material of frame 40032 is influential to the rigidity of the frame 40032, and therefore, it is selected in consideration of deformation of the manufacturing accuracy of the frame 40032 (resistivity against ambient condition), the fixing force relative to the main assembly and deformation during handling thereof. In this embodiment, PPS containing filler material is used.

Similarly to the second embodiment, the manufacturing structure of the recording head 40003 to the frame 40032 is such that a gap is formed between the recording head and the bottom of the groove formed between the ribs 40033. The gas is supplied by an adhesive material. The adhesive material is applied at least three portions in the groove 40034, or the bonding material may be applied all over the surface. By the rigidity of the adhesive and the strength of the groove 40034, the recording head 40003 is supported, by the provision of elastic member so as to cover the adhesive, the reliability on the positioning of the recording head 40003 can be further enhanced.

In this embodiment, the adhesive is an UV adhesive material having a high strength and short tact, as a filler material, a silicone adhesive material having elasticity is also used together.

Figure 58:
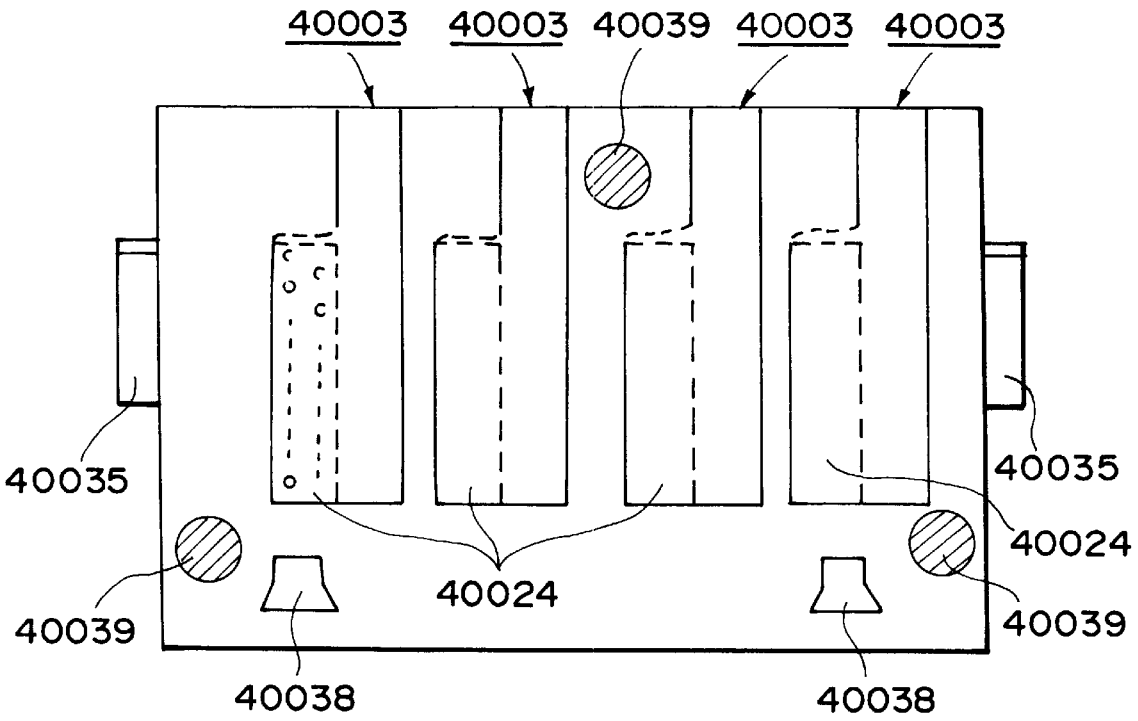
FIG. 58 illustrates a bottom side of the frame.

Designated by reference numeral 40036 is a cover covering the frame 40032, and has electrode pad 40037 of flexible cables in which the electric contacts relative to the recording head 40003 are collected at one location. The cover member 40036 has a window 40036*a* for disposing the nozzle 40003*a* of the recording head 40003. The covering member 40036 is provided with a connector 40036*b* for connecting to the recording head 40003. The connector 40036*b* is connected with the electrode pads 40037, so that the electric contact relative to the main assembly are concentrated at one position. In this embodiment, the recording head 40003 has a shift register (not shown), and therefore, the number of contacts can be reduced to less than the total number of electrodes of the recording head. The recording head is electrically connected with the main assembly of the recording apparatus through the electric contacts concentrated by the electrode pad 40037, so that the recording signal can be transmitted to each of the recording heads. In this embodiment, four recording heads 400003 are used, but the number thereof is not limited to this. As shown in FIG. 58, two holes 40038 are formed in the outer wall at the backside (arrow A direction of FIG. 57) of the frame 40032. At predetermined positions of the wall surface, three positioning projections 40039 are provided at different positions.

Figure 60:
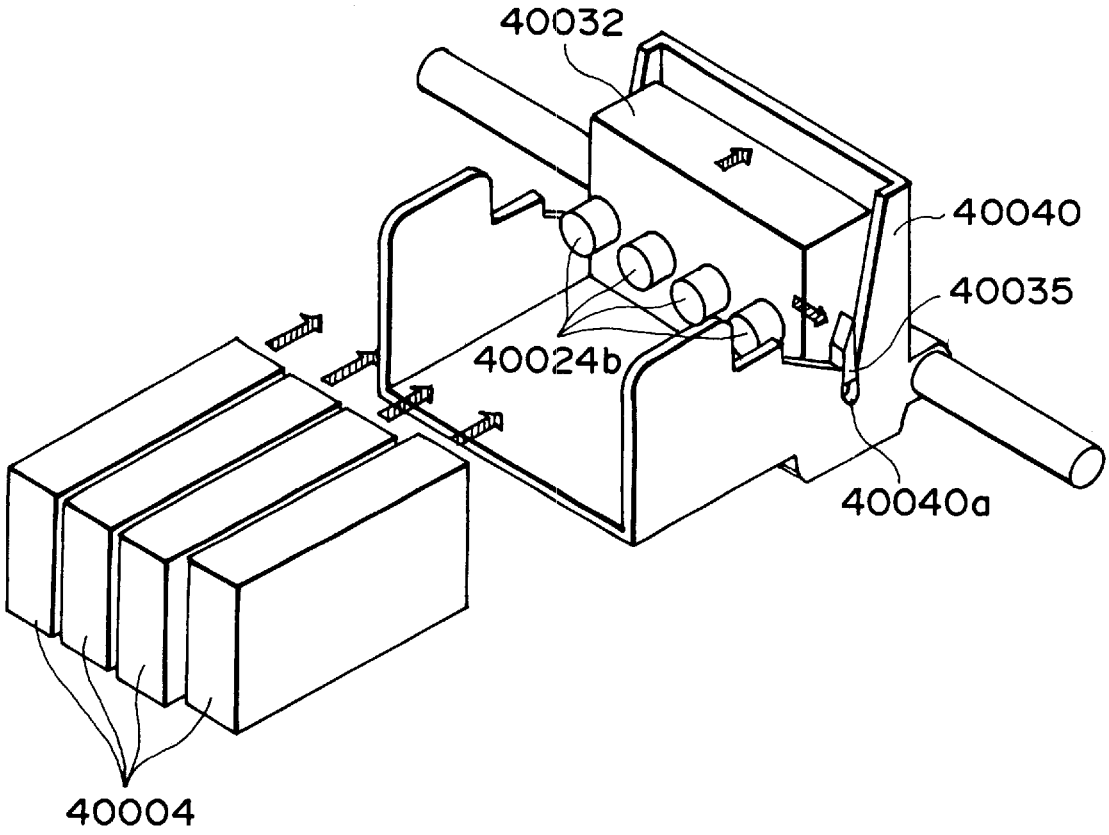
FIG. 60 illustrates a mounting structure of a frame to a carriage.

When the frame 40032 supporting the recording heads 40003 is mounted to the carriage 40040, the slide projection 40035 is slid along the slid 40040*a* formed in the carriage 40040, as shown in FIG. 60.

Figure 59:
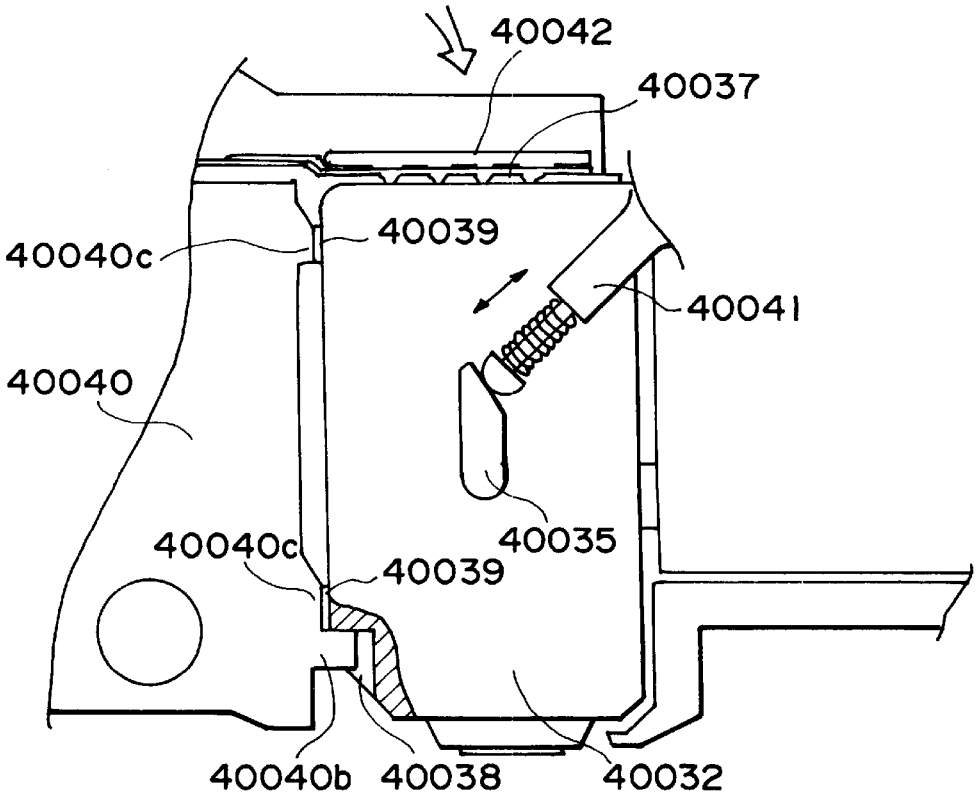
FIG. 59 illustrates a mounting structure of a frame to a carriage.

As shown in FIG. 59, the slide projection 40035 is urged to the carriage 40040 by urging member 40041 projected toward the main assembly. At this time, the positioning pins 40040*b* projected from the carriage 40040 are respectively engaged with the holes 40038. By doing so, it is positioned in x direction (main scan direction), z direction (height direction) and θy (inclination angle relative to the sub-scan direction) are determined. Simultaneously, the positioning projections 40039 of the frame 40032 are simultaneously contacted to a reference surface 40040*c* of the carriage 40040. By doing so, it is positioned in the y direction (sub-scan direction), θx (inclination angle relative to the main scan direction and θz (inclination angle in the height direction).

The electric connection with the main assembly of the apparatus is established by urging the electrode pads 40042 of the main assembly to the electrode pads 40037 of the covering member for covering the frame 40032, as shown in FIG. 59.

As shown in FIG. 60, the frame 40032 is mounted on the carriage 40040, and then, the ink containers 40004 are respectively connected with the ink supply pipes 40024*b* projected from the backside of the frame 40032. By mounting the recording head on the carriage 40040, so that, the mounting operation of the recording head 40003 is completed. The ink container 40004 is detachably mounted relative to the frame 40032.

With this structure, the plurality of recording heads 40003 are mounted on the frame 40032, by which the recording heads are constructed as a unit, thus making the head exchange operation relative to the carriage 40040 easier.

Since the recording head 40003 is mounted by way of the frame 40032 onto the carriage 40040, the possible positional deviation by the direct external force to the recording head 40003, can be effectively prevented. In addition, the recording head 40003 is prevented from direct contact to the frame 40032, and therefore, when the recording heads 40003 are unified, they can be mounted on the carriage 40040 without being influenced by the accuracy of the frame 40032, and therefore, the recording heads 40003 can be accurately positioned in all of x, y and z directions, in accordance with the accuracy of the main assembly of the recording apparatus.

It is possible that the shot position deviation of the ink droplet is measured beforehand for the recording head 40003, and the recording head 40003 is supported on the frame 40032 in consideration of the information, by which the droplet shot position deviation of each of the recording head can be collected in the recording head unit. Then, there is no need of electric timing adjustment of the ink ejection determined by the main assembly, thus simplifying the control operation. Accordingly, even if the recording head unit is exchanged, the high print quality can be maintained without the necessity of adjustment of the position in the main scan direction of the recording head.

The recording head units described in conjunction with FIGS. 52–60, is usable with the relaying connector shown in FIGS. 23–34, the positioning structure shown in FIGS. 35–29, and/or the confining members shown in FIGS. 44–51, and then, the advantageous effects of the present invention are further enhanced.

The present invention is usable with any ink jet apparatus, such as those using electromechanical converter such as piezoelectric element, but is particularly suitably usable in an ink jet recording head and recording apparatus wherein thermal energy by an electrothermal transducer, laser beam or the like used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,33 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to a maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operations are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. A recording head unit for recording with a plurality of ink jet recording heads, each of the ink jet recording heads having an ink ejection side, a side opposite therefrom and an electric contact, on a recording material, comprising:

a mounting portion for mounting the ink jet heads with a space between adjacent said recording heads with the ink ejection sides facing in a same direction and with the electric contacts exposed;

a relaying electric contact member comprising:

a plurality of first electric contact portions for making a plurality of corresponding external electrical connections, wherein said first electric contact portions are provided on a side of said relaying electric contact member opposite from a side facing the ink jet recording heads;

a plurality of second electric contact portions for electrically connecting said first electric contact portions with said recording heads, wherein said second electric contact portions each comprise an elongated elastic member having an electrical contact for extending into the space to establish electrical connection with one of the electric contacts of said recording heads, and wherein said second electric contact portions are provided so as to face said recording heads.

2. A recording head unit according to claim 1, wherein said recording head unit comprises said plurality of ink jet recording heads, and said ink jet recording heads are provided with a predetermined positional relationship maintained therebetween.

3. A recording head unit according to claim 1, wherein said second electric contact portion comprises an end electric contact for connection to said first electric contact portion, and wherein said end contact is formed from an end portion of said elastic member which has been bent into an L shape.

4. A recording head unit according to claim 1, wherein said recording head comprises a wiring board having an electric contact, whereby said electric contact of said elastic member is moved into contact with said electric contact of said wiring board.

5. A recording head unit according to claim 1, wherein said recording head unit further comprises a head supporting member positions said recording head by abutting said recording head against the head positioning portion of said head supporting member.

6. A recording head unit according to claim 5, wherein said head supporting member positions said recording head without abutting said recording head against the head positioning portion of said supporting member.

7. A recording head unit according to claim 5, wherein said head supporting member comprises and a hole, a locking recess and a guiding groove, and said relaying electric contact member includes a matching positioning pin corresponding to said hole of said head supporting member, a locking arm corresponding to said locking recess, and a guiding rib corresponding to said guiding groove, wherein when said relaying electric contact member is mounted to said head supporting member, said guiding rib is inserted into the guiding groove, and the locking arm is locked with the locking recess, and the positioning pin is engaged with the positioning hole.

8. A recording head unit according to claim 7, wherein said guiding groove and said guiding rib are pressed together by contact pressure exerted between said electric contact of said electric member and the electric contact of said recording head.

9. A recording head unit according to claim 1, wherein said recording head comprises an electrothermal transducer for generating thermal energy for ejecting the ink.

10. A recording apparatus comprising:

a recording head unit for recording with a plurality of ink jet recording heads, each of the ink jet recording heads having an ink jet ejection side, a side opposite therefrom and an electric contact, on a recording material, comprising;

a mounting portion for mounting the ink jet heads with a space between adjacent said recording heads with the ink ejection sides facing in a same direction and with the electric contacts exposed;

a relaying electric contact member comprising;

a plurality of first electric contact portions for making a plurality of corresponding external electrical connections, wherein said first electric contact portions are provided on a side of said relaying electric contact member opposite from a side facing said ink jet recording heads;

a plurality of second electric contact portions for electrically connecting said first electric contact portions with said recording heads, wherein said second electric contact portions each comprise an elongated elastic member having an electric contact for extending into the space to establish electrical connection with one of the electric contacts of said recording heads, and wherein said second electric contact portions are provided so as to face said recording heads.

11. A recording apparatus according to claim 10, wherein said recording head unit comprises said plurality of ink jet recording heads, and said ink jet recording heads are provided with a predetermined positional relationship maintained therebetween.

12. A recording apparatus according to claim 10, wherein said second electric contact member comprises an end electric contact for connection to said first electric contact member, and wherein said end contact is formed from an end portion of said elastic member which has been bent into an L shape.

13. A recording apparatus according to claim 10, wherein said recording head comprises a wiring board having an electric contact, whereby said electric contact of said elastic member is moved into contact with said electric contact of said wiring board.

14. A recording apparatus according to claim 10, wherein said recording head unit further comprises a head supporting member having a head positioning portion, wherein said head supporting member positions said recording head by abutting said recording head against the head positioning portion of said head supporting member.

15. A recording apparatus according to claim 14, wherein said head supporting member positions said recording head without abutting said recording head against the head positioning portion of said head supporting member.

16. A apparatus according to claim 14, wherein said head supporting member comprises a hole, a locking recess and a guiding groove, and said relaying electric contact member included a matching positioning pin corresponding to said hole of said head supporting member, a locking arm corresponding to said locking recess, and a guiding rib corresponding to guiding groove, wherein when said relaying electric contact member is mounted to said head supporting member, said guiding rib is inserted into the guiding groove, and the locking arm is locked with the locking recess, and the positioning pin is engaged with the positioning hole.

17. A recording apparatus according to claim 14, wherein said guiding groove and said guiding rib are pressed together by contact pressure exerted between said electric contact of said elastic member and the electric contact of said recording head.

18. A recording apparatus according to claim 10, wherein said recording head comprises an electrothermal transducer for generating thermal energy for ejecting the ink.

* * * * *

UNITED STATES PATENT AND TRADEMARK OFFICE

CERTIFICATE OF CORRECTION

PATENT NO. : 6,151,046
DATED : November 21, 2000
INVENTOR(S) : Tsutomu Abe et al.

It is certified that error appears in the above-identified patent and that said Letters Patent is hereby corrected as shown below:

Title page,
Item [56], References Cited - U.S. PATENT DOCUMENTS insert:
-- 4,630,078 12/1986 Watanabe --.

Column 2,
Line 35, "can not" should read -- cannot --.

Column 5,
Line 12, "explain" should read -- explaining --; and
Line 29, "connector" should read -- connector. --.

Column 10,
Line 37, "a" should read -- an --.

Column 11,
Line 21, "view" should read -- views --.

Column 12,
Line 27, "operatively" should read -- operativity --.

Column 16,
Line 31, "provide" should read -- provided --; and
Line 36, "1006aof" should read -- 1006 of --.

Column 20,
Line 16, "penetrate" should read -- penetrates --; and
Line 23, "doing," should read -- doing --.

Column 21,
Line 31, "the" (first occurrence) should read -- The --.

Column 23,
Line 54, "so that," should be deleted.

UNITED STATES PATENT AND TRADEMARK OFFICE

CERTIFICATE OF CORRECTION

PATENT NO. : 6,151,046
DATED : November 21, 2000
INVENTOR(S) : Tsutomu Abe et al.

It is certified that error appears in the above-identified patent and that said Letters Patent is hereby corrected as shown below:

Column 26,
Line 35, "electrical" should read -- electric --;
Line 58, "member positions" should read -- member having a head positioning portion, wherein said head supporting member positions --; and
Line 67, "and" should be deleted.

Column 27,
Line 24, "comprising;" should read -- comprising: --;
Line 29, "comprising," should read -- comprising: --; and
Line 46, "according to claim 48" should be deleted.

Column 28,
Line 26, "A" should read -- An --;
Line 29, "included" should read -- includes --; and
Line 32, "guiding" should read -- said guiding --.

Signed and Sealed this

Ninth Day of July, 2002

*Attest:*

*Attesting Officer*

JAMES E. ROGAN
*Director of the United States Patent and Trademark Office*